US006120130A

United States Patent [19]

Hirano et al.

[11] Patent Number: 6,120,130

[45] Date of Patent: Sep. 19, 2000

[54] RECORDING METHOD AND RECORDING APPARATUS

[75] Inventors: Hideki Hirano, Kanagawa; Minoru Kohno, Tokyo, both of Japan

[73] Assignee: Sony Corporation, Tokyo, Japan

[21] Appl. No.: 09/285,235

[22] Filed: Apr. 1, 1999

[30] Foreign Application Priority Data

Apr. 1, 1998 [JP] Japan ..... 10-089030

[51] Int. Cl.[7] ..... B41J 2/135; B41J 2/05

[52] U.S. Cl. ..... 347/46; 347/56; 347/61

[58] Field of Search ..... 347/46, 51, 52, 347/100, 56, 61

[56] References Cited

U.S. PATENT DOCUMENTS 5,748,211 5/1998 Shinozaki et al. ..... 347/46

5,984,457 11/1999 Taub et al. ..... 347/56

*Primary Examiner*—N. Le

*Assistant Examiner*—Juanita Stephens

*Attorney, Agent, or Firm*—Hill & Simpson

[57] ABSTRACT

Disclosed are a recording method and a recording apparatus which are superior in transfer performance such as transfer sensitivity and transfer speed. When causing ink held in a transfer section to fly upon heating by a heater to be transferred onto a transfer target member placed opposite to the transfer section, a surface tension gradient and/or an interface tension gradient is developed in the surface of the ink under the heating, and the ink is forced to fly in the form of a mist by utilizing the Marangoni flow of the ink caused by the surface tension gradient and/or the interface tension gradient.

56 Claims, 43 Drawing Sheets

EXAMPLE 1

EXAMPLE 3

EXAMPLE 6

EXAMPLE 7

EXAMPLE 8

EXAMPLE 11

EXAMPLE 12

EXAMPLE 13

EXAMPLE 24

EXAMPLE 25 (DUTY : 90%, POWER : 233mW, AVERAGE POWER : 210mW)

RECORDING METHOD AND RECORDING APPARATUS

RELATED APPLICATION DATA

The present application claims priority to Japanese Application No. P10-089030 filed Apr. 1, 1998 which application is incorporated herein by reference to the extent permitted by law.

BACKGROUND OF THE INVENTION

1. Field of the Invention

The present invention relates to a recording method and a recording apparatus utilizing the so-called thermal transfer process in which a recording material held in a transfer section is heated by heating means so as to fly toward a target member, onto which the recording material is to be transferred and which is placed opposite to the transfer section, thereby forming a predetermined transfer image on the target member.

2. Description of the Related Art

Recently, printing out such color images as processed on personal computers or picked up by video cameras and electronic still cameras, for example, has become increasingly popular for enjoyment and other purposes. That trend has increased a need for printers with the capability of producing high-quality full color images. In particular, high-quality full color images have begun to be required even in relatively inexpensive printers adapted for, e.g., personal users and small-scaled offices called SOHO (Small Offices and Home Offices).

As color printing processes, there are proposed so far color hard copy processes such as a sublimation thermal transfer process (or a dye diffusion thermal transfer process), a fusion thermal transfer process, an ink jet process, an electrophotographic process, and thermal-development silver salt process. Among these processes, the dye diffusion thermal transfer process and the ink jet process are particularly known as being able to readily produce a high-quality image with a relatively simple apparatus.

In the dye diffusion thermal transfer process, an ink layer containing a high-density transfer dye dispersed in an appropriate binder resin is coated on an ink ribbon or sheet, and the ink ribbon or sheet is brought into close contact with the so-called thermal transfer paper on which a dyeing resin accepting the transferred dye is coated. Heat is applied by a heat-sensitive recording head (thermal head) to the back side of the ink ribbon or sheet so that the transfer dye is thermally transferred from the ink ribbon or sheet onto the thermal transfer paper in accordance with the amount of heat applied.

By repeating the above operation for each of image signals decomposed corresponding to, for example, three primary colors in the subtractive color process, i.e., yellow (Y), magenta (M) and cyan (C), a full color image can be obtained which has a continuous gradation.

FIG. 71 shows the construction of a thermal head and thereabout of a printer in accordance with the dye diffusion thermal transfer process.

A thermal head 90 is disposed in an opposed relation to a platen roller 97. Between the thermal head 90 and the platen roller 97, an ink sheet 91 having an ink layer 93 coated on a base film 92 and a sheet of recording paper (thermal transfer paper) 94 having a dye resin layer (dye accepting layer) 96 coated on the surface of a sheet of paper 95, for example, run in the direction of arrow A in FIG. 71 while both the sheets are pressed against the thermal head 90 by the platen roller 97 rotating in the direction of arrow B.

Ink contained in the ink layer 93 is selectively heated by the thermal head 90 in accordance with an image to be printed, whereupon the ink is thermally diffused into the dye resin layer 96 of the recording paper 94 that is held in contact with the ink layer 93 and is hence under heating. As a result, a transfer image is formed in a dot pattern, for example.

The dye diffusion thermal transfer process is a superior technique with capabilities of reducing the size of a printer, making maintenance of the printer easier, providing immediate image formation, and producing an image with high quality comparable to that of silver salt color prints. The dye diffusion thermal transfer process however has major disadvantages in that because ink ribbons or sheets are discarded after once used, a large amount of wastes is generated and the running cost is increased. Another problems is that thermal transfer paper must be used as recording paper, which also pushes up the cost. Further, a transfer time as long as about one minute is required to form an A6-size image.

The fusion thermal transfer process enables an image to be transferred onto ordinary paper, but also has similar problems of generating a large amount of wastes and increasing the running cost because ink ribbons or sheets are discarded after once used,. Another problem is that image quality is inferior to that of silver salt prints.

The thermal-development silver salt process can produce a high-quality image, but also has similar problems of generating a large amount of wastes and increasing the running cost because specific printing paper and throwaway ribbons or sheets are used. Another problem is that the cost of an apparatus used for this process is high.

On the other hand, as the ink jet process, there are known an electrostatic attraction type, a continuous vibration generating type (piezoelectric type), a thermal type (bubble-jet type), etc. as disclosed in, for example, Japanese Patent Publication No. 61-59911 and No. 5-217. In any type, printing is performed such that small droplets of ink are forced to eject from nozzles provided in a printer head and stick onto a sheet of printing paper or the like.

With the ink jet process, therefore, an image can be transferred onto ordinary paper, and no use of ink ribbons, etc. makes it possible to hold down the running cost and essentially avoid generation of wastes. In response to needs for simple printing of color images, this process has become increasingly used recently.

However, the ink jet process (particularly the on-demand type ink jet process) has a difficulty in achieving a density gradation per pixel from its own principles, and hence has a difficulty in reproducing such a high-quality image in a short time as being obtainable with the dye diffusion thermal transfer process and comparable to that of silver salt prints. Stated otherwise, in the ink jet process, since one droplet of ink constitutes one pixel, it is difficult to achieve a density gradation per pixel from the standpoint of principles. For this reason, a high-quality image cannot be formed. Although a method of realizing a pseudo-gradation with the dither process by making use of a high resolution of the ink jet process is attempted, this method cannot provide image quality comparable to that obtainable with the dye diffusion thermal transfer process, and lowers the transfer speed considerably.

Lately, there have also appeared, for example, an ink jet process wherein diluted ink is employed to provide a two- or three-level gradation, and an ink jet process wherein the size of ink droplets is reduced. Using the diluted ink however has problems that transfer heads must be prepared in several levels, thus resulting in a higher head cost, and a large amount of solvents absorbed in the same pixel raises a difficulty in design of printing paper, thus resulting in a higher running cost. Further, the principles of the on-demand type ink jet process have such a limitation that it is difficult to reduce the size of each ink droplet down to be smaller than one picoliter. For this reason, a satisfactory fine density gradation of 64 or more levels cannot be obtained in a unit pixel. For an image such as a natural picture, particularly, the on-demand type ink jet process has difficulties in providing image quality comparable to that obtainable with the dye diffusion thermal transfer process and silver salt prints.

The electrophotographic process is realized with a low running cost and a high transfer speed, but cannot provide image quality comparable to that obtainable with silver salt prints, and in addition requires an apparatus having a considerably expensive cost.

As a color printing process that can satisfy the demands mentioned above, the so-called dye vaporization thermal transfer process has been proposed (see, e.g, Japanese Unexamined Patent Publication No. 9-183239 and No. 9-183246).

In the dye vaporization thermal transfer process, ink is heated in a transfer section of a printer head so as to fly based on such a phenomenon as vaporization or ablation. The flying ink sticks to the surface of a target member (a sheet of printing paper such as a printer sheet), onto which an image is to be transferred and which is placed opposite to the printer head with a gap on the order of, e.g., 50 to 100 $\mu$m left between them, thereby forming a transfer image.

The transfer section has an ink holding structure in the form of such a concave/convex structure that a large number of pillar or columnar members having a width or diameter of about 2 $\mu$m and a height of about 6 $\mu$m, for example, are arranged to stand vertically with small gaps of about 2 $\mu$m therebetween. A heater is provided in a lower portion of the ink holding structure to constitute a vaporizing section (transfer section).

With the transfer section including the above ink holding structure, the following advantages (1) to (4) are obtained.

(1) Ink is spontaneously supplied to the vaporizing section based on a capillary phenomenon.

(2) Ink can be efficiently heated due to a large surface area.

(3) By properly setting the height of the pillar members, a predetermined amount of ink can be always held in the vaporizing section.

(4) Since the surface tension of a liquid generally exhibits a negative temperature coefficient, locally heated ink is subject to a force tending to move the ink toward an outer periphery at a lower temperature. The movement of the ink is however minimized by the ink holding structure, and hence a reduction in transfer sensitivity is prevented.

Accordingly, it is possible to fly ink in an amount corresponding to the amount of heat applied to the vaporizing section for transfer onto a sheet of printing paper or the like, to achieve continuous control of the amount of transferred ink, and to provide a density gradation in each pixel. As a result, a high-quality image comparable to that obtainable with silver salt prints, for example, can be obtained.

Also, no need of using ink ribbons and so on reduces the running cost. In addition, by using ink that has high absorption to ordinary paper, image transfer onto ordinary paper can be achieved and the use of ordinary paper also contributes to further reducing the running cost.

Moreover, since the dye vaporization thermal transfer process utilizes vaporization of ink, i.e., dyes, the transfer section of the printer head for heating the ink needs to be neither pressed against a transfer target member such as a sheet of printing paper under a high pressure, nor brought into contact therewith. This obviates a problem of thermal fusion adhesion between an ink heating member such as an ink ribbon and a transfer target member such as a sheet of printing paper, which problem possibly occurs in the other thermal transfer processes.

With the conventional dye vaporization thermal transfer process disclosed in Japanese Unexamined Patent Publication No. 9-183239 and No. 9-183246, however, since ink is forced to fly for transfer with vaporization or ablation under heating and most of the flying ink is a vaporized matter in the form of a single molecule (including a small mist particle with a diameter of 1 $\mu$m or less that is created by condensation of ink molecules in the gap), the transfer sensitivity (OD=optical density) is reduced (that is to say, the transfer speed is lowered) and the reproducibility may differ depending on quality of printing paper. Further, since the volume of the flying ink is too small, the flying ink loses a speed at once, and the gap between the transfer section of the printer head and the transfer target member cannot be increased in length. This results in that paper powder or dust adhering to the surface of the transfer target member may in turn adhere to the transfer section and cause unevenness in a transfer image.

Also, while ink is vaporized or ablated in the transfer section, impurities such as silica particles and metal powder, which are contained in trace amount in the ink and have the relatively high boiling points, are hard to vaporize and are accumulated in the transfer section. Eventually, fusing of the accumulated impurities may occur and deteriorate a transfer capability over time. In addition, if the boiling point of a solvent in the ink is much lower than that of dyes therein, only the solvent is selectively evaporated, causing the dyes to precipitate in the transfer section. This results in a problem that a range in which used solvents are selectable is narrowed.

SUMMARY OF THE INVENTION

In view of the state of art set forth above, an object of the present invention is to provide a recording method and a recording apparatus which are superior in transfer performance such as transfer sensitivity and transfer speed.

As a result of conducting intensive studies, the inventor has found that recording of an image is achieved with superior transfer performance such as transfer sensitivity and transfer speed, by developing a surface tension gradient and/or an interface tension gradient in the surface of ink under heating, and forcing the ink to fly based on flowage of the ink (particularly due to the Marangoni flow or surface tension convection) caused by such a tension gradient.

More specifically, the present invention provides a recording method including the steps of forcing a recording material held in a transfer section to fly upon heating by heating means and transferring the recording material onto a transfer target member that is placed opposite to the transfer section, wherein the method comprises the steps of developing a surface tension gradient and/or an interface tension gradient in the surface of the recording material under the heating, and flying the recording material by utilizing flowage of the recording material caused by the surface tension gradient and/or the interface tension gradient (referred to as the recording method of the present invention hereinafter).

With the recording method of the present invention, a surface tension gradient and/or an interface tension gradient is developed in the surface of a recording material (ink) under, e.g., resistance heating or laser-beam heating, and the recording material is forced to fly by utilizing flowage of the recording material caused by the surface tension gradient and/or the interface tension gradient. Therefore, the recording material can be forced to fly in the form of a mist including relatively larger mist particles than that obtained in the case of flying the recording material by utilizing vaporization to produce driving forces. As a result, the transfer sensitivity per unit time is improved, whereby a recording method superior in transfer sensitivity and transfer speed can be realized.

In particular, the recording method of the present invention can efficiently force the above-mentioned mist to fly in the form of relatively larger particles having diameters not smaller than 2 $\mu$m, for example, (those particles be referred to as large mist particles hereinafter and can be observed with a stroboscope or the like). The large mist particle has a volume about 1000 times as much as those of vaporized matters and small mist particles produced by the conventional dye vaporization thermal transfer process. Accordingly, the transfer sensitivity per unit time can be improved on the order of 2 to 10 times.

Further, with the recording method of the present invention, since a surface tension gradient and/or an interface tension gradient is developed in the surface of the recording material and flowage of the recording material caused by such a gradient is utilized as driving forces to fly the recording material, it requires energy to be supplied for heating only about ½ to ⅓ of that required in the conventional dye vaporization thermal transfer process which utilizes vaporization or ablation alone, and can avoid fusing of nonvolatile impurities in the recording material. In total, the recording method of the present invention can increase the operating efficiency 4 to 30 times that obtainable with the conventional dye vaporization thermal transfer process. Additionally, the gap between the transfer section and the transfer target member can be so increased as to prevent dust etc. from adhering to the transfer section.

Note that, in the recording method of the present invention, the recording material is forced to fly upon the induced flowage in the form of a mist made up of relatively large particles (large mist particles), but at the same time vaporized matters, small mist particles, etc. are also probably forced to fly therewith. The "flying matters" in the recording method of the present invention therefore include those vaporized matters, small mist particles, etc., as well as the large mist particles.

Also, the present invention provides, as a recording apparatus capable of implementing the recording method of the present invention, a recording apparatus comprising a transfer section disposed opposite to a transfer target member, heating means for heating a recording material held in the transfer section to fly the recording material, and recording material flying means for developing a surface tension gradient and/or an interface tension gradient in the recording material under the heating, and flying the recording material by utilizing flowage of the recording material caused by the surface tension gradient and/or the interface tension gradient (referred to as a recording apparatus of the present invention hereinafter).

In the recording apparatus (particularly a printer head) of the present invention, the "recording material flying means" includes, e.g., a signal applied to the heating means, means for applying the signal, a recording material holding structure for holding the recording material, and so on.

DESCRIPTION OF THE PREFERRED EMBODIMENT

Figure 1A:
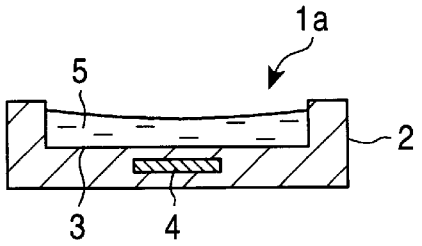
FIGS. 1A to 1G are schematic views for explaining principles of transfer according to a recording method of the present invention.

The recording method of the present invention and the recording apparatus of the present invention (referred to also simply as the present invention hereinafter) will be described below.

With the present invention, in a recording apparatus (printer head) comprising a transfer section for transferring ink onto a transfer target member placed opposite to the transfer section, an ink supply passage for supplying the ink to the transfer section, heating means for heating the ink supplied to the transfer section, and ink holding means for holding the ink in a predetermined thickness in the transfer section, an ink mist (including large mist particles, small mist particles and vaporized matters; this is equally applied to "ink mist" appearing below) is forced to fly by utilizing, as driving forces, ink flow (flowage; this is equally applied to "flow" appearing below), i.e., the so-called Marangoni flow, caused by a surface tension gradient in an ink surface in accordance with a temperature gradient developed in a heating area (area near the heating means; this is equally applied to "heating area" appearing below) upon heating by the heating means in a direction from the heating area to a peripheral area, the flying ink being stuck and fixed onto the transfer target member which is placed opposite to the transfer section.

Also, in a recording apparatus comprising a transfer section for transferring ink onto a transfer target member placed opposite to the transfer section, an ink supply passage for supplying the ink to the transfer section, heating means for heating the ink supplied to the transfer section, and ink holding means for holding the ink in a predetermined thickness in the transfer section, an ink mist is forced to fly by utilizing, as driving forces, cyclic ink flowage attributable to ink flow, i.e., the so-called Marangoni flow, caused by a surface tension gradient in an ink surface in accordance with a temperature gradient developed in a heating area upon cyclic heating by the heating means in a direction from the heating area to a peripheral area, and ink flow caused by a meniscus restoring force and/or a capillary attraction between the ink and the transfer section developed in the ink surface during cooling from the peripheral area to the heating area, the flying ink being stuck and fixed onto the transfer target member which is placed opposite to the transfer section.

When the ink flows cyclically in the transfer section based on the principle of the above-mentioned cyclic flowage, at least one of the heating power, heating cycle, surface tensions of the ink during the heating and during the cooling, interface tensions between the ink and a bottom surface of the transfer section during the heating and during the cooling, size of the heating means, and thickness of an ink layer is set so that at least a part of the bottom surface of the transfer section is exposed upon the ink flow moving from the heating area to the peripheral area during the heating, and the exposed part of the bottom surface of the transfer section is completely covered by the ink upon the ink flow moving from the peripheral area to the heating area during the cooling. This enables an ink mist to be forced to fly by utilizing, as driving forces, cyclic movement of the boundary between the ink surface and the exposed bottom surface of the transfer section, i.e., cyclic movement of a gas—solid—liquid line, the flying ink being stuck and fixed onto the transfer target member which is placed opposite to the transfer section.

Further, in a printer head comprising a transfer section for transferring ink onto a transfer target member placed opposite to the transfer section with a gap left therebetween, an ink supply passage for supplying the ink to the transfer section, heating means for cyclically heating the ink supplied to the transfer section, ink holding means for holding the ink supplied to the transfer section in a predetermined thickness, and four or more pillar structures, conical structures, or similar concave/convex structures each arranged within the distance of 20 $\mu$m from the center position (barycenter) of the heating means in the transfer section and having a height not smaller than 1 $\mu$m but not larger than 50 $\mu$m, a representative width dimension (width) not smaller than 1 $\mu$m but not larger than 10 $\mu$m, and a center-to-center distance not smaller than 2 $\mu$m but not larger than 40 $\mu$m, those structures being arranged in a cyclic or not-cyclic pattern, an ink mist is forced to fly by utilizing, as driving forces, interactions including cyclic flowage of the ink attributable to the ink flow, i.e., the so-called Marangoni flow, caused by a surface tension gradient in an ink surface in accordance with a temperature gradient developed in a heating area during heating upon cyclic heating by the heating means in a direction from the heating area to a peripheral area, and ink flow caused by a meniscus restoring force and/or capillary attractions among the ink, the transfer section and the concave/convex structure developed in the ink surface during cooling from the peripheral area to the heating area, as well as collision between the concave/convex structure and a wave of the ink flowage (traveling wave), the flying ink being stuck and fixed onto the transfer target member which is placed opposite to the transfer section.

When the ink flows cyclically in the transfer section based on the principle of inducing the above-mentioned interactions, the heating power, heating time, cooling time, surface tensions of the ink during the heating and during the cooling, interface tensions between the ink and the transfer section during the heating and during the cooling, size of the heating means, thickness of an ink layer, thermal conductivity of an underlying base, thickness, thermal conductivity, etc. of a heat insulating layer between the heating means and the underlying base, and size, number, shape, interval and array of the concave/convex structures are set so that at least a part of a bottom surface of the transfer section, except the concave/convex structures, is exposed upon the ink flow moving from the heating area to the peripheral area during the heating, and the exposed part of the bottom surface of the transfer section is always not completely covered by the ink upon the ink flow moving from the peripheral area to the heating area during the cooling. This enables an ink mist to be forced to fly by utilizing, as driving forces, interactions including cyclic movement of the boundary between the ink surface and the exposed bottom surface of the transfer section, i.e., cyclic movement of a gas—solid—liquid line, and collision between the traveling wave accompanying such a movement and the concave/convex structure, the flying ink being stuck and fixed onto the transfer target member which is placed opposite to the transfer section.

Moreover, when the ink flows cyclically in the transfer section based on the principle of inducing the above-mentioned interactions, the heating power, heating time, cooling time, surface tensions of the ink during the heating and during the cooling, interface tensions between the ink and the transfer section during the heating and during the cooling, size of the heating means, thickness of an ink layer, thermal conductivity of an underlying base, thickness, thermal conductivity, etc. of a heat insulating layer between the heating means and the underlying base, and size, number, shape, interval and array of the concave/convex structures are set so that at least a part of a bottom surface of the transfer section, except the concave/convex structures, is exposed upon the ink flow moving from the heating area to the peripheral area during the heating, and the exposed part of the bottom surface of the transfer section is not always completely covered by the ink upon the ink flow moving from the peripheral area to the heating area during the cooling. This enables an ink mist to be forced to fly by utilizing, as driving forces, interactions including cyclic movement of the boundary between the ink surface and the exposed bottom surface of the transfer section, i.e., cyclic movement of a gas—solid—liquid line, and collision between the resultant traveling wave and the concave/convex structure, the flying ink being stuck and fixed onto the transfer target member which is placed opposite to the transfer section.

With the recording method of the present invention, the recording material is given a temperature gradient upon heating by the heating means to develop at least the surface tension gradient (preferably the interface tension gradient as well) in accordance with the temperature gradient, and resulting flowage of the recording material is utilized as driving forces to fly the recording material in the form of a mist. Here, among the large mist particles, the small mist particles and the vaporized matters, as described above, at least the large mist particles are included in the form of a mist.

Though described later in detail, the flowage of the recording material (especially the flowage in the initial stage) may be produced in a direction from the heating area near the heating means to the peripheral area away from it (see FIGS. 1 and 2), or in an opposed direction (i.e., from the peripheral area to the heating area, see FIG. 3).

The flowage of the recording material can be produced by generating at least one of flowage of the recording material from the heating area to the peripheral area during heating, and flowage of the recording material caused by a meniscus restoring force and/or a capillary attraction in the transfer section from the peripheral area to the heating area during cooling.

Further, in the present invention, the recording material can be forced to fly based on at least one of collision between a traveling wave of the recording material flowing from the heating area to the peripheral area and recording material holding means for holding the recording material in the transfer section, collision between a traveling wave of the recording material flowing from the peripheral area to the heating area and the recording material holding means, collision between a traveling wave of the recording material flowing from the heating area to the peripheral area and a traveling wave of the recording material flowing from the peripheral area to the heating area, and resonation of a standing wave of the recording material with a traveling wave of the recording material flowing from the heating area to the peripheral area and a traveling wave of the recording material flowing from the peripheral area to the heating area.

With the recording method of the present invention, the recording material is forced to fly based on the above-described flying principle, but any other flying principles other than described above are also applicable to the present invention. For example, two or more traveling waves can be generated to collide against each other by providing two or more heating means in one transfer section, and energizing the heating means to heat simultaneously or at predetermined cycles. Also, two or more different flying principles may be utilized at the same time.

Among the following types of the Marangoni flow;

(1) the Marangoni flow caused by the surface tension gradient in the recording material in accordance with the temperature gradient, (2) the Marangoni flow caused by the interface tension gradient between the recording material and the bottom surface of the transfer section in accordance with the temperature gradient, (3) the Marangoni flow caused by a density distribution of a substance constituting the recording material, and (4) the Marangoni flow caused by selective evaporation of a surfactant contained in the recording material, at least the Marangoni flow caused by the surface tension gradient may be utilized to cause the flowage of the recording material.

While the present invention employs the above transfer principles (1) to (4) for developing the surface tension gradient, etc. to produce the Marangoni flow, any surface tension gradients (and/or any interface tension gradients) developed based on other principles than described here can be utilized in the present invention. Also, two or more of those surface tension gradients may be developed at the same time.

In the present invention, preferably, the heating means performs cyclic heating to flow the recording material cyclically.

Also, the recording material may be forced to flow such that at least a part of the bottom surface of the transfer section is exposed.

In such a case, by way of example, the bottom surface of the transfer section may be cyclically exposed and covered with the flowage of the recording material, or an exposed area of the bottom surface of the transfer section may be cyclically moved. Alternatively, the exposed area of the bottom surface of the transfer section may not be completely covered and cyclically moved.

Further, in the present invention, it is desired that a recording material holding structure (ink holding structure or pillar structure) for holding the recording material based on a capillary phenomenon is disposed in the transfer section.

The recording material holding structure may comprise a small concave/convex structure (or pillar structure). A part of the recording material holding means can be constituted by the small concave/convex structure.

The concave/convex structure may be formed by at least four pillar or conical projections each arranged within the range of 20 μm from the center of the heating area and having a height not smaller than 1 μm but not larger than 50 μm, a width not smaller than 1 μm but not larger than 10 μm, and a center-to-center distance not smaller than 2 μm but not larger than 40 μm. Also, the concave/convex structure may be arranged in a cyclic or not-cyclic pattern. In the small concave/convex structure, concave portions serve as dye (ink) containing portions and convex portions serve as the ink holding means.

In the present invention, preferably, the recording material held near the heating means vaporizes or boils only from the gas and liquid interface.

The present invention makes it sufficiently possible that an amount of the recording material (ink mist) forced to fly upon the flowage of the recording material is kept not larger than one pico-liter. Therefore, a fine density gradation can be realized at, e.g., 64 levels within a unit pixel.

In the present invention, the recording material holding means may comprise a wall provided within the range of 50 μm from the center of the heating area on at least one side thereof, the wall having a height not smaller than 1 μm but not larger than 50 μm. Stated otherwise, it is desired that a wall is formed to provide the recording material holding means for holding the ink in a predetermined thickness in the transfer section. The wall may serve as a partition for holding the ink, or an auxiliary wall for adjusting the ink meniscus.

The recording material holding means preferably comprises a member having an opening formed to position above the heating area, the member having an opening area not smaller than 1000 $\mu m^2$ but not larger than 50000 $\mu m^2$, the member defining a thickness of the recording material to be not smaller than 1 μm but not larger than 50 μm, and mist particles of the recording material flying from the transfer section have a maximum cross-sectional area, in terms of perfect sphere, not more than 1/10 of the opening area.

The member having the opening may be a plate-like member made of, e.g., a metal, high polymer or ceramic, or a film-like member.

As an alternative, the recording material holding means preferably comprises a member having a slit formed to position above the heating area, the slit having an average width not smaller than 30 μm but not larger than 500 μm, the member defining a thickness of the recording material to be not smaller than 1 μm but not larger than 50 μm, and mist particles of the recording material flying from the transfer section have a diameter, in terms of perfect sphere, not more than 1/3 of the average width of the slit.

The member having the slit may also be a plate-like member made of, e.g., a metal, high polymer or ceramic, or a film-like member.

In the present invention, the recording material may be held in the transfer section and defined in its thickness only by the recording material holding means.

The means for holding the ink in a predetermined thickness in the transfer section may comprise only the pillar structures, the conical structures (circular cones, triangular pyramids, etc.), or the similar concave/convex structures, mentioned above, each having a height not smaller than 1 μm but not larger than 50 μm. Thus the thickness of the ink held by such recording material holding means can be held in the range of not smaller than 1 μm but not larger than 50 μm.

Further, the thickness of the ink held in the transfer section can be defined only by a wall, a structure like a groove, a member having an opening (i.e., a lid member), or the concave/convex structure mentioned above with no needs of outlet ports such as nozzles or orifices.

In the present invention, a contact angle $\theta_1$ of the recording material with respect to the bottom surface of the transfer section and a side or back surface of the recording material holding means is preferably not larger than 60° at temperatures not lower than 0° C. but not higher than 200° C. Stated otherwise, it is desired that a contact angle $\theta_1$ of the ink with respect to a side surface of the wall, a side surface of the structure like a groove, a side surface of the concave/convex structure, a bottom surface of the member having an opening, or the bottom surface of the transfer section is not larger than 60° in the above temperature range.

Also, a contact angle $\theta_2$ of the recording material with respect to an upper portion surface of the recording material holding means and a side surface of an opening in a member, which has the opening formed to position above the heating area and defines a thickness of the recording material, is preferably not smaller than 75°. Stated otherwise, it is desired from the point of forming satisfactory meniscus that a contact angle $\theta_2$ of the ink with respect to an upper portion of the wall, an upper portion of the structure like a groove, upper and top portions of the concave/convex structure, or a side surface of the member having an opening (through which the mist is allowed to pass) is not smaller than 75°.

To make the contact angle $\theta_2$ of the recording material not smaller than 75°, in particular, the recording material holding means and/or the member having the opening may be made of a liquid repellent material, or the recording material holding means and/or the member having the opening may be treated (e.g., by fluorine coating) to be liquid repellent. In this case, the member having the opening is preferably disposed on the same side as the transfer target member with a predetermined gap left between the member and the surface of the recording material.

In the present invention, it is desired that the transfer section is made of materials containing not less than 90% by weight of a substance that has thermal conductivity not less than 1 W/m·K at temperatures not lower than 0° C. but not higher than 200° C. A higher value of the thermal conductivity provides a faster on/off response and enables the driving frequency to be increased correspondingly.

In the present invention, the heating means may comprise resistance heating means (referred to also as a heater hereinafter) provided below the transfer section and having a maximum size not larger than 60 μm. A shape of the heater is not particularly restricted. When the heater shape is square (or rectangular), for example, the length of one side is preferably not larger than 42 μm. When the heater shape is circular (or elliptic), the diameter (or the length of the longer axis) is preferably not larger than 60 μm.

Further, in the present invention, an opto-thermic transducing substance may be contained as at least a part of substances making up the recording material, and the recording material may be forced to fly by using a laser beam as the heating means and irradiating the laser beam to the opto-thermic transducing substance.

Alternatively, an opto-thermic transducing substance may be added to at least a part of substances making up the transfer section, and the recording material may be forced to fly by using a laser beam as the heating means and irradiating the laser beam to the opto-thermic transducing substance.

Stated otherwise, thermal energy for the heating can be supplied by using a semiconductor laser, for example, as the heating means, and irradiating a laser beam emitted from the semiconductor laser to an opto-thermic transducing substance which is able to transduce optical energy into thermal energy (see Japanese Unexamined Patent Publication No. 8-169171 and No. 8-336992).

In the present invention, preferably, a stuff having the boiling point not lower than 250° C. at the atmospheric pressure is selected as the recording material (ink). By using such an ink stuff, it is possible to prevent evaporation of the ink in an inoperative mode or boiling of the ink during the transfer operation, and to achieve stable ejection of the ink.

Also, preferably, a stuff producing a pyrolysate of not larger than 100 ppm when heated at the normal pressure and a temperature of 200° C. in air for one hour, is selected as the recording material (ink). By using such an ink stuff, it is possible to prevent pyrolysis of the ink during the transfer operation, and to achieve stable ejection of the ink.

In the present invention, a distance between the surface of the recording material held in the transfer section and the transfer target member is preferably set to be not smaller than 50 $\mu$m but not larger than 2000 $\mu$m.

In the present invention, it is desired that the cyclic heating is performed by applying a rectangular-wave signal having a duty of not smaller than 20% to the heating means (especially the resistance heating means). Therefore, the recording apparatus of the present invention may include signal applying means for applying the rectangular-wave signal. Also, when the laser beam is used as the heating means, a driving signal with a similar waveform can be applied (this point will be equally applied to the following description).

As an alternative, the cyclic heating is preferably performed by applying a triangular or sawtooth signal having a duty of not smaller than 20% to the heating means (especially the resistance heating means). Therefore, the recording apparatus of the present invention may include signal applying means for applying the triangular or sawtooth signal.

Particularly, it is desired in the present invention that the cyclic heating is performed by applying a pulse signal having a duty of not smaller than 40% but not larger than 80% and power not smaller than 130 mW but not larger than 210 mW (especially in the range of 160 mW to 170 mW) to the heating means (especially the resistance heating means). Therefore, the recording apparatus of the present invention may include signal applying means for applying the pulse signal. Incidentally, the duty and the power largely depend on the type of the recording material, the shape of the concave/convex structure, the distance of the gap, the size of the heating means, thermal conductivities of the underlying base and the heat insulating layer, the thickness of the heat insulating layer, the thickness of the ink layer, etc., and they may be changed case by case depending on various conditions. It is particularly desired that the above-mentioned power and duty ranges are applied when the thickness of the heat insulating layer ($SiO_2$ layer) is about 2 $\mu$m and the heater size is about 2 $\mu$m square.

Also, preferably, the pulse signal and an interval (pause period; this will be equally applied to "interval" appearing below) are applied within a period of time necessary for forming one pixel. With the presence of the interval, there occurs the flowage of the ink attributable to the meniscus restoring force and/or the capillary attraction between the ink and the transfer section from the peripheral area to the heating area during cooling so that a predetermined amount of ink may be properly supplied to the transfer section.

In the present invention, the transfer target member (printing paper) preferably comprises a sheet of porous printing paper having an average pore size not smaller than 0.05 $\mu$m but not larger than 20 $\mu$m is used as. By using the porous printing paper having such a range of the average pore size, the transfer operation can be achieved with good reproducibility.

In the present invention, the recording material may be added with a surfactant having the boiling point 20° C. or more lower than that of a solvent of the recording material at the normal pressure. By adding such a surfactant, the Marangoni flow caused by selective evaporation of the surfactant contained in the recording material, as mentioned above, can be produced.

Moreover, it is desired in the present invention that the heating means comprises a plurality of heating means provided in one transfer section, or that the heating means comprises ring-shaped heating means provided in one transfer section. Stated otherwise, the heating means provided in one transfer section may comprise a plurality of heating means (heaters, opto-thermic transducers or the likes) in the form divided into two, three, four or more separate units, or comprise a heating means having a ring-like or any other suitable shape.

Next, the operation of the present invention will be described below.

The inventor has found the fact as follows. By stabilizing the thickness of an ink layer formed in the transfer section, particularly, in the range of 1 $\mu$m to 5 $\mu$m, locally heating the ink by heating means (e.g., a heater) provided in the transfer section, and applying a predetermined signal to the heating means, the temperature of the ink surface near the heating means rises to reduce the surface tension of the ink having a negative temperature coefficient. Accordingly, the ink exhibits a surface tension gradient between a heating area (i.e., an area near the heating means) and a peripheral area (i.e., an area away from the heating means), causing the ink in the heating area to flow toward the peripheral area. This local ink flowage develops shearing forces with which an ink mist having a size not larger than one pico-liter (including mist particles with a diameter not smaller than 2 $\mu$m) is generated.

Such a convection caused by the surface tension gradient is called Marangoni flow (Marangoni convection or surface tension convection) (see, e.g., "Applied Physics Handbook", p. 329, Maruzen, and "*Netsushori* (Heat Treatment)", Vol. 33, No. 3, pp. 150–153).

Ejection of an ink mist based on the Marangoni flow can be stably and continuously developed, for example, by locally heating the ink in a cyclic manner. More specifically, when the ink is heated by the heating means, ink flowage occurs based on the Marangoni flow, and when the heating by the heating means is stopped (i.e., when the ink is cooled), the ink is forced to flow in the direction to restore the ink surface to the initial state before the heating due to a meniscus restoring force of the ink surface itself or a capillary attraction between the ink surface and the surface of the transfer section; namely there occurs ink flowage directing from the peripheral area to the heating area. With such ink flowage repeated in opposite directions, small ink mist particles (as well as, in particular, the above-mentioned large mist particles) are continuously ejected from the area of the transfer section near the heating means.

FIGS. 1A to 1G are schematic views for explaining principles of transfer according to the recording method of the present invention based on the Marangoni flow.

As shown in FIG. 1A, ink 5 is pooled in a transfer section 1*a* and restricted in thickness by, e.g., an ink holding means (corresponding to walls or a concave/convex structure) 2.

When a heater 4 disposed in a lower portion of the ink holding means 2, i.e., below the transfer section 1*a*, is heated, heat generated by the heater 4 is conducted to the surface of the ink 5, and the surface tension of the ink 5 in an area near the heater 4 (i.e., a heating area) is reduced.

Figure 1B:
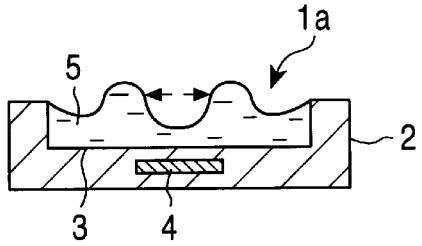

The ink positioned just above the heater 4 is then attracted toward the ink that is positioned around the heater 4 (in a peripheral area) and exhibits a higher surface tension. The ink surface is thereby changed, as shown in FIG. 1B, to produce ink traveling waves in the outward direction (or the directions indicated by arrows in the figure).

Figure 1C:
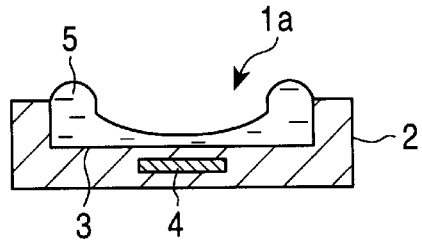
Figure 1D:
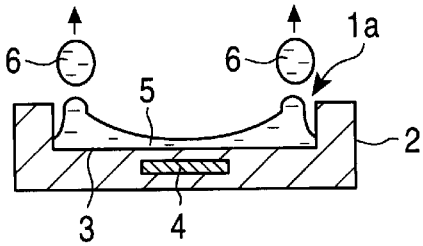
Figure 1E:
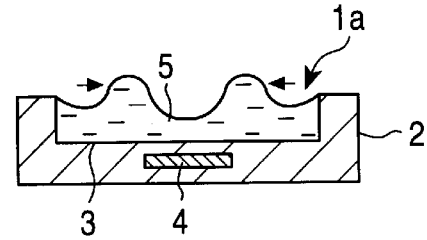

Subsequently, as shown in FIG. 1C, when the outward ink traveling waves strike against the ink holding means 2, a speed component of the flowing ink 5 is changed into the upward direction, causing the ink surface to swell upward along the ink holding means 2. Thus a part of the ink is ejected upward in the form of a mist or mist particles 6, as shown in FIG. 1D.

Figure 1F:
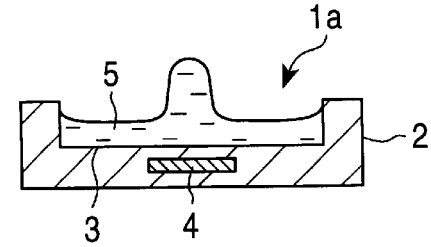
Figure 1G:
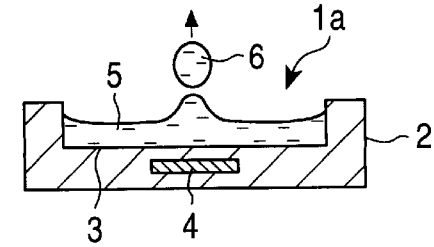

After that, the heating by the heater 4 is stopped and the ink surface is cooled. When the difference in surface tension between the area near the heater (heating area) and the area away from the heater (peripheral area) reduces, there occur ink traveling waves in the inward direction, as indicated by arrows in FIG. 1E, due to the meniscus restoring force or the capillary attraction developed by the surface of the transfer section. The inward ink traveling waves strike against each other, e.t., at the center of the heater as shown in FIG. 1F, whereupon a part of the ink is ejected upward in the form of the mist or mist particles 6, as shown in FIG. 1G. With the above operation repeated cyclically, the ink mist is continuously ejected. Incidentally, a bottom surface 3 of the transfer section 1*a* is not exposed during the above process.

The transfer according to the recording method of the present invention mainly bases on four principles or mechanisms below, including ones utilized in the transfer operation shown in FIGS. 1A to 1G.

(1) Collision between Outward Ink Traveling Wave and Ink Holding Means

A wave of the ink produced with the Marangoni flow under heating and traveling outward (i.e., an ink traveling wave directing from the heating area to the peripheral area) strikes against the ink holding means such as a structure in the form of a wall, groove or the like, the periphery of a lid having an opening formed therein, or a group of pilar structures, conical structures or similar concave/convex structures, whereupon a horizontal speed component of the traveling wave is changed into the direction toward a transfer target member. As a result, the ink is ejected in the direction toward the transfer target member primarily in the form of a mist not larger than one pico-liter.

(2) Collision between Inward Ink Traveling Wave and Ink Holding Means

A wave of the ink produced upon extinction of the Marangoni flow under cooling and traveling inward (i.e., an ink traveling wave directing from the peripheral area to the heating area) strikes against the ink holding means such as a structure in the form of a wall, groove or the like, the periphery of a lid having an opening formed therein, or a group of pillar structures, conical structures or similar concave/convex structures, whereupon a horizontal speed component of the traveling wave is changed into the direction toward a transfer target member. As a result, the ink is ejected in the direction toward the transfer target member primarily in the form of a mist not larger than one pico-liter.

(3) Collision between Traveling Waves

When the ink is cyclically heated and cooled by energizing and de-energizing the heating means, a wave of the ink produced with the Marangoni flow under heating and traveling outward strikes against a wave of the ink produced upon extinction of the Marangoni flow under cooling and traveling inward, whereupon horizontal speed components of the traveling waves are changed into the direction toward a transfer target member. As a result, the ink is ejected in the direction toward the transfer target member primarily in the form of a mist not larger than one pico-liter. Note that the two traveling waves may strike against each other in a position other than the center of the heating area.

(4) Resonation with Standing Wave

The natural frequency of a standing wave of the ink, which is primarily defined by the spacial dimensions of the ink holding means provided in the transfer section, such as a structure in the form of a wall, groove or the like, the periphery of a lid having an opening formed therein, or a group of pillar structures, conical structures or similar concave/convex structures, and by the surface tension of the ink, resonates with cyclic vibration formed by an outward traveling ink wave produced with the Marangoni flow under heating and an inward traveling ink wave produced upon extinction of the Marangoni flow under cooling, thereby increasing the magnitude of the standing wave. Eventually, when the magnitude of the standing wave increases beyond a certain range, the ink positioned at the loop of the vibration is ejected in the direction toward the transfer target member primarily in the form of a mist not larger than one picoliter.

The ink mist formed based on the above transfer principles has a size much smaller than that of an ink droplet ejected by the known thermal ink jet process or the like, and the ink meniscus restores more quickly, thus enabling the driving frequency to increase. In other words, an ink droplet having a smaller size can be formed in a shorter time as compared with the known thermal ink jet process. It is hence possible to realize a multi-value density gradation in a unit pixel, and to carry out recording (of, e.g., a full color image) without using any ink ribbon with such a level of fine image quality as that cannot be obtained with the conventional on-demand type ink-jet image forming process, and that is comparable or superior to an image produced by the silver salt process.

Also, since the ink is ejected in the form of a small-size mist (ink mist including, especially, large mist particles), the recording method of the present invention requires neither heating of a dye accepting layer formed in a transfer target member as needed in the conventional dye vaporization thermal transfer process, nor pressing of an ink sheet against a recording member under a high pressure. This is also advantageous in reducing the size and weight of a printer. Furthermore, non-contact between the dye layer in the vaporizing section and the recording member surely prevents fusion between them, and recording can be performed even when compatibility between the dye and a resin of the dye accepting layer is small. Accordingly, available ranges for design and selection of the dyes and the dye accepting layer are considerably widened. In addition, since the ink mist includes relatively large-size mist particles, recording can be made with a high transfer sensitivity, a high transfer speed, and almost the same reproducibility regardless of paper quality, etc. Since the substances having the relatively high boiling points are also forced to fly together with the large mist particles while being included therein, impurities contained in trace amounts in the ink and having the high boiling points, such as silica particles and metal powder, are avoided from being left in the transfer section and fusing there. As a result, performance degradation over time is suppressed. Since the large mist particles have an initial speed as high as 5 m/sec or more and are less slowed down upon collision against air molecules, the gap between the printer head and the transfer target member can be set to a relatively large value. Therefore, even porous printing paper having asperities on the order of, e.g., 50 μm or more can be used, and paper powder, dust, etc. can be avoided from adhering to the transfer section. Resulting larger tolerance of the accuracy, that is required in the process of manufacturing the printer head, contributes to reducing the manufacturing cost.

As other advantages, the recording method of the present invention makes it possible to reduce the cost, the printing time, and the amount of wastes incidental to the printing. That is, the recording method of the present invention employs no ink ribbons which are costly from the principle point of view, and enables printing to be made on inexpensive ordinary paper by using ink that exhibits high absorptivity to the ordinary paper. Because of employing no ink ribbons, the amount of wastes is naturally much reduced in comparison with the sublimation thermal transfer process. Further, since the length of a transfer head can be easily increased, the transfer time can be considerably shortened in comparison with the sublimation thermal transfer process and the on-demand type ink jet process by driving printer heads for inks of three primary colors or four colors including black.

In the present invention, there are mainly two means for increasing the ejection efficiency of an ink mist.

The first means is to specify the heating power, heating cycle, cooling time, surface tensions of the ink during a temperature-rising (heating) period and during a temperature-lowering (cooling) period, interface tensions between the ink and the transfer section of the printer head during the temperature-rising period and during the temperature-lowering period, size of the heating means, thickness of the ink layer, etc. so that when the ink surface is cyclically vibrated in the transfer section to cause ink flow directing from the heating area to the peripheral area, at least a part of a (bottom) surface of the transfer section is exposed upon the ink flow. The boundary between the ink surface and the exposed surface of the transfer section that is formed upon exposure of the transfer section surface, i.e., the gas—solid—liquid line, travels at a high speed. In addition, during cooling, the capillary attraction acting so as to cover the exposed surface, which has been formed during the preceding heating period, is added to the meniscus restoring force of the ink. Accordingly, the efficiency of ejecting the ink mist can be improved, and the driving frequency can also be increased.

The second means is to form a small concave/convex structure in the heating area of the transfer section so that interactions occur between the cyclic flowage of the ink surface and the concave/convex structure to improve the efficiency of ejecting the ink mist. A capillary attraction developed by the presence of the concave/convex structure increases the meniscus restoring force of the ink in the transfer section, thus enabling the driving frequency for mist ejection to be increased. Another advantage is that the ink surface is always kept even with the top of the concave/convex structure, and stability in the transfer operation is improved.

The first means, i.e., exposing the bottom surface of the transfer section, and the second means, i.e., providing the small concave/convex structure near the heating area in the transfer section, provide independent effects. Simultaneous application of both the means does not cancel their effects, but can rather generate additional ink flow due to collision between the gas—solid—liquid line and the small concave/convex structure, thus providing a synergistic effect to improve the efficiency of ejecting the mist.

There two modes in vibrating the gas—solid—liquid line:

(1) In the first mode, the line is vibrated such that at least a part of the surface (bottom surface) of the transfer section is exposed during the heating, and the exposed surface of the transfer section is completely covered by the ink during the cooling.

(2) In the second mode, the line is vibrated such that at least a part of the surface (bottom surface) of the transfer section is exposed during the heating, and the exposed surface of the transfer section is not completely covered by the ink while at least a part of the transfer section surface remains exposed during the cooling.

In the first mode (1), relatively large mist particles tend to occur at the center of the transfer section because ink traveling waves collide there against each other when the exposed bottom surface of the transfer section is covered by the ink. In the second mode (2), the vibrating gas—solid—liquid line tends to resonate with the specific frequency of an ink standing wave that is determined by the spatial dimensions of structure of the ink holding means and the surface tension of the ink, and relatively small mist particles tend to occur from the periphery of the heating means in the transfer section. Note that, even in the second vibrating mode, the exposed part of the transfer section surface, i.e., the gas—solid—liquid line, of course disappears during a predetermined pause time set in the transfer operation for each pixel.

The small concave/convex structure formed in the heating area of the transfer section is suitably in pillar, conical, or truncated-conical shape, but can be formed in any shape so long as it can satisfactorily develop the capillary attraction described above. In particular, a sectional surface of the pillar, conical, or truncated-conical structure is preferably circular, elliptic, or polygonal such as triangular or rectangular. A polygonal sectional surface including an angle larger than 180°, such as a crossed or star-shaped surface, is also preferable because it increases a specific surface area of the concave/convex structure. Further, a valve-like structure, in which the concave/convex structures are arranged with irregular intervals, is often effective to promote turbulence of the ink flowage based on the Marangoni flow, to increase shearing forces imposed on the ink, and to improve the efficiency of ejecting the ink mist.

The small concave/convex structures each preferably have a height not smaller than 1 μm but not larger than 50 μm, a representative width dimension not smaller than 1 μm but not larger than 10 μm, and a center-to-center distance not smaller than 2 μm but not larger than 40 μm. If the height of the small concave/convex structure is smaller than 1 μm, there would occur such a tendency that the capillary attraction decreases and the amount of ink held by it reduces, thus resulting in lower transfer efficiency. If the height exceeds 50 μm, there would occur such a tendency that thermal conduction to the ink surface is delayed, the surface tension gradient becomes harder to develop in the ink surface, and the magnitude of cyclic vibration of the ink surface is reduced, thus resulting in lower mist ejection efficiency.

If the representative width dimension of the small concave/convex structure is smaller than 1 μm, the mechanical strength of the concave/convex structure would be so reduced that the concave/convex structure is easily damaged during the transfer operation or during storage, and the ink is sometimes not ejected in a stable manner. If the representative width dimension exceeds 10 μm, the surface area of the ink locating above the heating means would be so reduced relatively that the mist ejection efficiency lowers sometimes.

If the center-to-center distance between the small concave/convex structures is smaller than 2 μm, the amount of ink held by them would be so reduced that the transfer efficiency lowers sometimes. If the center-to-center distance exceeds 40 μm, the capillary attraction would be so reduced that the ink surface becomes hard to vibrate and the mist ejection efficiency lowers sometimes. Though described later in detail, the especially preferable size of the small concave/convex structure is below; the height not smaller than 2 μm but not larger than 10 μm, the representative width dimension not smaller than 2 μm but not larger than 5 μm, and the center-to-center distance not smaller than 3 μm but not larger than 10 μm.

Arranging the small concave/convex structures in a cyclic pattern makes a standing wave generate easily due to vibration of the ink surface, and improves the mist ejection efficiency based on the generated standing wave. On the other hand, arranging the small concave/convex structures in a not-cyclic (irregular) pattern makes turbulence generate easily due to contact of the Marangoni flow in the ink surface with the concave/convex structures, and improves the mist ejection efficiency based on the generated turbulence. Accordingly, the small concave/convex structures may be arranged in either cyclic or not-cyclic pattern. In the case of arranging the small concave/convex structures in a cyclic pattern, the pattern is preferably symmetric through two, three or four transformations, for example, from the point of easily generating the standing wave due to vibration of the ink surface.

The small concave/convex structures can be formed by any suitable method, e.g., embossing, photoetching with a photosensitive resin, wet etching with a photosensitive resin used as a mask, or etching technique employed in the semiconductor lithographic process. In particular, to precisely form the small concave/convex structures having the most preferable size, i.e., the height not smaller than 2 μm but not larger than 10 μm, the representative width dimension not smaller than 2 μm but not larger than 5 μm, and the center-to-center distance not smaller than 3 μm but not larger than 10 μm, application of the etching technique employed in the semiconductor lithographic process is optimum. One example of such etching technique comprises the steps of forming a $SiO_2$ layer having a thickness of about 10 μm by, e.g., the CVD (Chemical Vapor Deposition) process on a certain substrate provided with heating means, then forming a photoresist or a metal mask in a predetermined pattern corresponding to the small concave/convex structures, and then forming recesses of, e.g., 8 μm with such a technique as RIE (Reactive Ion Etching) or powder beam etching. Desired small concave/convex structures are thus formed in which the masked areas serve as convex portions. The method of forming the small concave/convex structures will be described in more detail in Examples below.

Alternatively, the small concave/convex structures may be formed by coating a photoresist in a predetermined pattern corresponding to the small concave/convex structures (similarly to the reversed relation between a negative film and a positive print), and depositing Ni or the like by the electrolytic plating process. In this case, a conductive layer requires to be formed beforehand as an underlying layer. As compared with the method of forming the concave/convex structures using a $SiO_2$ layer, the method using the electrolytic plating can form the concave/convex structures in a much shorter time and is superior in mass-production because the time-consuming processes such as forming of a $SiO_2$ layer, forming of a metal mask, and etching of the $SiO_2$ layer are not needed.

In addition to the concave/convex structures described above, a bead cluster, a fibrous member, etc. are also applicable to the present invention so long as it has an equivalent function.

In the present invention, it is desired that the thickness of ink is always held at a fixed value because the magnitude of the Marangoni flow is affected to a large extent by the ink thickness. To this end, a wall is preferably provided means on at least one side of the heating means to surround it. For optimizing the ink thickness, the wall preferably has a height not smaller than 1 μm but not larger than 50 μm. If the wall height is smaller than 1 μm, the amount of ink held by them would be so reduced that the transfer efficiency lowers sometimes. If the wall height exceeds 50 μm, there would occur such a tendency that thermal conduction to the ink surface is delayed, the surface tension gradient becomes harder to develop in the ink surface, and the magnitude of cyclic vibration of the ink surface is reduced, thus resulting in lower mist ejection efficiency. Further, by forming walls on both sides of the heating means to provide such a structure that the heating means is positioned within a groove defined by the walls, the ink meniscus is formed with stability, and hence the mist is ejected in a stable manner. The ink surface can be satisfactorily held by providing the wall(s) within the distance of 50 μm from the center of the heating means. Additionally, an auxiliary wall having a predetermined shape may be provided in a predetermined position for the purpose of stabilizing the ink meniscus.

The wall for defining the ink thickness can be fabricated by means of the same process as employed for forming the small concave/convex structures. If the wall does not require the accuracy and dimensions that are required for the small concave/convex structures, it may be fabricated by using the photoetching process with a photosensitive resin, or by bonding a metal film formed into a comb-like shape.

For defining an appropriate ink thickness, a member (lid member) having an opening (hole) or a slit (gap) formed therein may be provided above the heating means. By placing the member so as to cover the transfer section, ink is formed with stability along the opening or the slit. However, how the ink thickness is defined by the lid member depends on whether a side surface of the opening or the slit is repellent or affinitive to the ink. For example, when the side surface of the opening or the slit is repellent to the ink, the ink is allowed to reach a line where the edge of the opening or the slit adjoins with a bottom surface of the lid member, and the ink thickness is determined by a gap between the surface of the transfer section and the bottom surface of the lid member. On the other hand, when the side surface of the opening or the slit is affinitive to the ink, the ink is allowed to reach a line where the edge of the opening or the slit adjoins with a surface of the lid member facing the transfer target member, and the ink thickness is determined by a total value of the gap between the surface of the transfer section and the bottom surface of the lid member plus a thickness of the lid member.

The simplest method of providing the lid member is to bond a plate having an opening or a slit to the above-mentioned wall. In particular, when a groove is formed by the photoetching process using a photosensitive resin, a wall member can be easily provided because a metal film (e.g., a Ni sheet) can be simply fixed to the groove with heat pressing. Other various methods such as anisotropic etching, bonding of a plate, in which a groove and an opening or a slit are formed beforehand, to the transfer section, etc. are also applicable.

The lid member having the opening or the slit is basically different from an outlet port, i.e., the so-called nozzle or orifice, used in the conventional ink jet process in that the size of the ejected ink mist is much smaller than the area of the opening or the width of the slit. In other words, if the area of the opening is comparable to the area of the heating means, or if the width of the slit is comparable to the size of the heating means, a sufficient temperature gradient is not developed in the ink surface defined by the opening or the slit, and the Marangoni flow primarily serving as driving forces to produce the ink mist in the present invention is not produced. Consequently, the lid member having the opening or the slit plays a completely different role from the nozzle or orifice used in the conventional on-demand type ink jet process.

Typical mist particles generated in accordance with the recording method of the present invention preferably have a maximum cross-sectional area, in terms of perfect sphere, not more than 1/100 of the opening area in usual conditions and not more than 1/10 thereof at maximum. On the contrary, if an ejected ink area is defined as per made in the conventional on-demand type ink jet process by using the outlet port, i.e., the nozzle or orifice, the ejected ink area would be so reduced that the convection attributable to the surface tension gradient and serving as driving forces in the recording method of the present invention, i.e., the Marangoni flow, may not be produced sufficiently.

The opening area of the above-mentioned member (lid member) is preferably in the range of not smaller than 500 $\mu m^2$ but not larger than 50000 $\mu m^2$. If the opening area is smaller than 500 $\mu m^2$, the surface tension gradient would be too small to produce the Marangoni flow sufficiently. If the opening area exceeds 50000 $\mu m^2$, the ink holding ability would tend to reduce. Although the opening of the lid member may have any shape, a circular opening is suitable particularly for causing the ink to form meniscus with stability, while a rectangular opening is suitable particularly for providing a sufficiently high degree of resolution.

The slit in the above-mentioned member (lid member) has an average width preferably in the range of not smaller than 30 $\mu m$ but not larger than 500 $\mu m$. If the average width is smaller than 30 $\mu m$, the surface tension gradient would be too small to produce the Marangoni flow. If the average width exceeds 500 $\mu m$, the ink holding ability would tend to reduce. Although the slit may have a linear shape, adaptability for positive generation of the ink meniscus is improved by forming the slit in match with the heating means in the transfer section.

When the side surface of the opening or the slit in the above-mentioned member (lid member) is repellent to the ink, the height from the transfer section surface to the bottom surface of the lid member, i.e., the surface of the lid member opposing to the transfer target member, is preferably in the range of not smaller than 1 $\mu m$ but not larger than 50 $\mu m$. On the other hand, when the side surface of the opening or the slit is affinitive to the ink, the height from the transfer section surface to the front surface of the lid member, i.e., the surface of the lid member facing the transfer target member, is also preferably in the range of not smaller than 1 $\mu m$ but not larger than 50 $\mu m$. In any case, it is important to accurately and stably control the ink surface by the lid member or the like so that the ink is smoothly supplied.

If the gap defined between the above-mentioned member (lid member) and the transfer section surface for accommodating the ink is smaller than 1 $\mu m$, smooth ink supply would be impeded. If the gap defined therebetween accommodating the ink exceeds 50 $\mu m$, the ink layer would be too thick to produce the Marangoni flow sufficiently. The lid member can be made of any materials, such as metals, films of polyimides or other high polymers, and ceramics, which have high heat-resistance, have high stability to the ink, can control a wetting property for the ink, and have high mechanical strength.

In the present invention, for promoting generation of ink flow caused by the capillary attraction between the ink and the transfer section surface from the area away from the heating means to the center of the heating means during the temperature-lowing period of the heating means (i.e., during the cooling), a contact angle of the ink with respect to the bottom surface of the transfer section and a side surface of the wall, the structure like a groove, the pillar structure, the conical structure or the similar concave/convex structure is preferably not larger than 60° in the entire range of ink temperatures taken during the transfer operation.

In order to reduce the contact angle of the ink with respect to the bottom surface of the transfer section and the side surface of the wall, the structure like a groove, the pillar structure, the conical structure or the similar concave/convex structure, it is highly effective to form the bottom surface of the transfer section and the side surface of the wall, the structure like a groove, the pillar structure, the conical structure or the similar concave/convex structure to have porous nature, thereby increasing the ink holding ability. In particular, if the contact angle of the ink with respect to the bottom surface of the transfer section and a side surface of the wall, the structure like a groove, the pillar structure, the conical structure or the similar concave/convex structure in the entire range of ink temperatures taken during the transfer operation is not larger than 30°, the meniscus restoring force of the ink is increased and the ink supply speed is also increased, this being suitable for speed-up of the operation.

In contrast with the side surface mentioned above, for the purpose of accurately defining the thickness of the ink layer and ejecting the ink mist with stability, upper and top portions of the wall, the structure like a groove, the pillar structure, the conical structure or the concave/convex structure are preferably treated to be repellant to the ink to render the contact angle of the ink with those portions not smaller than 75° so that the ink thickness is precisely kept coincident with the height of the wall, the structure like a groove, the pillar structure, the conical structure or the concave/convex structure. By treating a metal mask on the top of each convex member with plasm as the method of providing the ink repellent nature, the contact angle of the ink with those portions can easily become not smaller than 75°. The contact angle of the ink can be further increased to 90° or more, for example, by spin-coating an amorphous hydrocarbon resin, such as Cytop (trade name, made by Asahi Glass Co., Ltd.) on the target portion, and then patterning a resultant coating with a plasma etching apparatus, if desired.

In the present invention, for the purpose of improving a temperature response in the area of the transfer section area away from the heating means (i.e., in the above-mentioned peripheral area) and increasing the driving frequency for ejection of the ink mist, a portion of the printer head near the heating means, i.e., the transfer section, is preferably made of materials containing not less than 90% by weight of a substance that has thermal conductivity not less than 1 W/m·K.

In the present invention, the heating means provided in the transfer section is preferably cyclically heating means capable of driving at frequency not higher than 1 KHz, and may comprise any heating means with such a capability. Practically usable examples of the heating means include resistance heating means directly supplying a current to an electric resistance for heating, and electromagnetic-wave heating means externally irradiating an electromagnetic wave to an absorber, which is disposed in part of the transfer section or part of the ink, thereby heating the ink.

As one type of electromagnetic-wave heating means, laser heating means may also be practiced in such a manner that a part of the transfer section or a part of the ink is made of an opto-thermic transducing material for optical energy of a laser beam into thermal energy, and a focused laser beam is irradiated to the opto-thermic transducing material. In this case, a laser beam source may comprise any type of laser beam source such as a gas laser, excimer laser, solid laser, or a semiconductor laser. Among them, a semiconductor laser is especially preferable because it has a small size and consumes a small amount of power. When a laser beam source is used as the heating means, it is desired that the substrate is formed of a transparent substrate made of Pyrex, quartz glass or the like, and a laser beam is irradiated from the side of the substrate opposite to the side from which the mist is ejected.

The opto-thermic transducing material added to the ink in the above case is preferably a naphthalocyanine dye that neither absorbs visible light nor contaminates printing paper, or an infrared absorbing coloring matter similar to the cyanine dye. In the latter case, it is important to lower the polarity of infrared absorbing coloring matter so that it may be sufficiently dissolved in the ink. The opto-thermic transducing material added to the transfer section is preferably a coating of carbon black, or a dielectric two-layer film (e.g., a two-layer film of silicon nitride and tantalum) in match with the wavelength of the laser beam.

A heating area covered by the heating means is preferably defined within a rectangle with each side not longer than 42 $\mu$m or a circle with a diameter not larger than 60 $\mu$m. If the size of the heating area is too large, there would occur such a tendency that an effective temperature gradient is not developed in the ink surface and the ink is not sufficiently ejected. The especially preferable size of the heating area is that each side is not longer than 25 $\mu$m when the area is rectangular, and the diameter is not larger than 30 $\mu$m when the area is circular.

Figure 44:
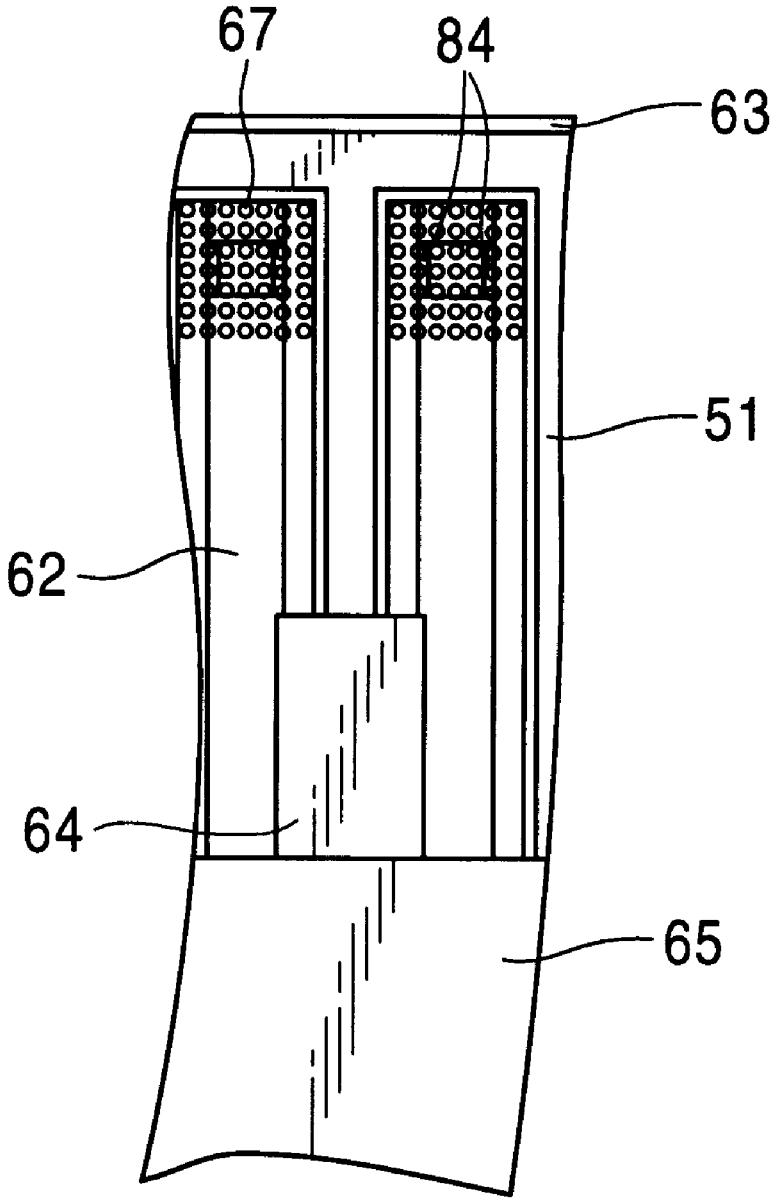
FIG. 44 is a schematic plan view showing the structure of a transfer section and thereabout of a head chip according to Example 24 of the present invention.
Figure 45:
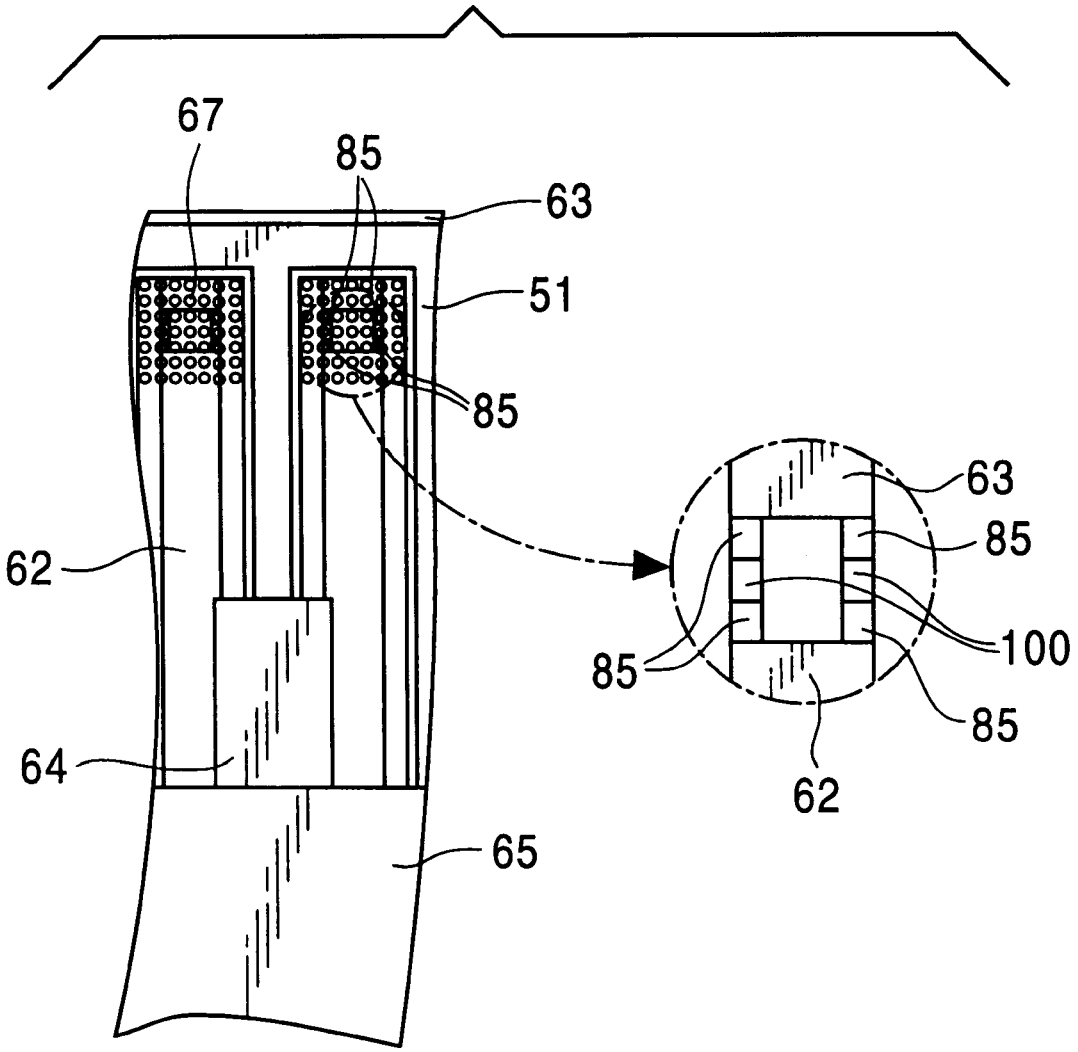
FIG. 45 is a schematic plan view showing the structure of a transfer section and thereabout of one head chip of the printer head according to the present invention.
Figure 46:
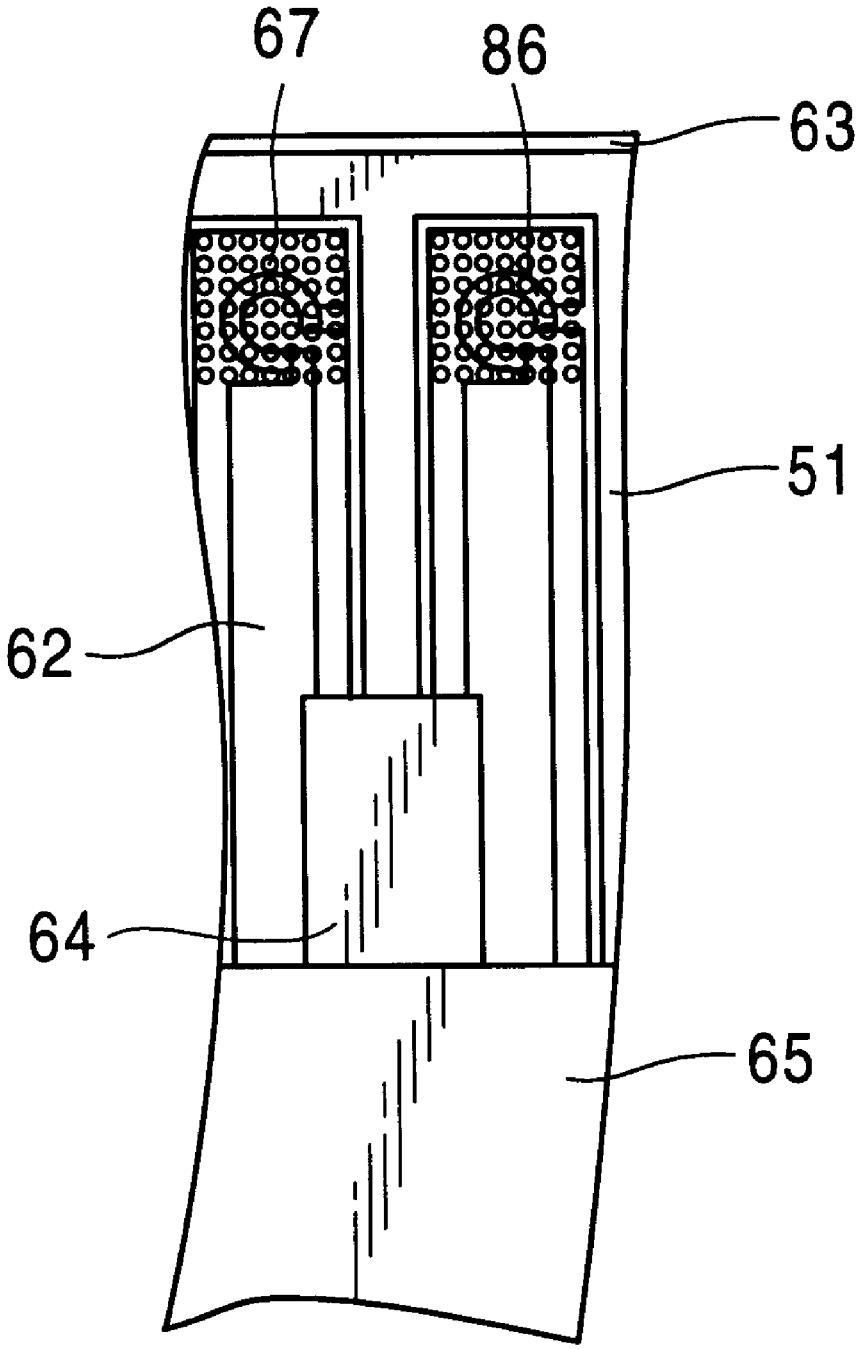
FIG. 46 is a schematic plan view showing the structure of a transfer section and thereabout of another head chip of the printer head according to the present invention.

Though described later in detail, by providing the heating means in the form divided into, e.g., two per pixel as shown in FIGS. 44 and 47, ink traveling waves generated by the respective heating means interfere with each other about the middle between the two heating means, thereby ejecting a mist. Further, providing the heating means in the form divided into four as shown in FIG. 45, or providing the heating means in the form a ring as shown in FIGS. 46 increases a possibility that ink traveling waves concentrate on at the center of the heating means to provide higher transfer sensitivity. Note that, in the case of FIG. 46, an area above the center of the ring-shaped heating means corresponds to the above-mentioned peripheral area.

In the printer head of the present invention, the number of ink accommodating portions, the number of dots, and the number of corresponding heating means and transfer sections may be changed variably, and the array pattern, size, etc. of them are also not restricted to those described above.

In the present invention, when the ink is heated by the heating means, a solvent, a coloring matter and other additives are necessarily vaporized at a speed depending on the surface temperature of the ink. The generated vapors (vaporized matters) are often condensed in the gas phase so as to grow into a small-particle mist (small mist particles). Because of a low initial flying speed, these vaporized matters and small mist particles may lose speed components while flying through the gap, and may continue floating in the gap without reaching a sheet of printing paper positioned in an opposed relation. Such ink vapors and small mist particles are disadvantageous in not only causing background stain of the printing paper and a deterioration in resolution, but also producing toxicity harmful to the human bodies if they leak outside the printer. To suppress leakage of the ink vapors and the small mist particles, it is desired in the present invention to provide, in the transfer section, a cover which is repellent to the ink and has a hole sized to allow passage of just over 90% of the ejected mist so that only the mist (particularly large mist particles), which is to be inherently ejected as intended, can pass through the cover, but the ink vapors and the small mist particles ejected concomitantly are blocked by the cover. If the cover is not repellant to the ink, the ink may fill into an entire space defined by the cover due to the capillary attraction. Since the cover does not aim at holding the ink, its role perfectly differs from that of a nozzle or orifice used in the conventional on-demand type ink jet process.

In the present invention, if the ink is boiled under heating by the heating means disposed in the transfer section, the convection attributable to the surface tension gradient and serving as driving forces in the recording method of the present invention, i.e., the Marangoni flow, would be often unstable in generation thereof. It is therefore preferable to set the boiling points of the coloring matter, solvent and other additives in the ink to such sufficiently high values that they will not boil and hence the ink is prevented from boiling.

In particular, if the ink components, i.e., the coloring matter, solvent and other additives, have the boiling points different from each other, the stable ink ejection may be impeded because only the component having the lowest boiling point is selectively vaporized and the ink components are unbalanced to change the ink properties. Also, if the boiling point of any of the ink components is extremely low, only that component vaporizes while the printer is in an inoperative mode, for the reason that the ink surface is exposed to air in the recording method of the present invention. This may result in that the ink components are unbalanced to change the ink properties and the stable ink ejection is impeded. To prevent such an adverse operation, it is desired that the boiling points of all the ink components, including the coloring matter, solvent and other additives, are selected to be not lower than 250° C., or that the differences between the boiling points of all the ink components, including the coloring matter, solvent and other additives, are selected to fall within 10° C.

In the present invention, the temperature of the ink components may momentarily reach 200° C. or over. Therefore, if the pyrolyzing temperatures of all the ink components, including the coloring matter, solvent and other additives, are not higher than 200° C., a part of the ink would pyrolyze and a resulting pyrolysate would accumulate in a recording section to change its surface area or change its wetting property for the ink, thereby impeding stable mist ejection. To prevent such an phenomenon, it is desired that the pyrolysis starting temperatures of all the ink components, including the coloring matter, solvent and other additives, are selected to be not lower than 200° C. Practically, it is preferable to employ a material producing a pyrolysate of not larger than 100 ppm when heated at a temperature of 200° C. in air for one hour.

In the present invention, for effectively producing the convection attributable to the surface tension gradient and serving as driving forces in the recording method of the present invention, i.e., the Marangoni flow, it is desired that the ink surface tension has a negative temperature coefficient (dependency) and an absolute value of the coefficient is as large as possible. Preferably, an appropriate surfactant is added so that the absolute value of the negative temperature coefficient of the ink surface tension is held in the desired range.

The ink employed in the present invention is made up of a dye, a solvent, and additives which are added as needed. It is desired to select materials and adjust a mixing ratio of the composition materials so that the transfer sensitivity, thermal stability, image quality, and preservation stability are optimized.

In addition to satisfying the above-described conditions, i.e., having the boiling point not lower than 250° C. and producing a pyrolysate of not larger than 100 ppm when heated at 200° C. in air for one hour, the dye used in the present invention preferably has sufficient solubility with respect to the solvent described below, and exhibits a necessary and sufficient degree of preservation stability on printing paper. An oil-soluble dye having low polarity, called a disperse dye or an oil-soluble dye, is particularly preferable.

Specifically, examples of the oil-soluble dye include Kayaset dye series (by Nippon Kayaku Co., Ltd.), Diamira dye series (by Mitsubishi Chemical Industries Co., Ltd.), Mitsui PS dye series (by Mitsui Toatsu Co., Ltd.), Sumiplast dye series (by Sumitomo Chemical Co., Ltd.), and Aizen dye series (by Hodogaya Chemical Co., Ltd.).

The disperse dye is preferably not added with a dispersant, and is given by, for example, ESC dye series (by Sumitomo Chemical Co., Ltd.). More specifically, examples of the disperse dye include azo-base dyes such as CI (color index) disperse yellow 3, disperse yellow 7, disperse yellow 8, solvent yellow 16, solvent yellow 56, disperse red 1, disperse red 17, disperse red 19, solvent red 19, and solvent red 23; quinophthaline-base dyes such as disperse yellow 54; and anthraquinone-base dyes such as disperse red 4, disperse red 11, disperse red 60, disperse blue 14, disperse blue 26, and solvent blue 35. In addition, dicyanostyryl-, tricyanostyryl-, and indoaniline-base dyes are also usable. To reduce an amount of vaporization residues and to prevent the deteriorated matter (pyrolysates) from adhering to the recording section, the dyes are preferably refined by any of the sublimation refining process, the recrystallizing process, the zone melting process, the column refining process, etc. before the use.

The ink solvent used in the present invention preferably satisfies such conditions as having the melting point lower than 50° C. and the boiling point not lower than 250° C., producing a pyrolysate of not larger than 100 ppm when heated at 200° C. in air for one hour, having high solubility to the above-mentioned dyes, having viscosity not higher than 100 cp at 100° C., exhibiting low toxicity to the human bodies, and being colorless. Any kind of compound is usable so long as it satisfies the above requirements.

More specifically, particularly preferable examples of the ink solvent include phthalate esters such as dimethyl phthalate, diethyl phthalate, dibutyl phthalate, diisobutyl phthalate, dihexyl phthalate, diheptyl phthalate, dioctyl phthalate, and diisodecyl phthalate; esters of fatty acids and dibasic acids such as dibutyl sebacate, dioctyl sebacate, dioctyl adipate, iodecyl adipate, dioctyl azelate, and dioctyl tetrohydrophthalate; phosphate esters such as tricresyl phosphate and trioctyl phosphate; organic compounds such as tributyl acetylcitrate and butylphthalyl butylglycolate which are generally called plastic-purpose plasticizer; and organic compounds in combinations of aromatic compounds, such as ethyl naphthalene, propyl naphthalene, hexyl naphthalene, and octyl benzene, and alkyl compounds.

To properly adjust values of the ink properties, adequate additives such as a surfactant and a viscosity adjusting agent can be added as needed. These additives preferably satisfy such conditions as having the boiling point not lower than 250° C., producing a pyrolysate of not larger than 100 ppm when heated at 200° C. in air for one hour, and being colorless. Any kind of compound is usable so long as it satisfies the above requirements. More specifically, the surfactant is preferably one containing a perfluoro radical or a silyl radical. Preferable examples of the viscosity adjusting agent are polyethylene glycols such as tetraethylene glycol and triethylene glycol.

It is desired that the ink is prepared by dissolving not less than 5% by weight, preferably not less than 10% by weight, more preferably not less than 20% by weight, of any of the above-mentioned dyes at 50° C. or higher in any of the above-mentioned solvents. On this occasion, two or more dyes may be used in a mixed manner to improve solubility. Likewise, two or more solvents may also be used in a mixed manner. Additives can be added to the ink as needed.

In the present invention, a distance between the ink surface in the transfer section and a sheet of printing paper is preferably set to fall in the range of not smaller than 50 μm but not larger than 2000 μm. If the distance is smaller than 50 μm, it would be difficult to obtain the mechanical accuracy necessary for ensuring the gap, and paper powder of the printing paper would tend to adhere to the transfer section. If the distance exceeds 2000 μm, there would occur such a tendency that the mist hits against the sheet of printing paper over a larger area and resolution becomes insufficient. In this connection, by applying electrostatic force to the ejected mist, it is possible to achieve both the large gap not smaller than 2000 μm and satisfactory resolution. Of course, applying electrostatic force is effective even in the case of the gap having a length not smaller than 2000 μm. Further, the above-mentioned ink repellent cover having an opening, through which the mist is allowed to pass, is also effective in achieving both an improvement of resolution and the larger gap.

The printer head (transfer head) is fabricated by forming heaters, ink passages, concave/convex structures, etc. on a substrate of silicon or quartz, for example, in accordance with the semiconductor lithographic process, cutting the processed substrate (into a heater chip) and bonding it to a head base, connecting an driver IC to the heater chip by means of wire bonding or the like, and then attaching an ink tank. By placing the head to obliquely face the sheet of printing paper, a predetermined gap is ensured between them. A full color printing can be performed by providing three heads provided with ink tanks containing inks of primary three colors for the subtractive color process, and driving the heads in a serial manner, or by providing three line-type heads and driving the heads in a one-pass manner. Details of the manufacturing process and transfer operation of the recording section will be described later. In the printer head described in the following Examples, the recording section includes 256 transfer sections and performs the image transfer operation in a serial driving manner. However, a transfer system using a longer heater head and transferring an image on the line-by-line basis (i.e., line type system) can be also easily practiced based on the following Examples without major difficulties in the principle point of view.

Density modulation in a unit pixel can be realized by applying, in the form of a burst signal, pulses in number corresponding to the number of gradation levels per unit pixel, the pulses having an appropriate duty and produced at basic driving frequency in the range of several tens to several hundreds Hz. In the case of the number of gradation levels being 256, the driving frequency per unit pixel is several hundreds Hz.

The point to be noted here is that, unlike the conventional ink jet process, one mist is not always ejected by one driving pulse in the recording method of the present invention. A typical example of the transfer operation is below. With initial several pulses, heat is not sufficiently accumulated in the ink surface, and the magnitude of the Marangoni flow is too small to eject a mist. After about five pulses have been applied, several to several tens small-size mists are ejected at the same by one pulse. Accordingly, the driving method employed in the sublimation thermal transfer process is more suitable for the recording method of the present invention than that employed in the ink jet process.

Printing paper suitable for use with the recording method of the present invention is, e.g., ordinary paper such as PPC paper, or fine paper such as art paper. To provide a high-quality image especially improved in gradation and density, specific paper can be used that is fabricated by coating, as a resin for promoting color development of the disperse dye or oil-soluble dye used, polyester, polycarbonate, acetate, CAB (cellulose acetate butylate), polyvinyl chloride, etc. on base paper. To improve an ink absorbing speed of the paper, adding a porous pigment such as silica or alumina is effective.

To improve preservation stability of a transferred image, it is effective to laminate a resin film on the printing paper onto which the image has been transferred. In particular, to make the ejected mist stuck and fixed onto the printing paper in a moment, it is preferable for the printing paper to have a porous surface with an average pore size not smaller than 0.05 $\mu$m but not larger than 20 $\mu$m.

To make the ink perfectly fixed onto the printing paper, it is also possible to press a heat roll against the printing paper just after the transfer operation so that the ink is forced to disperse into the printing paper to promote color development and fixing of the ink.

Further, in the present invention, a surfactant having the boiling point 20° C. or more lower than that of an ink solvent at the normal pressure may be added to the ink so that the surfactant residing in the heating area is selectively evaporated during heating by the heating means to develop a surface tension gradient in the ink surface, thus causing an ink mist to eject by utilizing, as driving force, flowage of the ink produced by the surface tension gradient. It is desired that such a surfactant has the boiling point 20° C. or more, preferably 50° C. or more, lower than that of the ink solvent at the normal pressure, is colorless, exhibits low toxicity, and is able to change the ink surface tension 3 dyn/cm or more, preferably 10 dyn/cm or more, when added to the ink at a concentration of not more than 1% by weight.

Particularly preferable examples of the surfactant include fluorine-base surfactants in which a part of hydrogens contained in alcohols, fatty acids, fatty acid esters, aromatic esters, etc. is replaced by fluorine, and silicone-base surfactants which contain silyl radicals in molecules.

As described, the Marangoni flow is produced in accordance with the present invention based on mechanisms below (see FIG. 1):

a temperature gradient developed in the recording material (ink) between the heating area and the peripheral area upon the operation of the heating means, a surface tension gradient caused by the temperature gradient based on dependency of the surface tension of the recording material upon temperature, and flowage (flow) of the recording material from a higher temperature area to a lower temperature area based on the surface tension gradient in the heating area.

In addition to the above mechanisms, as described above, the Marangoni flow is possibly produced in accordance with the present invention based on other three mechanisms below.

(1) Interface Tension Gradient with Temperature-Dependency of Interface Tension Between Recording Material and Bottom Surface of Transfer Section The interface tension between the recording material and the bottom surface of the transfer section (including wall surfaces of the concave/convex structures) also depends upon temperature. Because of difficulties in actually measuring the interface tension, however, how a interface tension gradient contributes to producing the Marangoni flow is not clear at the present. There is a possibility that such contribution is not negligible.

(2) Marangoni Flow Due to Density Distribution of Recording Material

Because the coloring matter, solvent and other additives making up the recording material have the boiling points different from each other, the component having the lower boiling point is selectively vaporized when heated by the heating means. Usually, the solvent has the boiling point lower than that of the coloring matter, and therefore only the solvent is evaporated while the coloring matter is condensed. This develops a density gradient of the recording material in the heating area. Also, since the surface tension (or the interface tension) changes depending upon the composition of the recording material, there occurs a surface tension gradient based on the density gradient of the recording material. As a result, the Marangoni flow is produced likewise.

(3) Marangoni Flow Due to Selective Evaporation of Surfactant

When a surfactant having the boiling point lower than those of the solvent and the coloring matter is added to the recording material, only the surfactant contained in the recording material in the heating area is selectively lost by evaporation to develop a surface tension gradient. Because the surfactant greatly affect the surface tension, this mechanism possibly produces the Marangoni flow in a large magnitude. In particular, with a usual surfactant providing an action to lower the surface tension, if the surfactant is lost in the heating area, the surface tension becomes larger in the heating area than in the peripheral area, possibly causing flowage of the recording material from the peripheral area to the heating area contrary to the mechanism for producing the Marangoni flow shown in FIG. 1.

The transfer principle in the case where at least a part of the bottom surface of the transfer section is exposed will now be described with reference to FIG. 2.

Figure 2A:
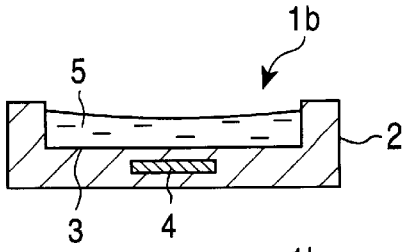
FIGS. 2A to 2G are schematic views for explaining other principles of transfer according to the recording method of the present invention.
Figure 2B:
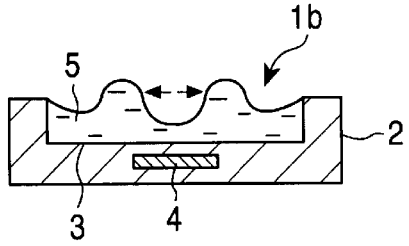

As shown in FIG. 2A, when a heater 4 provided in a transfer section 1*b* is energized to heat ink 5 that is placed in the transfer section 1*b* and has a thickness defined by ink holding means (such a wall or a concave/convex structure as described above) 2, for example, ink positioned just above the heater 4 is attracted to ink positioned in a peripheral area and having a relatively higher tension. Then, the ink surface deforms, as shown in FIG. 2B, to thereby generate outward ink traveling waves as indicated by arrows in the figure.

Figure 2C:
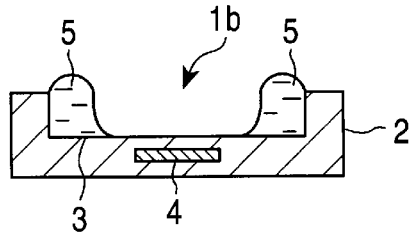
Figure 2D:
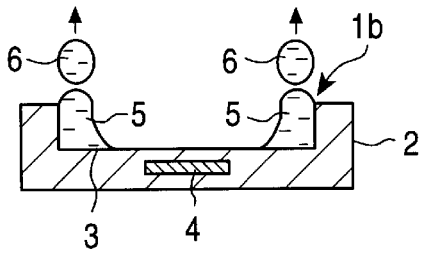
Figure 2E:
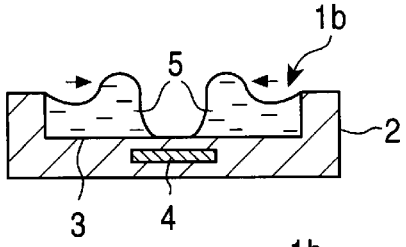

Subsequently, as shown in FIG. 2C, the ink in the transfer section 1*b* above the heater 4 (i.e., the ink in the heating area) is moved to the peripheral area, and therefore a bottom surface 3 of the transfer section 1*b* just above the heater 4 is completely exposed. Also, as shown, when the outward ink traveling waves strike against the ink holding means (the wall or the concave/convex structure) 2, their speed components are changed into the upward direction, causing the ink surface to swell upward along the ink holding means 2. Thus a part of the ink 5 is ejected upward in the form of a mist or mist particles 6, as shown in FIG. 2D.

After that, the heating by the heater 4 is stopped and the ink surface is cooled. When the difference in surface tension between the heating area and the peripheral area reduces, there occur ink traveling waves in the inward direction, as indicated by arrows in FIG. 2E, due to the meniscus restoring force or the capillary attraction developed by the exposed surface of the transfer section. At this time, the bottom surface 3 of the transfer section 1*b* may be partly exposed (not completely exposed), or may be entirely covered by the ink.

Figure 2F:
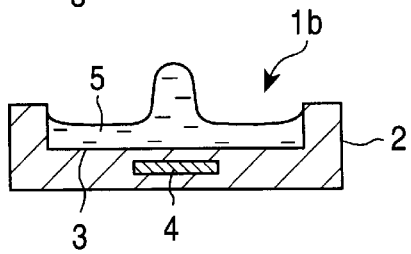
Figure 2G:
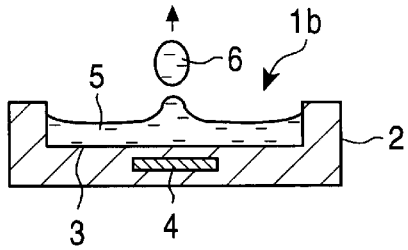

The inward ink traveling waves strike against each other, e.g., in the heating area as shown in FIG. 2F, whereupon a part of the ink 5 is ejected upward in the form of the mist or mist particles 6, as shown in FIG. 1G. With the above operation repeated cyclically, the ink mist is continuously ejected. By thus rendering the ink 5 to flow to such an extent that the bottom surface 3 of the transfer section 1*b* is exposed, it is possible to not only improve the efficiency of ejecting the ink mist 6, but also improve the driving frequency as described above.

Next, the transfer principle in the above case (3) will be described with reference to FIG. 3.

Figure 3A:
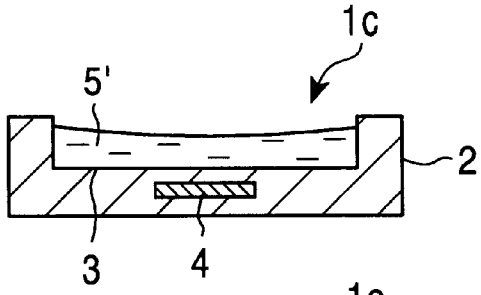
FIGS. 3A to 3F are schematic views for explaining still other principles of transfer according to the recording method of the present invention.

As shown in FIG. 3A, when ink 5' containing a surfactant is placed in an ink accommodating portion defined by ink holding means (such a wall or a concave/convex structure as described above) 2, for example, in a transfer section 1*c*, the surfactant spontaneously concentrate on the gas—liquid interface to form a film (not shown) of the surfactant at the interface.

Figure 3B:
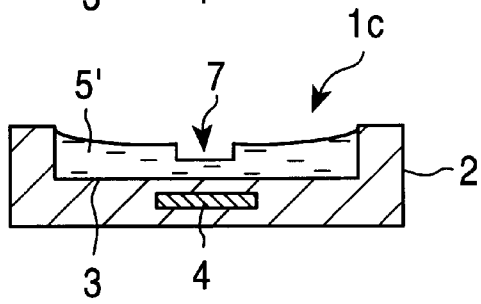

When a heater 4 provided at a predetermined position in the transfer section 1*c* including the ink 5' therein is energized to heat the ink 5' in the above condition, heat generated by the heater 4 is conducted to the ink surface, whereupon the surfactant having the relatively lower boiling point is evaporated. As shown in FIG. 3B, therefore, a hole (surfactant lost portion) 7 is formed in only an area just above the heater where the surfactant has been lost by evaporation).

With an resulting increase in the surface tension of the ink in the area just above the heater, the ink in the peripheral area is attracted to the ink positioned just above the heater and having the relatively higher surface tension. The ink surface is thereby changed to generate inward ink traveling waves.

Figure 3C:
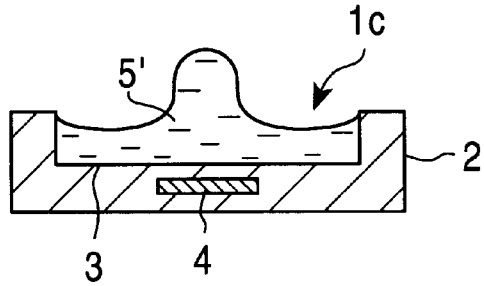
Figure 3D:
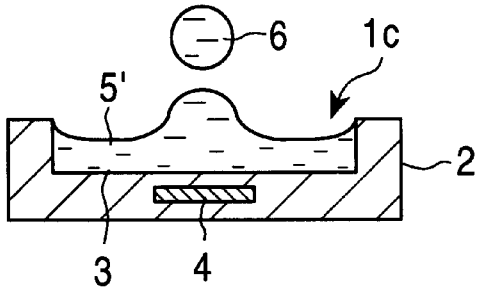

Subsequently, as shown in FIG. 3C, the ink surface swells upward in the heating area, for example. The inward ink traveling waves then strike against each other in the heating area as shown in FIG. 3D, whereupon a part of the ink 5' is ejected upward in the form of a mist or mist particle 6.

Figure 3E:
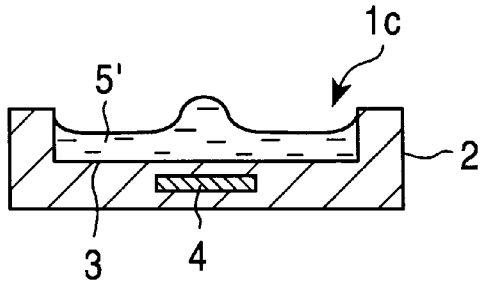
Figure 3F:
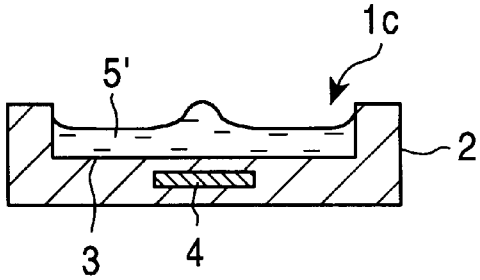

After that, when the transfer section 1*c* is cooled, the surfactant film restores to entirely cover the ink 5' again, as shown in FIGS. 3E and 3F. With the above operation repeated cyclically, the ink mist is ejected continuously.

The behavior of ink flying in accordance with the recording method of the present invention will now be described with reference to FIG. 4.

Figure 4:
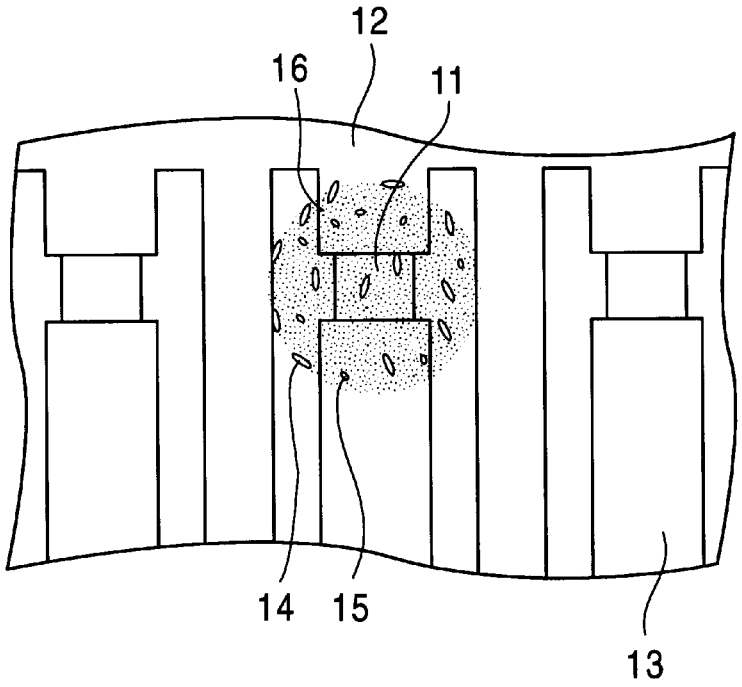
FIG. 4 is a schematic view of a principal part, showing the behavior of ink flying in accordance with one recording method of the present invention.

FIG. 4 shows the behavior of ink flying in accordance with the recording method of the present invention from a transfer section including a heater 11 connected to an individual electrode 13 and a common electrode 12. More specifically, as shown in FIG. 4, when a signal pulse having a duty of about 40 to 80% is applied to the heater in accordance with the present invention, the ink is forced to fly in the form of large mist particles 41 having diameters not smaller than 2 $\mu$m together with vaporized matters 6 and small mist particles 15. The flying ink sticks onto a transfer target member (not shown) positioned opposite to the transfer section.

Figure 5:
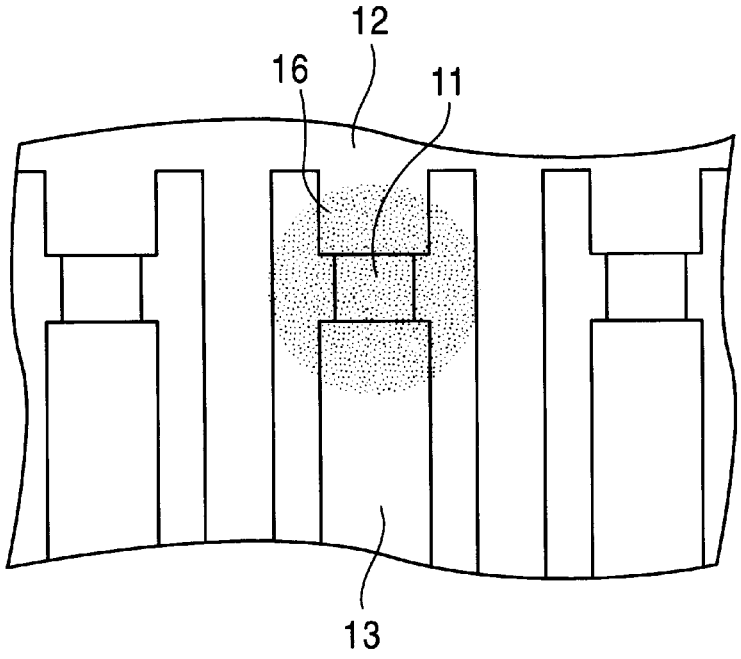
FIG. 5 is a schematic view of a principal part, showing a manner in which ink is forced to fly according to another recording method of the present invention.

By contrast, as shown in FIG. 5, when a signal pulse having a duty of about 80 to 90% is applied, the ink is forced to fly in the form of vaporized matters 16 (including small mist particles having diameters on the order of 1 $\mu$m in some cases). The flying ink sticks onto a transfer target member (not shown) positioned opposite to the transfer section.

Thus, by properly setting, e.g., the duty of a signal pulse applied to the heating means, the transfer section can be selectively heated corresponding to image information, the recording material (ink) can be ejected in the form of a mist with a size primarily not larger than 1 pico-liter (including large mist particles having diameters not smaller than 2 $\mu$m). The ejected ink is stuck and fixed for each unit pixel onto a sheet of printing paper or the like positioned opposite to the transfer section, whereby a high-quality full color image having a density gradation of 64 or more levels, for example, can be obtained.

An example of the construction of a printer head according to the present invention will now be described with reference to FIGS. 6 to 8.

Figure 6:
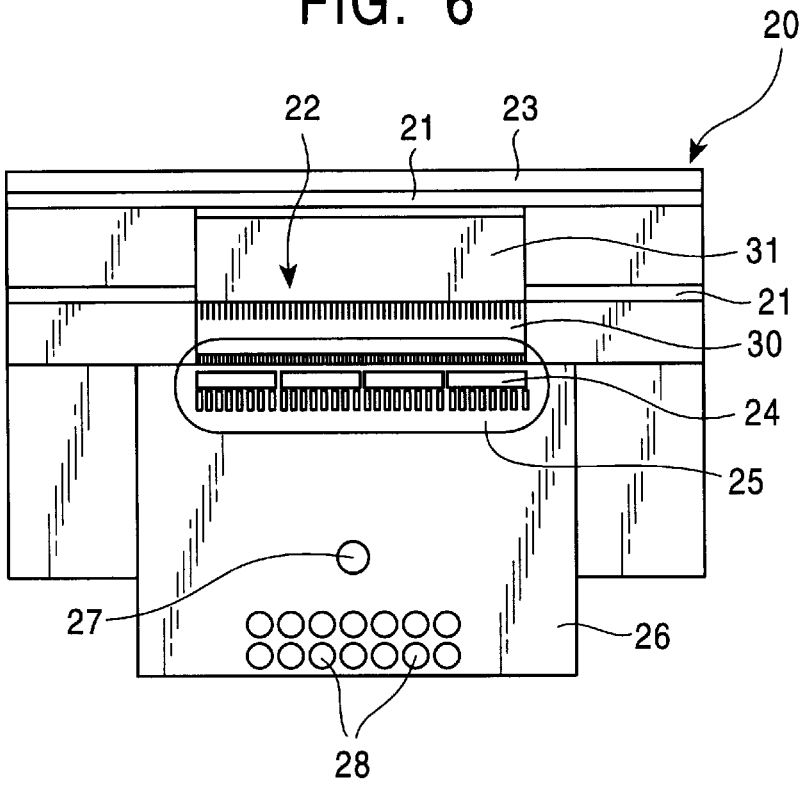
FIG. 6 is a schematic bottom view of a printer head used in a recording apparatus of the present invention with a cover removed.
Figure 7:
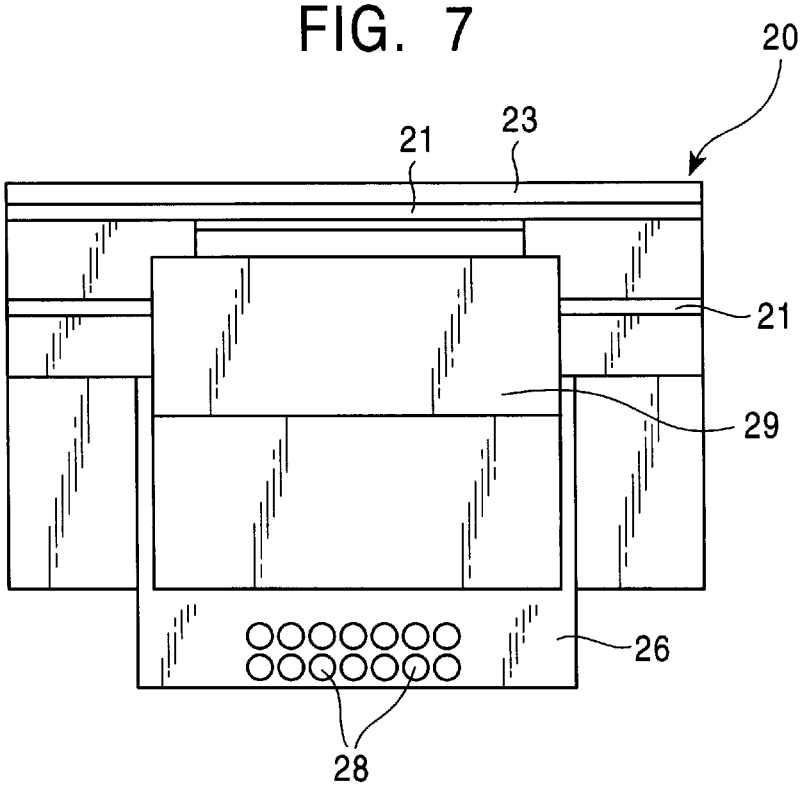
FIG. 7 is a schematic bottom view of the printer head.
Figure 8:
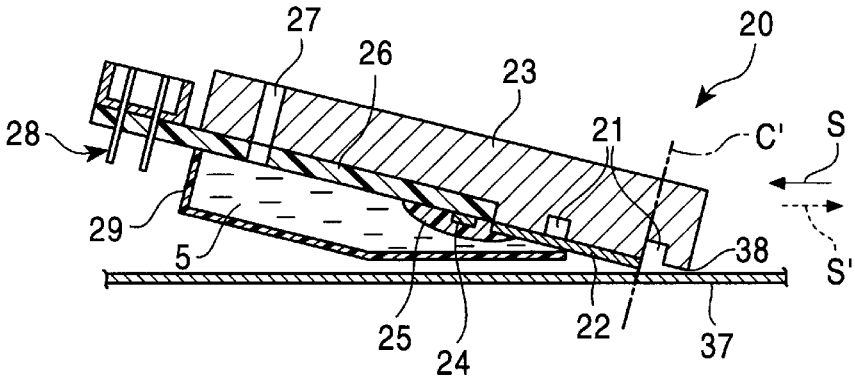
FIG. 8 is a schematic sectional view of the printer head.

FIG. 6 is a bottom view of the printer head according to the present invention with a cover for an ink storage removed, FIG. 7 is a bottom view of the printer head, and FIG. 8 is a schematic sectional view of the printer head in a state where a certain image is transferred onto a sheet of printing paper such as a printer sheet.

In a printer head 20, as shown in FIG. 6, a printed board 26 and a head chip 22 are bonded by a silicone-base adhesive, for example, onto an aluminum-made head base 23 which serves also as a heat sink. A cover 29 is attached by the same type of adhesive to cover them from above, as shown in FIG. 7.

Further, as shown in FIG. 8, an area of the head base 23 where the printed board 26 is to be attached is thinned corresponding to a thickness of the printed board 26. In a condition of the printed board 26 being attached, therefore, the height of the printed board 26 including a driver IC 24, which is mounted on it for driving a heater, is almost the same height as an upper surface of the head chip 22 attached to the head base 23 in a side-by-side relation to the printed board 26.

Grooves 21 are formed in an area of the head base 23 where the head chip 22 is to be bonded, allowing an extra adhesive to escape into the grooves 21 when the head chip 22 is bonded, so that the head chip 22 is evenly bonded. Then, as shown in FIGS. 6 and 8, a silicone-base coating material JCR (Junction Coating Material) 25, for example, is coated and hardened under heating to cover a junction area between electrodes on the head chip 22 and the driver IC 24 and a junction area between the driver IC 24 and a wiring pattern on the printed board 26, for thereby protecting bonding wires therebetween.

Also, s shown in FIGS. 6 and 8, an ink introducing hole 27 is formed through the printed board 26 and the head base 23, and a liquid ink 5 is introduced to a space defined between the head base 23 and the cover 29 from the head base 23 side. The cover 29 is bonded so as to cover a part of the printed board 26 and a part of the head chip 22 in a sealed condition. A space inside the over 29 serves as a common ink passage which receives the ink 5 introduced through the ink introducing hole 27 and supplies the ink 5 to branch ink passages (not shown).

Further, as shown in FIG. 8, by holding one end 38 of the head base 23, on the side where the head chip 22 is attached, in contact with transfer target member (recording member) 37, the printer head 20 can be placed such that it keeps a predetermined angle with respect to the transfer target member 37 while maintaining a constant gap between the flying center C' of an ink flying section (not shown) and the transfer target member 37.

In FIG. 8, the solid-line arrow S denotes a scanning direction of the printer head 20 during printing, and the broken-line arrow S' denotes a return direction after the printing. Specifically, during the printing, the heater is energized with a signal corresponding to image data supplied via a connector 28 provided at an end of the printed board 26, whereupon the ink 5 is forced to fly from the ink flying portion (not shown) for transfer onto the transfer target member 37. The wiring pattern on the printed board 26 is connected to a FPC (Flexible Printed Circuit; not shown) via the connector 28, and is employed for driving the head, for example, in a serial manner shown in FIG. 9 or a line manner shown in FIG. 10.

Figure 9:
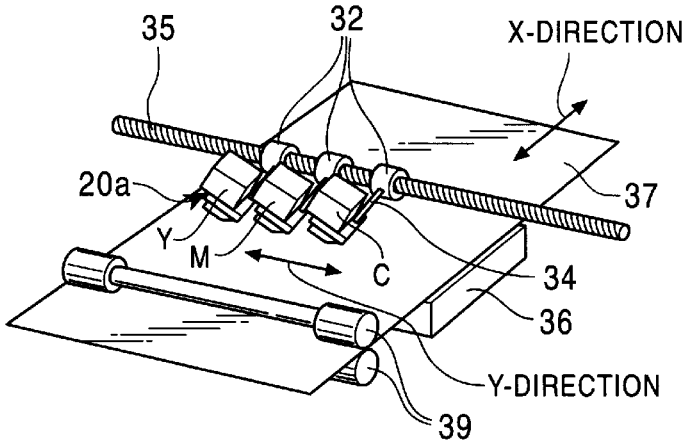
FIG. 9 is a schematic appearance view showing the construction of a serial color printer using three printer heads.

In a serial driving system, as shown in FIG. 9, ink reservoirs containing inks of three primary colors, e.g., Y (yellow), M (magenta) and C (cyan), additionally including black if necessary, are attached respectively to three printer heads 20*a* arranged side by side corresponding to the three primary colors, and the printer heads are coupled through connecting members 34 to carriages 32 engaged with a feed shaft 35. The feed shaft 35 and the carriages 32 are engaged with through thread meshing. Accordingly, when the feed shaft 35 is rotated by a drive source (not shown), the printer heads Y, M and C are reciprocated in the Y-direction indicated by arrow in FIG. 9.

On the other hand, the transfer target member 37 placed opposite to the printer heads 20*a* is moved by advance rollers 39 in the X-direction indicated by arrow in FIG. 9 whenever the printer heads 20*a* are scanned on the line-by-line basis. Thus an image is successively printed by the printer heads on the transfer target member 37 positioned between a platen 36 and the printer heads Y, M and C.

Figure 10:
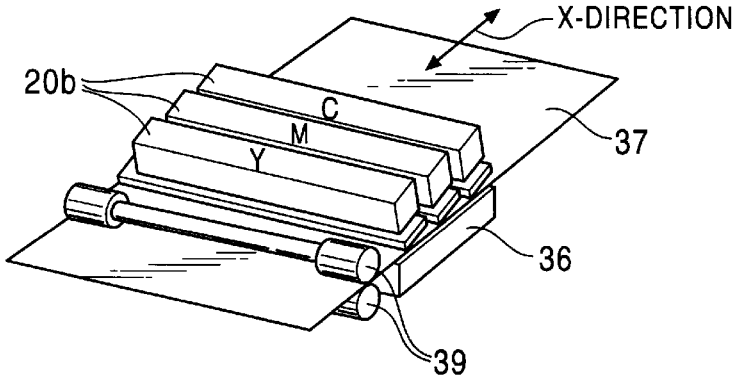
FIG. 10 is a schematic appearance view showing the construction of a line color printer using three printer heads.

In a line driving system, as shown in FIG. 10, three printer heads 20*b* are each fabricated to have a length corresponding to the width of the transfer target member 37, and are arranged in tandem in the X-direction as shown for each color. As with the above serial driving system, ink reservoirs containing inks of three primary colors, e.g., Y (yellow), M (magenta) and C (cyan), additionally including black if necessary, are attached respectively to the three printer heads 20*b*.

The transfer target member 37 is placed opposite to the printer heads Y, M and C, and an image is printed by the printer heads on the transfer target member 37 held between the printer heads and the platen 36. With the transfer target member 37 moved by the advance rollers 39 in the X-direction indicated by arrow in FIG. 10, an image is successively printed.

Next, a process for manufacturing the head chip of the printer head according to the present invention will be described step by step. It is to be noted that the manufacturing process of the printer head according to the present invention is not limited the following one.

FIGS. 11 to 23 are schematic sectional views showing successive steps, and FIGS. 24 to 30 are schematic plan views corresponding to some of those steps.

Figure 11:
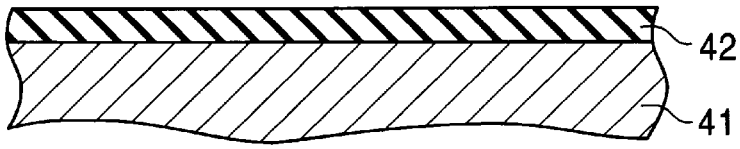
FIG. 11 is a schematic sectional view showing one step of a manufacturing process for a head chip of the printer head used in the recording apparatus of the present invention.

First, as shown in FIG. 11, a substrate 41 of the head chip of the printer head can be formed of a silicon wafer having a good heat radiating characteristic (high thermal conductivity). Then, a $SiO_2$ layer 42 is formed on the substrate 41 in thickness of about 1 to 2 $\mu$m, for example, by thermal oxidation, CVD or any other suitable process. Since the $SiO_2$ layer 42 is positioned just under a heater and serves as a heat accumulating layer, a thickness of the $SiO_2$ layer 42 needs to be determined in consideration of the heat radiating characteristic of the aluminum heat sink, which serves as a head base, in addition to the thickness of the Si substrate 41.

Figure 12:
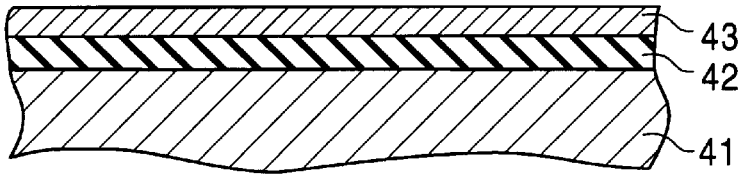
FIG. 12 is a schematic sectional view showing another step of the manufacturing process for the head chip of the printer head.

Then, as shown in FIG. 12, a polysilicon layer 43, serving as a resistor (heater), is formed on the $SiO_2$ layer 42 in thickness of about 0.4 $\mu$m, for example, by reduced-pressure CVD or any other suitable process. Preferably, phosphorous (P) or the like is doped into the polysilicon layer 43 to provide sheet resistance of about 4 kΩ.

Figure 13:
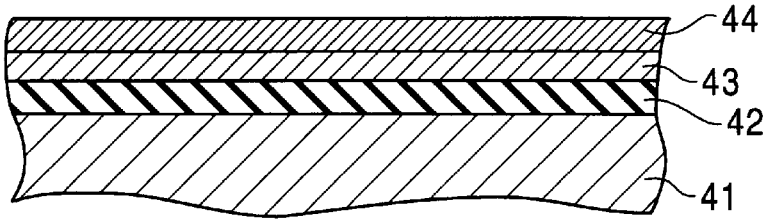
FIG. 13 is a schematic sectional view showing still another step of the manufacturing process for the head chip of the printer head.

Then, as shown in FIG. 13, an aluminum layer 44, serving to form electrodes, is formed on the polysilicon layer 43 in thickness of about 0.5 $\mu$m, for example, by sputtering or any other suitable process. In this step, other metals, such as gold, copper and platinum, than aluminum can also be used as an conductor.

Figure 14:
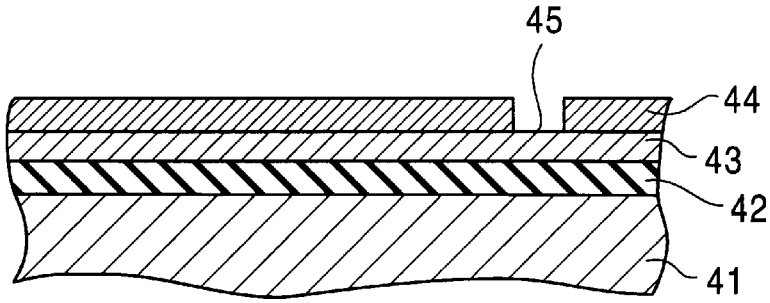
FIG. 14 is a schematic sectional view (taken along the line XIV—XIV of FIG. 24) showing still another step of the manufacturing process for the head chip of the printer head.
Figure 24:
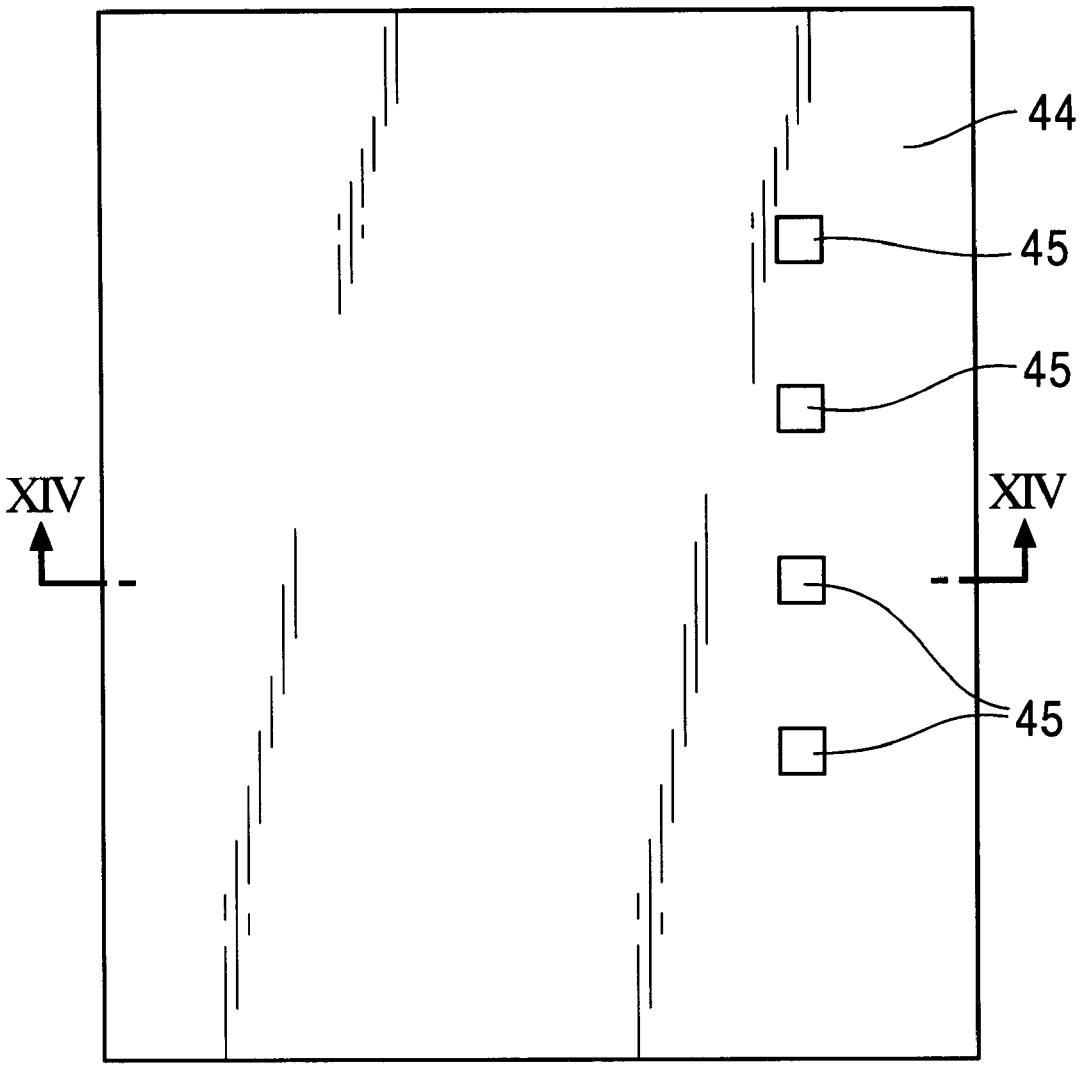
FIG. 24 is a schematic plan view for explaining one step of the manufacturing process for the head chip of the printer head.

Then, as shown in FIG. 14 (sectional view taken along the line XIV—XIV of FIG. 24) and FIG. 24, a photoresist is formed in a predetermined pattern and the aluminum layer 44 is selectively removed with an etchant corresponding to the photoresist pattern to thereby make the polysilicon layer 43 exposed in area where heater sections (heaters) 45 are to be formed (though four heater sections 45 are illustrated for simplicity, the heater sections 45 may be provided in larger number; this will be equally applied to the following description). FIG. 24 is a plan view corresponding to FIG. 14 in a state after this step. An acid mixture of phosphoric acid, nitric acid, acetic acid and water mixed at a ratio of 4:1:4:1 can be used as the etchant for the aluminum layer 44.

Figure 15:
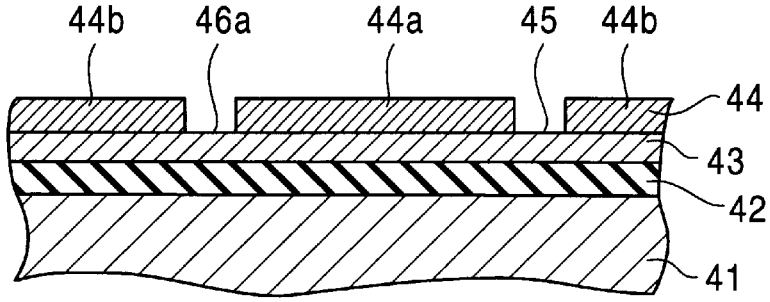
FIG. 15 is a schematic sectional view (taken along the line XV—XV of FIG. 25) showing still another step of the manufacturing process for the head chip of the printer head.
Figure 25:
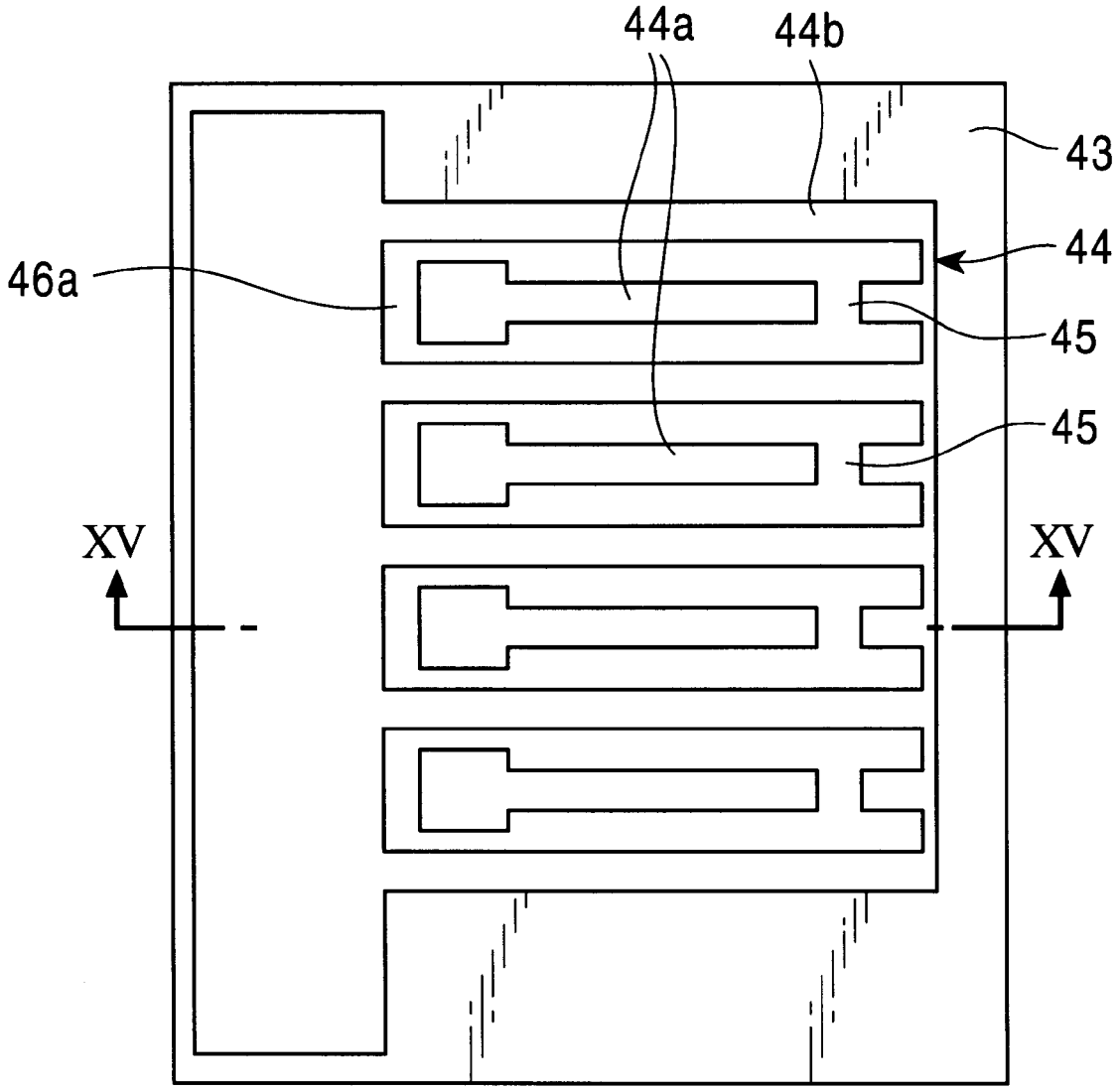
FIG. 25 is a schematic plan view for explaining another step of the manufacturing process for the head chip of the printer head.

Then, as shown in FIG. 15 (sectional view taken along the line XV—XV of FIG. 25) and FIG. 25, a photoresist is formed to define a predetermined wiring pattern connected to each of the heater sections 45. By employing the photoresist pattern as a mask, the aluminum layer 44 is selectively removed with the same aluminum etchant as used in the above step into a conductor pattern comprising a common electrode 44*b* and individual electrodes 44*a*.

Figure 16:
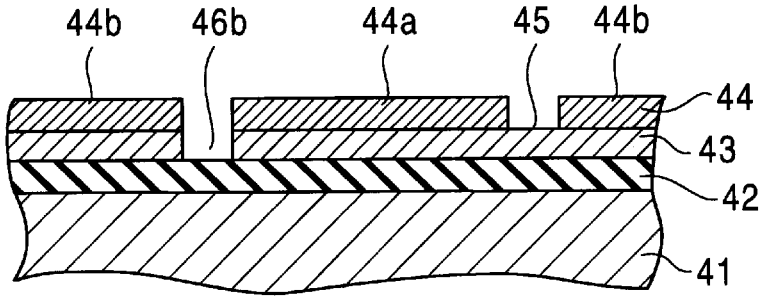
FIG. 16 is a schematic sectional view (taken along the line XVI—XVI of FIG. 26) showing still another step of the manufacturing process for the head chip of the printer head.
Figure 26:
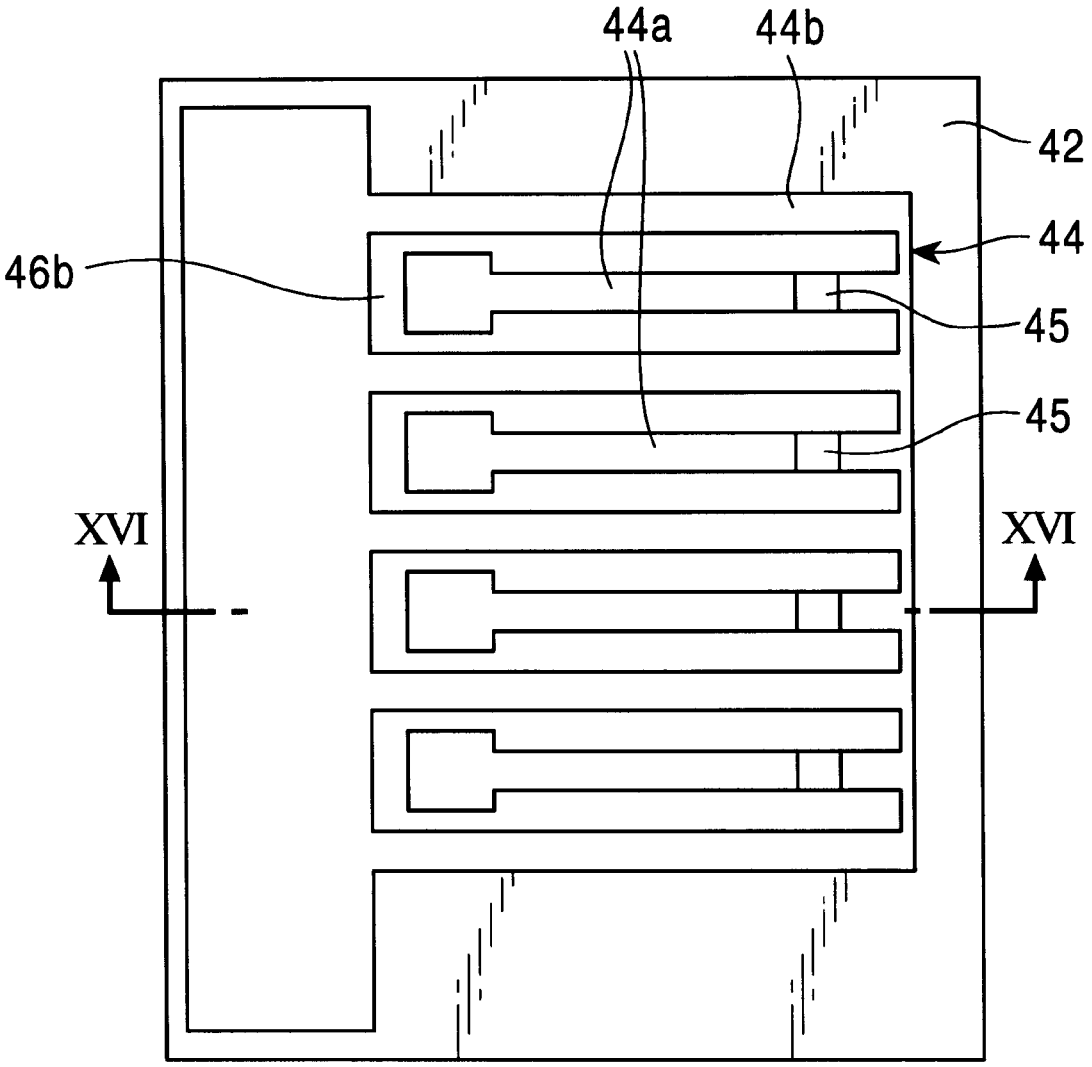
FIG. 26 is a schematic plan view for explaining another step of the manufacturing process for the head chip of the printer head.

Then, as shown in FIG. 16 (sectional view taken along the line XVI—XVI of FIG. 26) and FIG. 26, since the polysilicon layer 43 is not etched with the aluminum etchant, the polysilicon layer 43 is etched into the same pattern as the aluminum layer 44 except the heater sections 45 by the RIE process using a $CF_4$ (carbon fluoride) gas, for example, by employing, as a mask, the same photoresist pattern as used in the above step.

In this step, because the photoresist (not shown) is formed on the areas of the polysilicon layer 43 which serve as the heater sections 45, the polysilicon layer 43 in those areas is not etched. The aluminum layer 44 and the polysilicon layer 43 are formed into the same conductor pattern except the areas of the polysilicon layer 43 in which the polysilicon layer 43 has been exposed in the step shown in FIG. 14. With heat treatment carried out in a later step, the aluminum layer 44 (the common electrode 44*b* and the individual electrodes 44*a*) and the polysilicon layer 43 are brought into an ohmic contact state to function as a unitized conductor. The exposed areas of the polysilicon layer 43 remain as high-resistance resistors and function as resistance heater sections 45.

Figure 17:
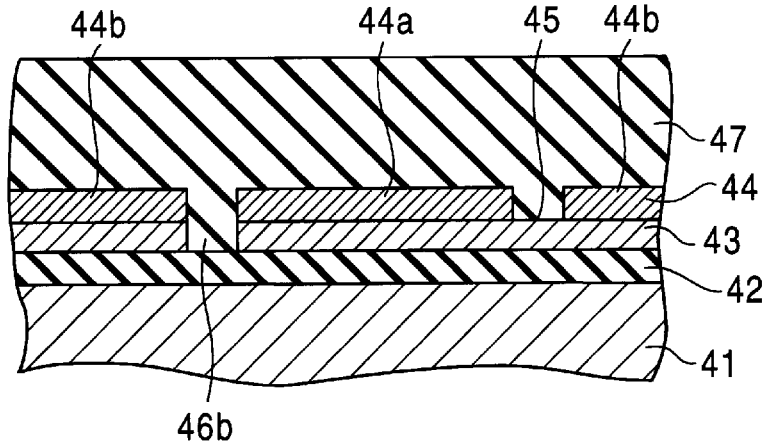
FIG. 17 is a schematic sectional view showing still another step of the manufacturing process for the head chip of the printer head.

Then, as shown in FIG. 17, a $SiO_2$ layer 47 is formed on the entire surface in thickness of about 6 μm, for example, by CVD or any other suitable process, followed by annealing, e.g., at 450° C. for 30 minutes in a nitrogen atmosphere. Thus cylindrical treatment is performed to establish ohmic contact between the polysilicon layer and the aluminum layer (i.e., ohmic contact between the resistors and the electrodes).

Figure 18:
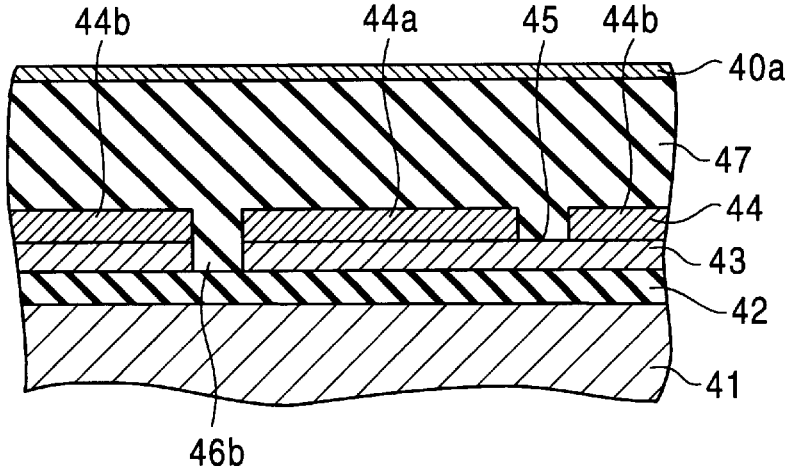
FIG. 18 is a schematic sectional view showing still another step of the manufacturing process for the head chip of the printer head.

Then, as shown in FIG. 18, a metal layer (made of, e.g., chromium) 40*a* is formed in thickness of about 0.2 μm, for example, by sputtering or any other suitable process. The metal layer 40*a* provides a metal mask when pillar members (small columnar members) serving as the ink holding means and ink accommodating portions in the form of minute holes to hold ink therein with capillary attraction are formed.

Figure 19:
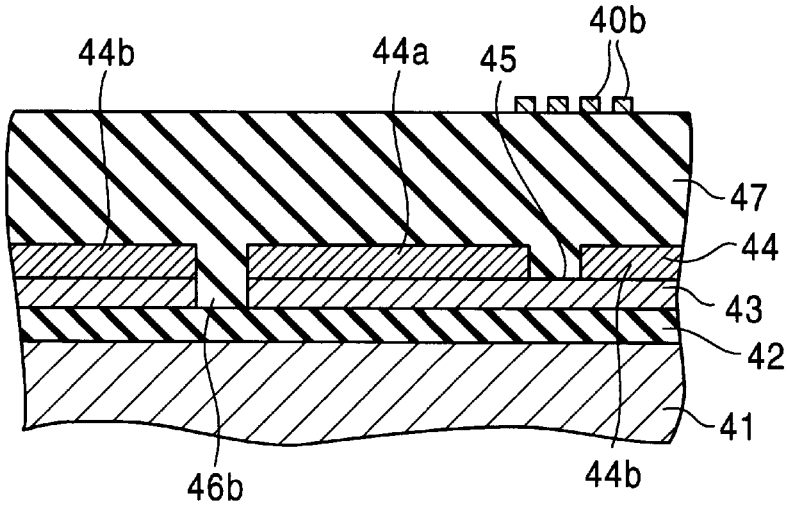
FIG. 19 is a schematic sectional view (taken along the line XIX—XIX of FIG. 27) showing still another step of the manufacturing process for the head chip of the printer head.
Figure 27:
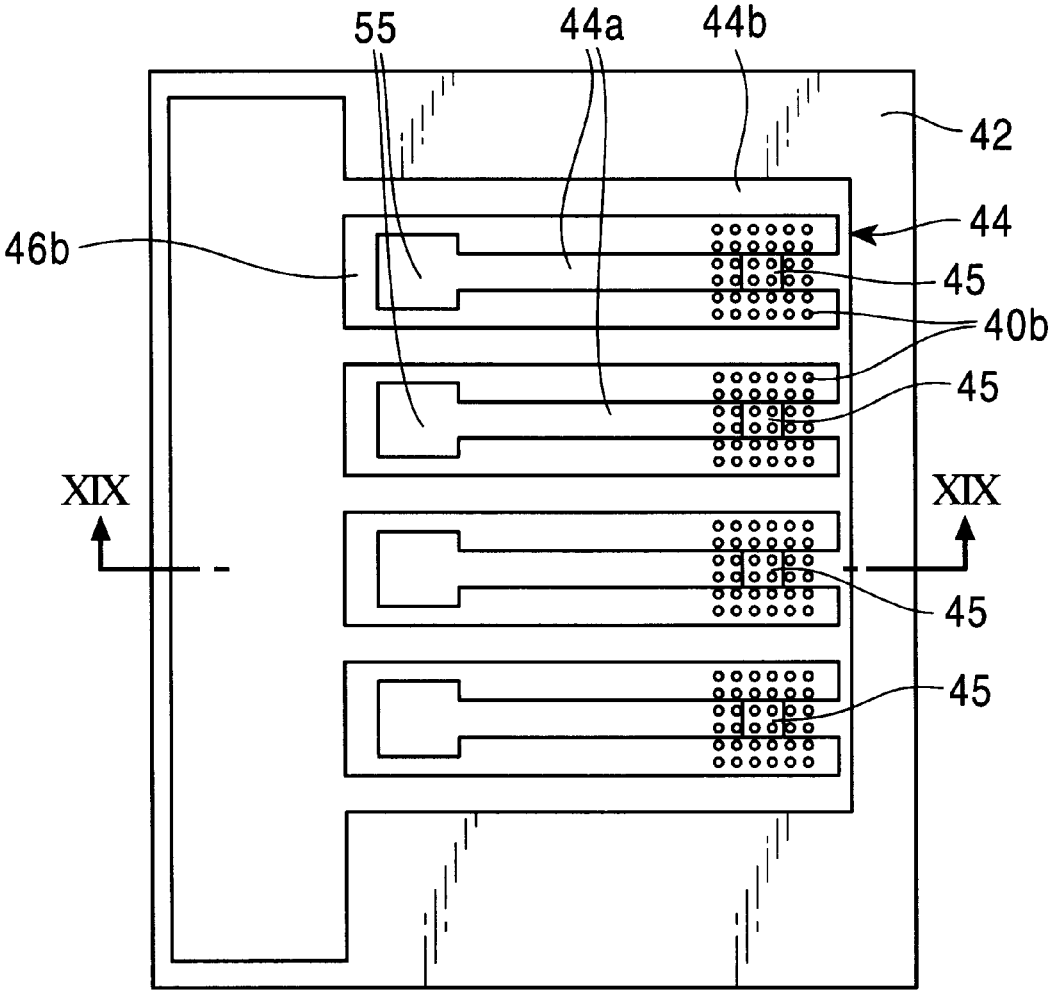
FIG. 27 is a schematic plan view for explaining still another step of the manufacturing process for the head chip of the printer head.

Then, as shown in FIG. 19, a photoresist is formed in a predetermined pattern for forming groups of columnar members and ink accommodating portions, and the chromium film is removed in unnecessary areas by the RIE process using a gas mixture of chlorine and oxygen to thereby form metal masks 40*b* in the predetermined pattern. FIG. 27 is a plan view corresponding to FIG. 19. In FIG. 27, the metal masks 40*b* are illustrated, while the $SiO_2$ layer 47 is omitted.

Figure 20:
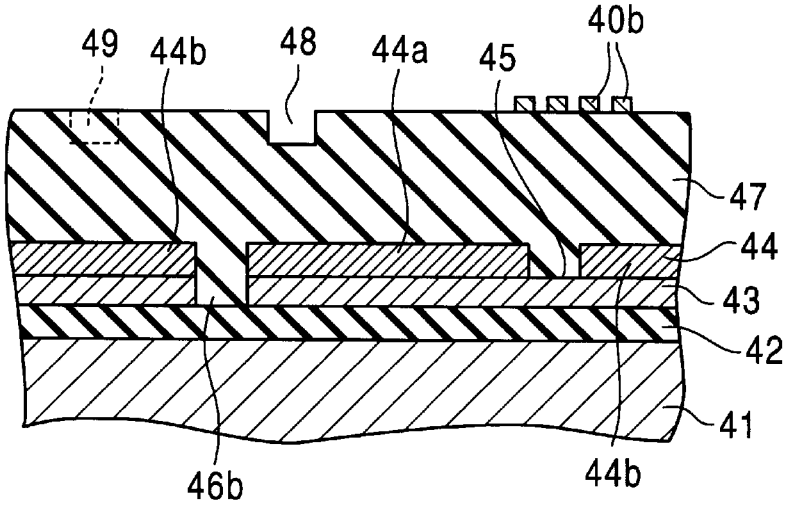
FIG. 20 is a schematic sectional view showing still another step of the manufacturing process for the head chip of the printer head.

Then, as shown in FIG. 20, a photoresist is formed in a predetermined pattern for opening bonding pad areas 48 and 49 through which the electrodes are to be led out, and the $SiO_2$ layer 47 is etched in thickness of about 1 μm by the RIE process. This step aims to make it sure that all the bonding pad areas, which are present on the wafer for leading out the electrodes, are surely opened in the next step of forming the groups of columnar members and ink accommodating portions.

Figure 21:
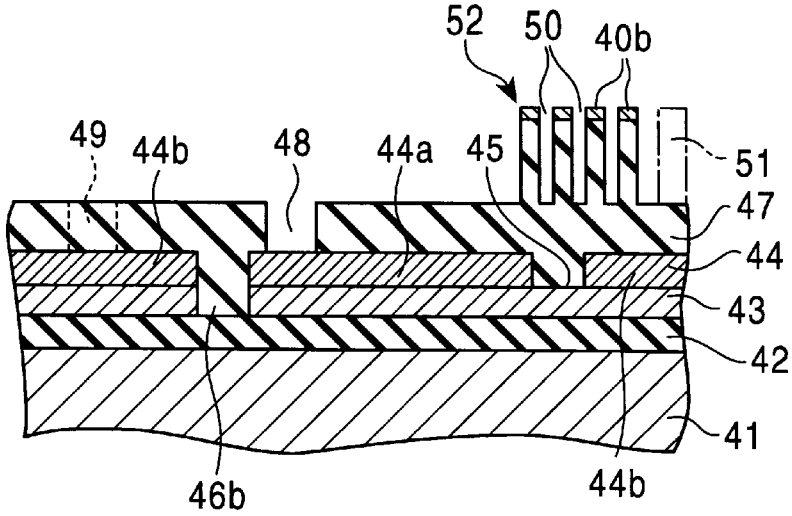
FIG. 21 is a schematic sectional view (taken along the line XXI—XXI of FIG. 28) showing still another step of the manufacturing process for the head chip of the printer head.
Figure 28:
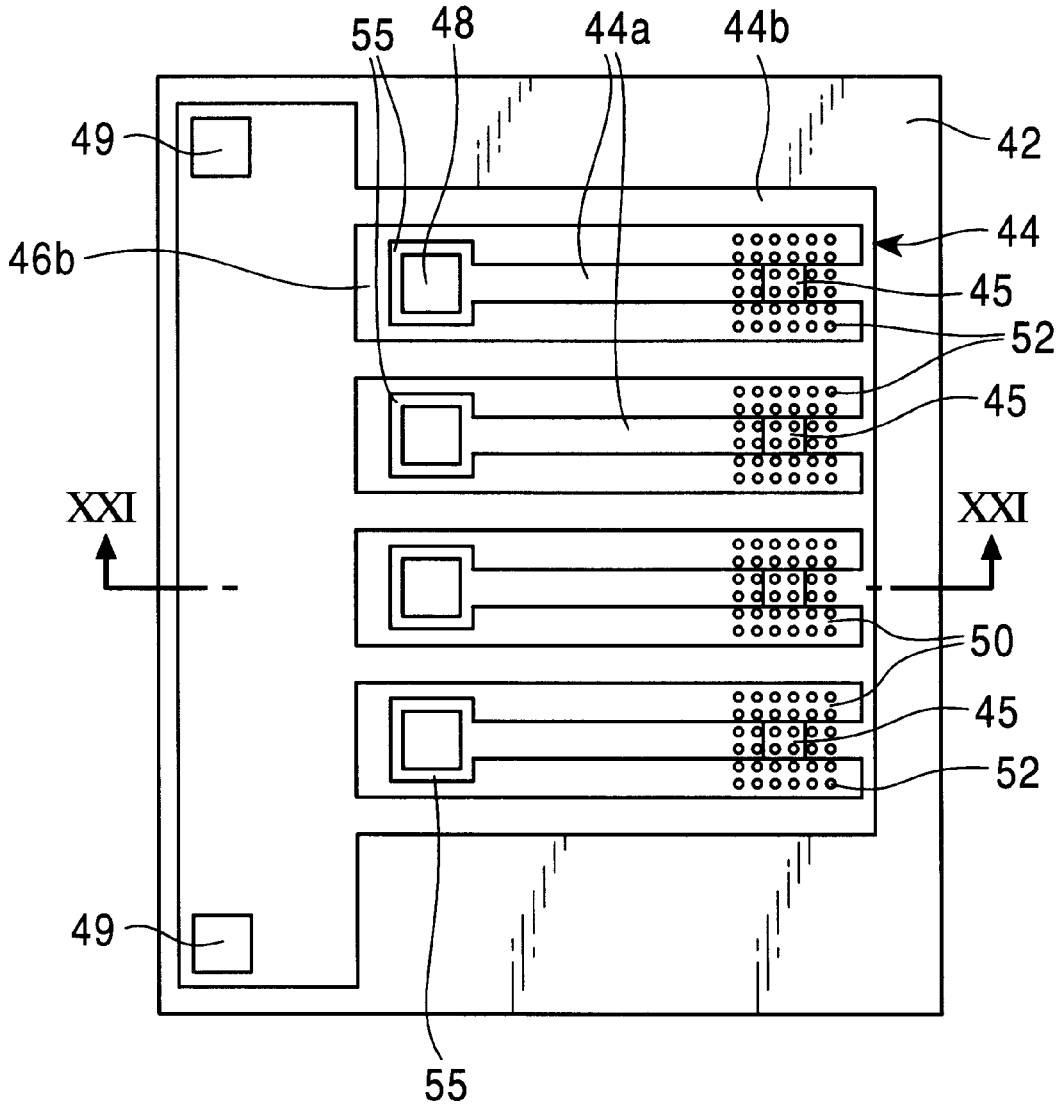
FIG. 28 is a schematic plan view for explaining still another step of the manufacturing process for the head chip of the printer head.

Then, as shown in FIG. 21 (sectional view taken along the line XXI—XXI of FIG. 28) and FIG. 28, by using the metal masks 40*b* formed in the predetermined pattern as a mask, the $SiO_2$ layer 47 is etched by the RIE process to form the groups of ink accommodating portions 50 and columnar members 52 therein (the number of the columnar members is not exactly illustrated). In the illustrated example, one group of ink accommodating portions 50 and columnar members 52 are formed corresponding to one heater section 45. At the same time, the bonding pad areas 48, 49 for leading out the electrodes are also opened through the $SiO_2$ layer 47 to make the electrode aluminum layer exposed. Note that, also in FIG. 28, the $SiO_2$ layer 47 shown in FIG. 21 is omitted. A member shown by imaginary lines at numeral 51 in FIG. 21 denotes a surrounding wall described later.

Figure 22:
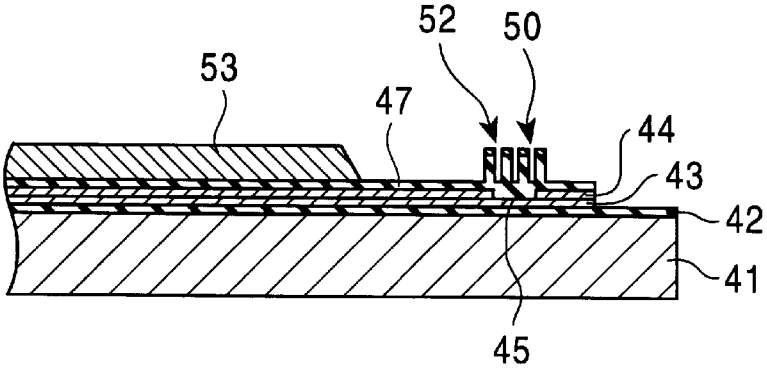
FIG. 22 is a schematic sectional view (taken along the line XXII—XXII of FIG. 29) showing still another step of the manufacturing process for the head chip of the printer head.
Figure 29:
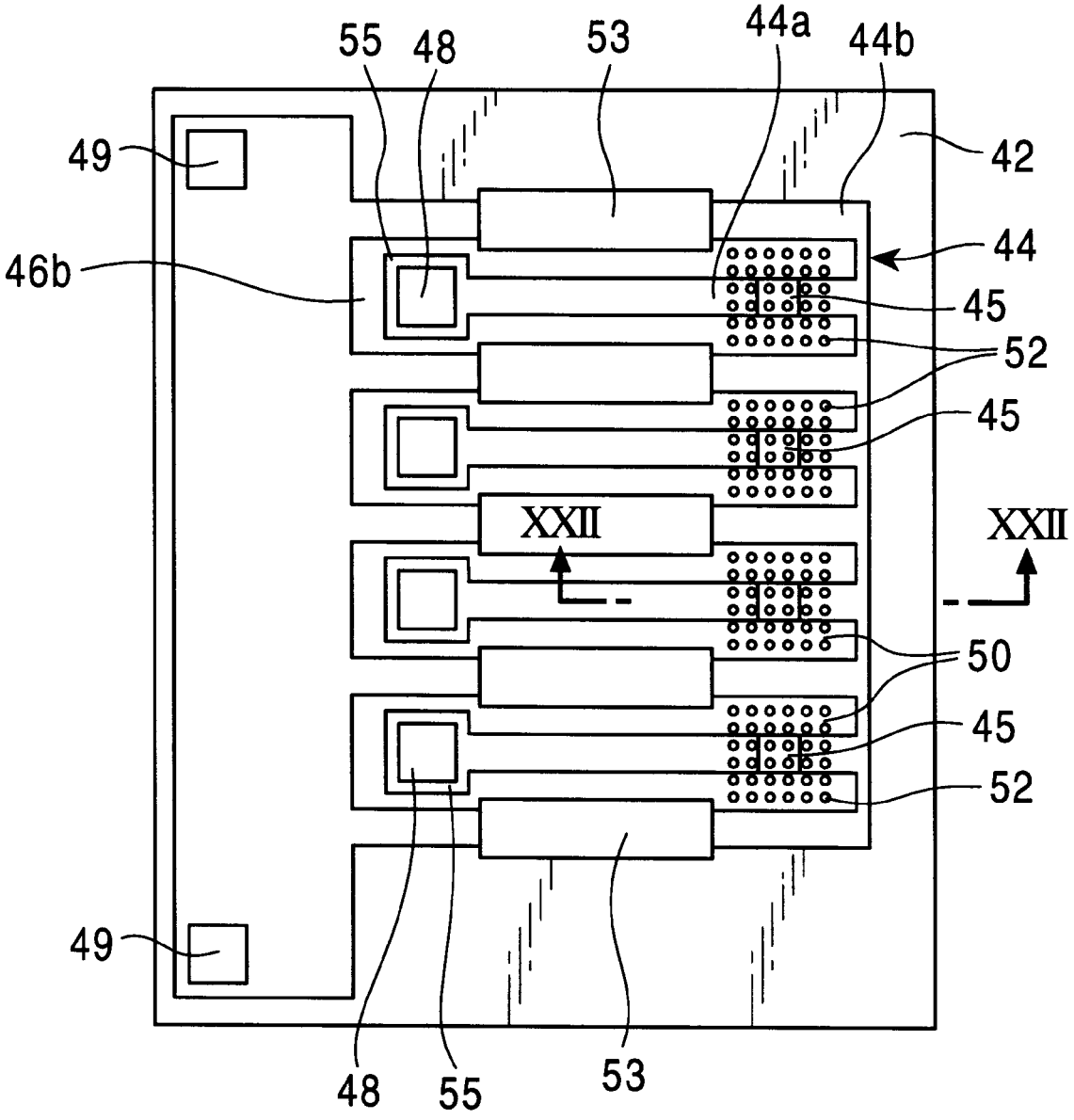
FIG. 29 is a schematic plan view for explaining still another step of the manufacturing process for the head chip of the printer head.

Then, as shown in FIG. 22 (schematic sectional view taken along the line XXII—XXII of FIG. 29) and FIG. 29, a dry film (sheet resist) 53 having a thickness of about 25 μm is laminated and patterned into a predetermined pattern to provide partitions which define ink supply passages.

Figure 23:
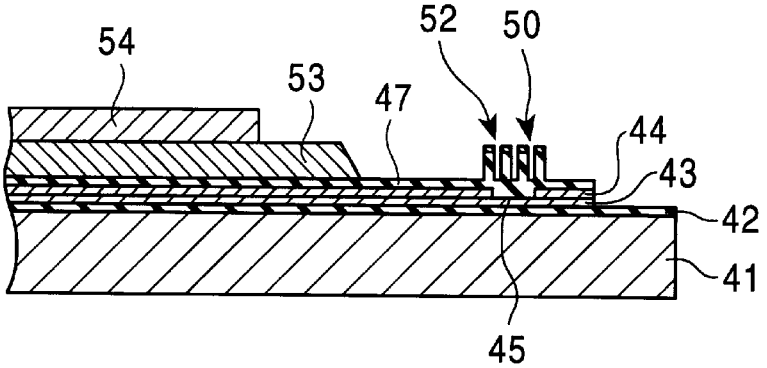
FIG. 23 is a schematic sectional view (taken along the line XXIII—XXIII of FIG. 30) showing still another step of the manufacturing process for the head chip of the printer head.
Figure 30:
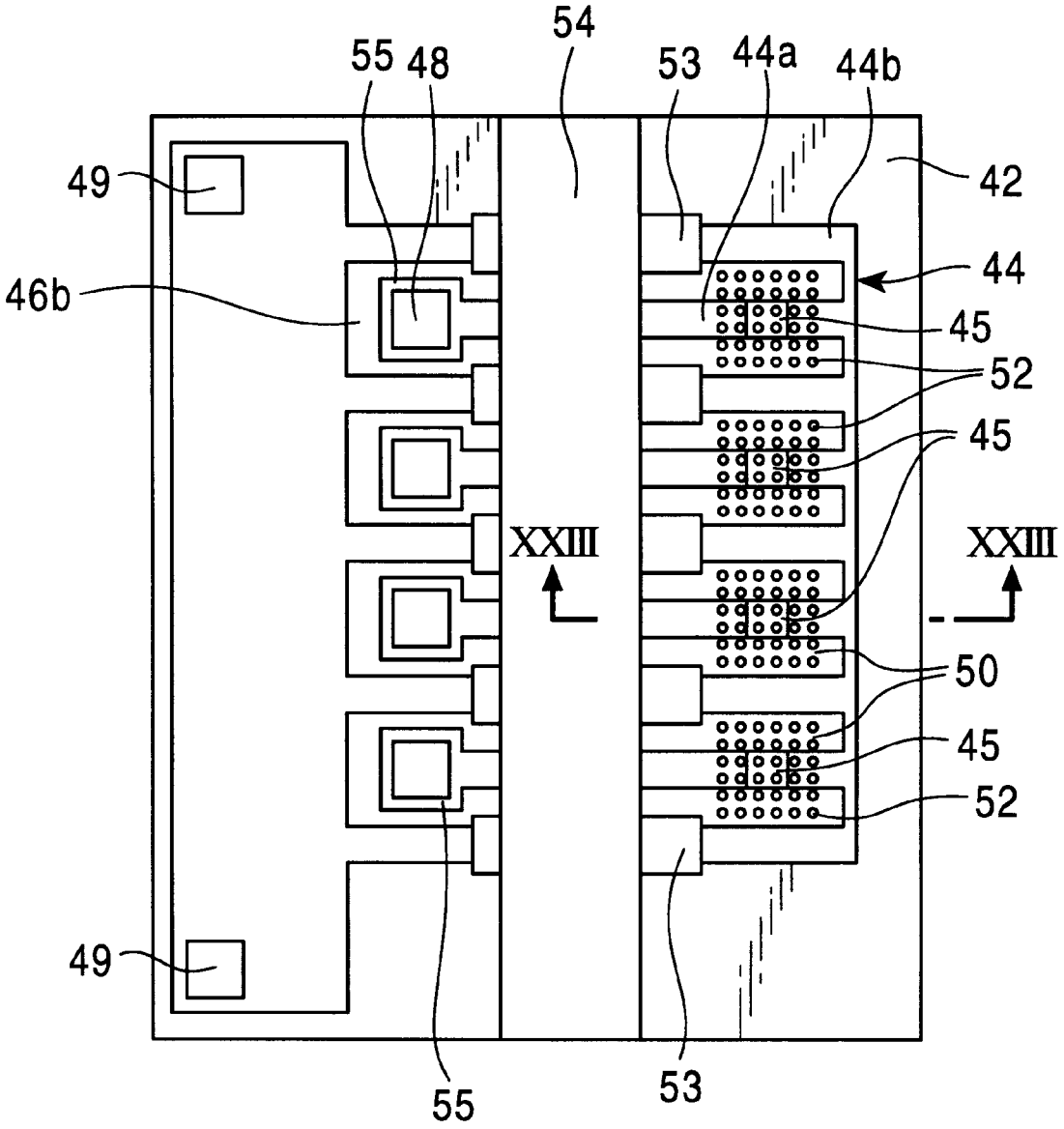
FIG. 30 is a schematic plan view for explaining still another step of the manufacturing process for the head chip of the printer head.

Further, as shown in FIG. 23 (schematic sectional view taken along the line XXIII—XXIII of FIG. 30) and FIG. 30, a nickel (Ni) sheet 54 finished to have a thickness of about 25 μm with high precision beforehand is fixedly disposed by thermal press-bonding to form a lid for the ink supply passages.

Thus the head chip is completed by forming, on a silicon substrate, heaters, wiring conductors, ink accommodating portions, and branch ink passages as a unitary structure corresponding to transfer sections, and cutting the substrate into a predetermined size.

After that, a driver IC, etc. are mounted, as shown in FIG. 6, so that the heaters 45 of the head chip may be driven with signals corresponding to image data. On a printed board made of glass or epoxy, a wiring pattern of copper or the like is formed for connection between the driver IC and connectors.

Connections between the electrodes on the head chip and the driver IC and between the driver IC and the connectors on the printed board are made by wire bonding using gold wires with a diameter of 25 μm, for example. Moreover, a silicone-base coating material JCR is coated and hardened under heating for protecting the driver IC and the bonding wires.

The head chip thus fabricated is bonded to a head base and a cover is attached in place, as described above with reference to FIGS. 6 to 8, followed by being used as a printer head in the serial driving system shown in FIG. 9 or in the line driving system shown in FIG. 10.

With the manufacturing process described above, the printer head according to the present invention can be easily manufactured with high accuracy by employing the semiconductor lithographic process.

Figure 31:
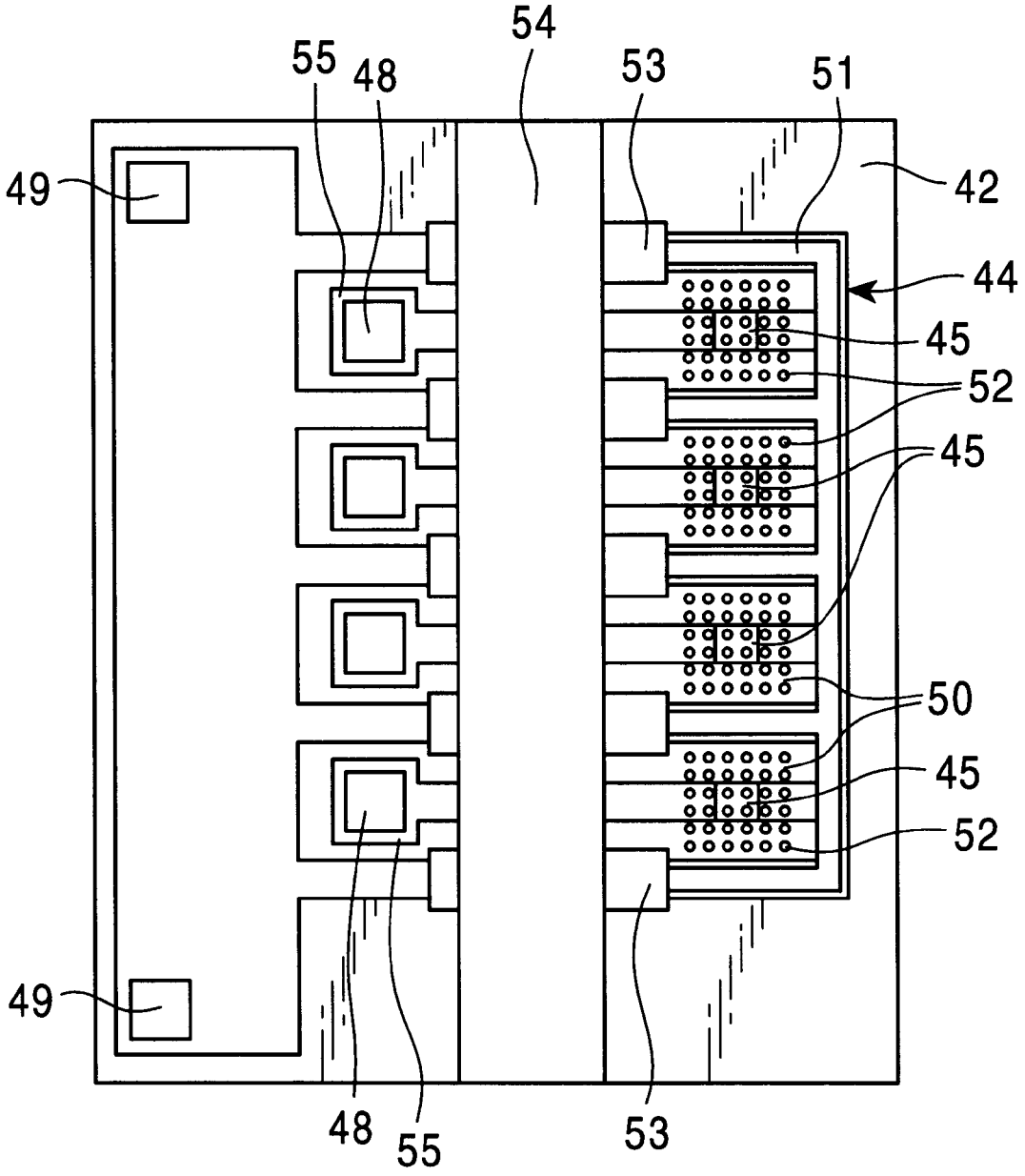
FIG. 31 is a schematic plan view of a head chip of the printer head in another form used in the recording apparatus of the present invention.

Additionally, as shown in FIG. 31, a partition wall 51 (shown by imaginary lines in FIG. 21) made of $SiO_2$ may be formed so as to surround each dye flying section (transfer section), and the Ni sheet 54 may be attached to the tops of the partition wall 51. The partition wall 51 assists the dye to form good meniscus.

The present invention will be described below in more detail in conjunction with Examples. It is a matter of course that the present invention is not restricted by the following Examples.

EXAMPLE 1

Structure of Printer Head

A printer head according to this Example has a similar structure as shown in FIGS. 6 to 8. The printer head comprises an aluminum head base 23 serving also as a heat sink, a heater chip 22 including transfer sections and ink supply passages for introducing ink to them which are formed as a unitary structure, a printed board 26 including a driver IC 24 mounted thereon and a wiring pattern formed to supply currents to respective heaters in accordance with image data to be transferred, and a cover 29 serving to protect the driver IC 24 and define the ink supply passages. As described later, a sheet of printing paper is held in contact with a part of the head base 23 so that a predetermined gap is maintained between the transfer section and the sheet of printing paper.

Figure 35:
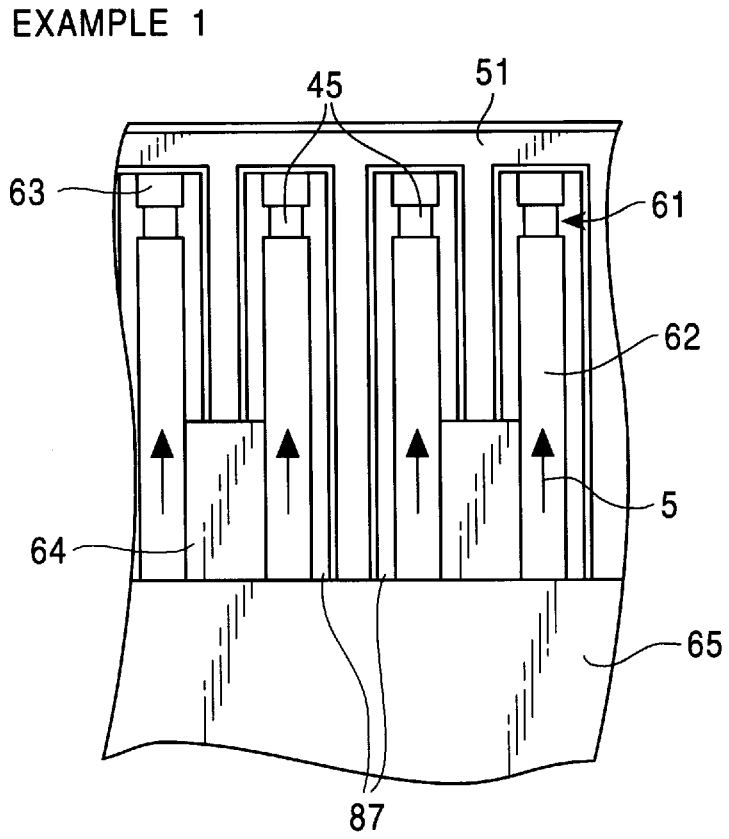
FIG. 35 is a schematic plan view showing the structure of a transfer section and thereabout of the head chip according to Example 1 of the present invention.

FIG. 35 is an enlarged plan view showing the structure of a heater chip end portion and thereabout of the printer head according to this Example. On the heater chip, heating means (heaters) 45 for heating ink, a wiring pattern (comprising individual electrodes 62 and a common electrode 63) for applying signal voltages in accordance with image signals to the heaters 45 for energization thereof, and ink supply passages 87 for supplying a dye (ink) in the direction of arrows shown in FIG. 35.

The pitch between the heaters 45 in Example 1 is 84.7 μm, and a total of 256 heaters (transfer sections) are formed in one heater chip. Since one heater transfers the ink for one dot, a resolution of 300 dpi can be realized. The heaters 45 are each formed by poly-Si (polysilicon) being 20 μm×20 μm square. The individual electrodes 62 and the common electrode 63 are connected to the heaters 45 so that signal voltages in accordance with image signals may be applied to the heaters 45 for energizing them.

The ink is supplied to transfer sections 61 through the ink supply passages 87 which are each defined by a sheet resist 64 and a Ni sheet 65, shown in FIG. 35, into a tunnel-like shape. An end of the sheet resist 64 forming a partition wall of the ink supply passages 87 is located in a position receded backward 100 μm from the center of the heater 45, and an end of the Ni sheet 65 forming a lid of the ink supply passages 87 is located in a position further receded backward 100 μm from the end of the sheet resist 64.

Since the transfer sections 61 disposed near the heaters are formed, as described above, to have the ends kept open without being enclosed, the surface of the ink positioning above the heaters are controlled to avoid excessive supply of the ink. If the excessive ink is supplied to an area above the heater, energy required to be supplied to the heater for producing the Marangoni flow would be increased, thus resulting in reduced transfer efficiency. Further, the ends of the sheet resist 64 and the Ni sheet 65 are arranged such that the ends of the components placed at higher levels from the substrate surface are located in positions farther away from the transfer section. This arrangement aims to prevent contact between the printer head and a sheet of printing paper which are positioned opposite to each other.

The process of manufacturing the heater chip, which is a core of the printer head used in this Example, and the process of assembling it into the printer head will be described below.

Heater Chip Manufacturing Process

The process of manufacturing the heater chip will be described with reference to FIGS. 11 to 18 and FIG. 32 to 34.

In the printer head of this Example, unlike a printer head based on laser heating, the substrate needs to be a transparent substrate allowing light to pass through it. Therefore, a material of the substrate can be selected in consideration of a thermal response that affects the on/off cycle of the heater. Although a quartz substrate or a ceramic substrate of, e.g., alumina is also usable, having a good heat radiating characteristic (high thermal conductivity) was employed as a heater chip substrate in this Example.

First, as shown in FIG. 11, on a substrate 41 formed of a silicon wafer, a $SiO_2$ layer 42 was formed in thickness of about 1 to 2 μm by the thermal oxidation or CVD process. Since the $SiO_2$ layer 42 is positioned just under a heater and serves as a heat accumulating layer, a thickness of the $SiO_2$ layer 42 needs to be determined in consideration of the heat radiating characteristic of the aluminum heat sink, which serves as a head base, in addition to the thickness of the Si substrate 41.

Then, as shown in FIG. 12, a polysilicon (poly-Si) layer 43, serving as a resistor (heater), was formed on the $SiO_2$ layer 42 in thickness of about 0.4 μm by the reduced-pressure CVD process. Phosphorous (P) was doped into the polysilicon layer 43 to provide sheet resistance of about 4 kΩ.

Then, as shown in FIG. 13, an aluminum layer 44 was formed on the polysilicon layer 43 in thickness of about 0.7 μm by the sputtering process. In this step, other metals, such as gold, copper and platinum, than aluminum are also usable as an conductor.

Then, as shown in FIG. 14, a photoresist was formed in a predetermined pattern and the aluminum layer 44 was selectively removed with an etchant corresponding to the photoresist pattern to thereby make the polysilicon layer 43 exposed in area where heaters 45 are to be formed. An acid mixture of phosphoric acid, nitric acid, acetic acid and water mixed at a ratio of 4:1:4:1 was used as the etchant for the aluminum layer 44.

Then, as shown in FIG. 15, a photoresist was formed to define a wiring pattern connected to each of the heaters 45. By employing the photoresist pattern as a mask, the aluminum layer 44 was selectively removed with the same aluminum etchant as used the above step into a conductor pattern (i.e., a common electrode 44*b* and individual electrodes 44*a*).

Then, as shown in FIG. 16, since the polysilicon layer 43 was not etched with the aluminum etchant, the polysilicon layer 43 was etched into the same pattern as the aluminum layer 44 except the heater sections 45 by the RIE process using a $CF_4$ gas by employing, as a mask, the same photoresist pattern as used in the above step. Resulting holes 46*b* serve as insulation holes for electrically isolating the common electrode 44*b* and the individual electrodes 44*a* from each other. In this step, because the photoresist (not shown) is formed on the areas of the polysilicon layer 43 which serve as the heaters 45, the polysilicon layer 43 in those areas is not etched.

Thus the aluminum layer 44 and the polysilicon layer 43 were formed into the same conductor pattern except the areas of the polysilicon layer 43 which had been exposed in the step shown in FIG. 14. With heat treatment carried out in a later step, aluminum and polysilicon are brought into an ohmic contact state to function as a unitized conductor. The exposed areas of polysilicon remain as high-resistance resistors and function as resistance heaters 45. In this Example, the heaters 45 were each formed into a square with one side of 20 μm (maximum dimension width of 40 μm).

Then, as shown in FIG. 17, a $SiO_2$ layer 47 was formed on the entire surface in thickness of about 10 μm by the CVD process.

Then, as shown in FIG. 18, a chromium layer 40*a*, serving as a metal mask in a later step of forming a wall 51 to surround each heater 45, was formed in thickness of about 0.2 μm by the vacuum vaporization process. Note that the foregoing steps are basically the same as those used in the manufacturing process described above as a basic embodiment.

Figure 32:
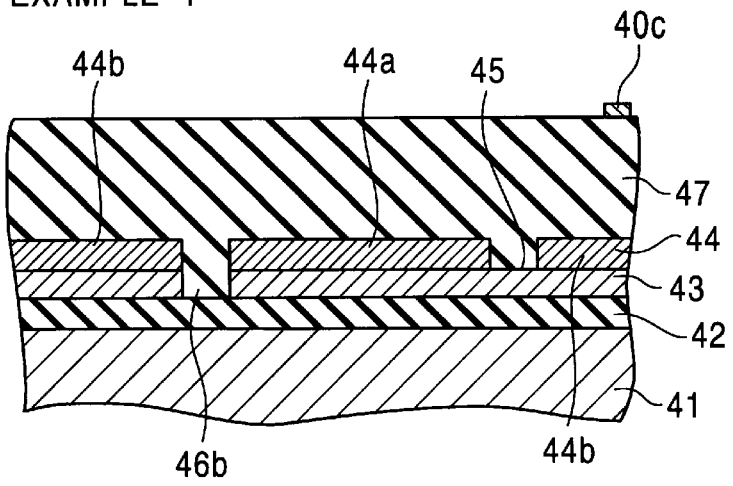
FIG. 32 is a schematic sectional view for explaining one step of a manufacturing process for a head tip of the printer head according to Example 1 of the present invention.

Then, as shown in FIG. 32, a photoresist (not shown) was formed in a predetermined pattern for forming the wall 51, and the chromium film was removed in unnecessary areas by an ion milling apparatus to thereby form metal mask 40*c*.

Figure 33:
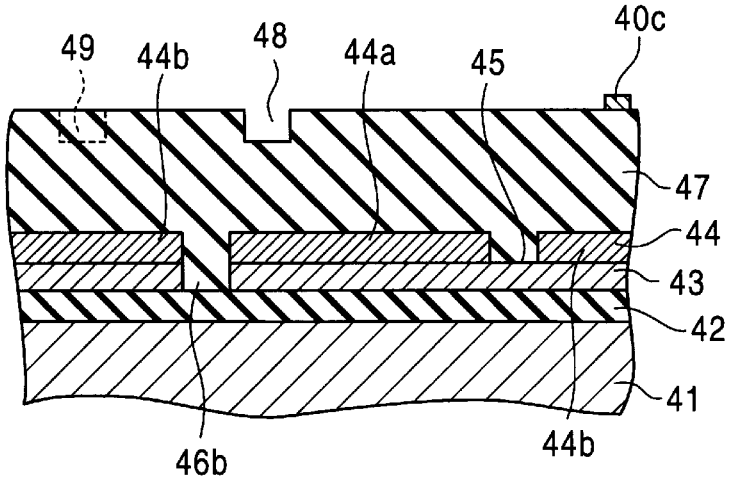
FIG. 33 is a schematic sectional view for explaining another step of the manufacturing process for the head tip of the printer head according to Example 1 of the present invention.

Then, as shown in FIG. 33, a photoresist was formed in a predetermined pattern for opening bonding pad areas through which the electrodes were to be led out (i.e., bonding pad areas 48 for leading out the individual electrodes 44*a* and bonding pad areas 49 for leading out the common electrode 44*b*), and the $SiO_2$ layer 47 was etched by the RIE process.

Figure 34:
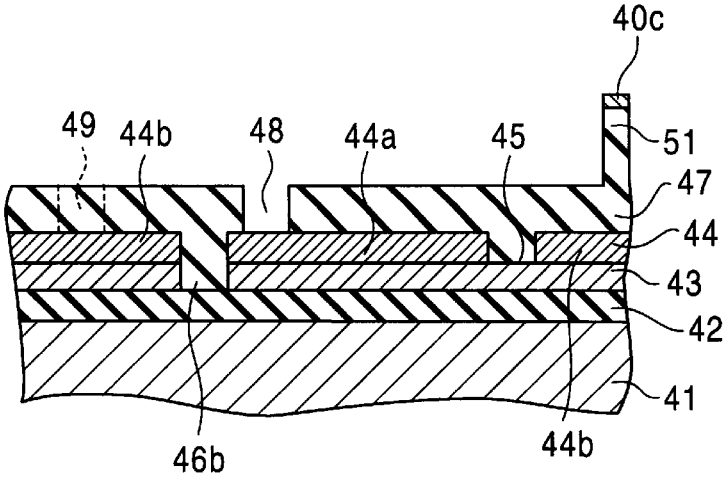
FIG. 34 is a schematic sectional view for explaining still another step of the manufacturing process for the head tip of the printer head according to Example 1 of the present invention.

Then, as shown in FIG. 34, by using the chromium film 40*c* formed in the predetermined pattern as a mask, the $SiO_2$ layer 47 was etched by the RIE process to form the wall 51 having a thickness of about 8 μm and made of the remaining $SiO_2$ layer 47. The wall 51 was formed so as to surround each heater.

Then, though not shown, a dry film (sheet resist) 64 having a thickness of about 25 μm was laminated and patterned into a predetermined pattern to define ink supply passages 87 basically as with the step shown in FIG. 22. An end of the patterned sheet resist 64 on the same side as the heater 45 was located in a position spaced 100 μm from the center of the heater 45. A similar patterning may be performed using polyimide instead of the sheet resist 64.

Further, though not shown, a nickel sheet 65 having a thickness of about 25 μm was fixedly disposed by thermal press-bonding to form a lid for the ink supply passages 87 basically as with the step shown in FIG. 23. Any other material, such as a stainless sheet, a silicon substrate, a quartz substrate or a glass substrate, than the nickel sheet are also usable so long as it exhibits a similar function. An end of the nickel sheet 65 on the same side as the heater 45 was located in a position further receded 100 μm from the end of the sheet resist 64. In such a manner, the tunnel-shaped ink supply passages 87 each having a width equal to the heater interval and a height of about 25 μm are formed, and ink is supplied to the transfer section in a proper amount based on a capillary phenomenon.

Thus the head chip is completed by forming, on a silicon substrate, heaters, wiring conductors, ink accommodating portions, and branch ink passages as a unitary structure corresponding to vaporizing (transfer) sections, and cutting the substrate into a predetermined size.

Printer Head Assembling Process

As shown in FIGS. 6 to 8, a driver IC 24 for driving the heaters 45 corresponding to image data was mounted on a printed board 26 to form an electric circuit.

The heater chip 22 and the printed board 26 were bonded onto an aluminum head base 23 serving also as a heat sink, as shown in FIG. 8, by using a silicone-base adhesive and an acryl-base adhesive. To evenly bond the head chip 22 to the head base 23 in a fixed area, grooves 21 were formed in the head base 23, allowing an extra adhesive to escape into the grooves 21 when applied.

An area of the head base 23 where the printed board 26 was to be attached was thinned corresponding to a thickness of the printed board 26 and a thickness of the driver IC 24 so that the heat chip 22 and the driver IC 24 mounted on the printed board 26 had their upper surfaces substantially flush with each other. Connections between the electrodes on the heater chip 22 and the driver IC 24 and between the driver IC 24 and the wiring pattern on the printed board 26 were made by wire bonding using gold wires with a diameter of 25 μm. Moreover, a silicone-base coating material JCR 25 was coated and hardened under heating for protecting the driver IC 24 and the bonding wires.

Finally, a cover 29 defining a cavity on the inner side and serving as an ink supply passage (ink tank) was bonded and sealed off with a silicone- or epoxy-base resin so as to cover the driver IC 24 protected by the JCR 25, a part of the printed board 26, and a part of the heater chip 22. The cover 29 had an upper surface partly sloped to avoid the head from contacting a transfer target member when the head was positioned opposite to the transfer target member. Ink 5 was introduced from an ink cartridge (not shown) to the ink supply passage defined inside the cover 29 via a through hole (ink introducing hole) 27 formed in the head base 23. The ink 5 was then supplied to the transfer sections 61, including the heaters 45, based on a capillary phenomenon developed by the wall through the ink supply passages 87 defined by the sheet resist 64 and the nickel sheet 65.

Means for Holding Gap Between Printer Head and Printing Paper

The printer head fabricated as described above can be placed to keep a constant gap between the transfer section and a transfer target member (recording member) 37, as shown in FIG. 8, by holding one end 38 of the head base 23 in contact with the transfer target member 37 at a predetermined angle with respect to the transfer target member 37.

In this Example, the center C' of a heat generating member (heater) in the transfer section was positioned inward 1.85 mm from the end of the head base 23 held in contact with the transfer target member 37. An angle formed between the head base 23 and the transfer target member 37 was maintained at 20° so that the distance between the heater formed on the silicon substrate being 0.4 mm thick and the transfer target member 37 was 100 μm (given the thickness of a adhesive layer between the silicon substrate and the head base being 10 μm). In other words, by selectively determining the distance from the contact point to heater center C' and the angle formed between the transfer target member and the head base to certain values, the gap between the heater and the transfer target member can be set to a desired distance.

In the printer head according to this Example, it is especially important to maintain constant the gap between the transfer section and the transfer target member from the point of obtaining a transferred image with a high resolution. An increase in the flying distance makes the ejected mist more dispersed, thus causing a blur and hence a lowering of resolution.

Further, since the end of the sheet resist 64, which defines the ink supply passages 87 and has a thickness of 25 μm, is located in a position receded 100 μm from the center C' of the heater 45 and the end of the nickel sheet 65 having a thickness of 25 μm is located in a position further receded 100 μm from the end of the sheet resist 64, a gap of 100 μm can be held between the transfer target member 37 and each of the sheet resist 64 and the nickel sheet 65 by placing the head base 23 and the transfer target member 37 in an opposed relation so as to form an angle 20°. In other words, by arranging the ends of the sheet resist 64 and the nickel sheet 65 to be receded from the heater center C' in the direction opposed to the contact position between the head base 23 and the transfer target member 37 such that the ends of the components defining the ink supply passages 87 and placed at higher levels from the substrate surface are located in positions farther away from the heater center depending upon the thicknesses thereof, a proper clearance can be maintained between the transfer target member 37 and the ink supply passages 87, like this Example, when the head and the transfer target member 37 are positioned opposite to each other.

Ink and Printing Paper

As inks (dyes), recording liquids (inks) of three colors, i.e., yellow, magenta and cyan, were prepared by dissolving 10% by weight of solvent yellow 56, disperse red 1, and solvent blue 35 in dibutyl phthlate separately at a temperature of 50° C. When these recording liquids were introduced to ink tanks of respective transfer chips under a temperature of 30° C., the liquids were led to the transfer sections spontaneously following the supply passages. Incidentally, the amounts of pyrolysates (deteriorated matters) resulted when the dyes were heated at the normal pressure and a temperature of 200° C. in air for one hour were below; 5 ppm for solvent yellow 56 (m.p. 96° C., b.p. 395° C.), 25 ppm for disperse red 1 (m.p. 161° C., b.p. 420° C.), and 50 ppm for solvent blue 35 (m.p. 121° C., b.p. 405° C.).

The introduced ink formed the meniscus extending from the top edge of the wall arranged to surround each transfer section, and the thickness of a resulting ink layer was 6 μm at the heater center.

Used as printing paper was Peach Coat (by Nisshinbo Industries Inc.) that has a porous structure including a large number of fine pores ranging from 0.8 μm to 10 μm in the surface and contains a binder resin having good compatibility with both the oil-soluble dyes and the solvents mentioned above.

Arrangement and Transfer Operation of Printer Head

In a color printer having the printer heads described above, an image is transferred, as shown in FIG. 9, by feeding a sheet of printing paper in the longitudinal direction (X-direction) and scanning the head in the transverse direction (Y-direction) perpendicular to the X-direction. The paper feeding in the longitudinal direction and the head scan in the transverse direction are effected alternately. In this printer, the printer heads provided with head chips containing inks of three primary colors, e.g., Y, M and C, additionally including black if necessary, are arranged as serial heads which are supported by a feed shaft 35, comprising a feed screw mechanism, and head carriages 32 to be able to reciprocate in the head scan direction Y perpendicular to the paper feed direction X of a sheet of printing paper 37.

Also, paper feed rollers 39 are disposed to support the sheet of printing paper 37 and is rotated to feed the sheet. The head is connected to a head driving circuit board (not shown), etc. through a flexible harness.

Since a total of 256 heaters are provided in the head of this Example, an image of 256 lines is printed per scan. Accordingly, upon the completion of each scan, the sheet of printing paper is fed a distance corresponding to 256 lines by rotating the paper feed rollers. The printing is started at the timing changed sequentially for each color so that the heads for the respective colors start printing from the predetermined position on the sheet of printing paper. Thus a full color image of 256 lines is printed by one scan.

Driving of Printer Head and Printing

Figure 36:
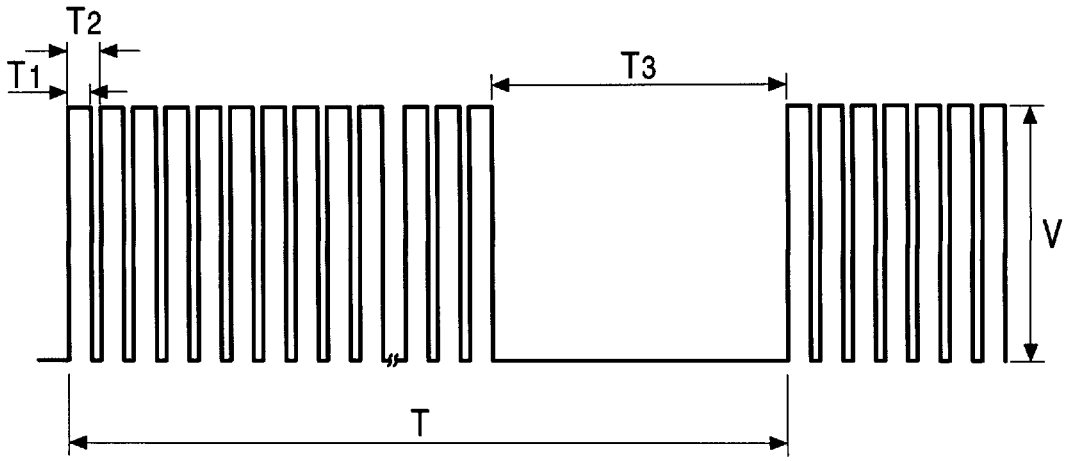
FIG. 36 is a schematic chart showing the waveform of a driving signal applied when the printer head according to Example 1 of the present invention is driven.

Rectangular 50-KHz driving pulses having a duty of 80%, shown in FIG. 36, are applied to each heater of the above-described printer head, thereby cyclically heating the ink in the transfer section. In this Example, maximum 255 pulses were applied to one pixel in accordance with image data. A time (cycle) T necessary for forming one pixel, i.e., the sum of a pulse applying time (255×20 μsec=5.1 msec) and a pause time (interval) $T_3$=0.9 msec for allowing the ink surface to restore sufficiently, was set to 6 msec (167 Hz). In a period of the pulse applying time, each pulse had a duration width $T_1$=16 μsec and a width $T_2$=20 μsec including an interrupt time. An applied voltage V was 20 V.

In a heater driving mode, the ink surface was locally heated to develop a surface tension gradient based on a temperature gradient in a heating area (area near the heater; this is equally applied to "heating area" appearing below), and the ink was moved due to the surface tension gradient from the heating area to a peripheral area (area away from the heater; this is equally applied to "heating area" appearing below). In a heater non-driving mode, the surface tension gradient in the ink surface disappeared, and the ink was moved from the peripheral area to the heating area due to the meniscus restoring force and so on. With such continuous cyclic ink flow, the ink in the transfer section was ejected in the form of a mist having a size of about 0.11 pico-liter at maximum (see FIG. 1). All mists having sizes not smaller than 0.01 pico-liter were forced to fly over a gap of 100 μm and stick onto a sheet of printing paper placed opposite to the head. After sticking onto the sheet of printing paper, the mists were absorbed into the paper and developed the color immediately. During the pause time for each period of time (cycle) necessary for forming one pixel, the temperature gradient disappeared and the ink surface completely restored to the initial state.

Figure 48:
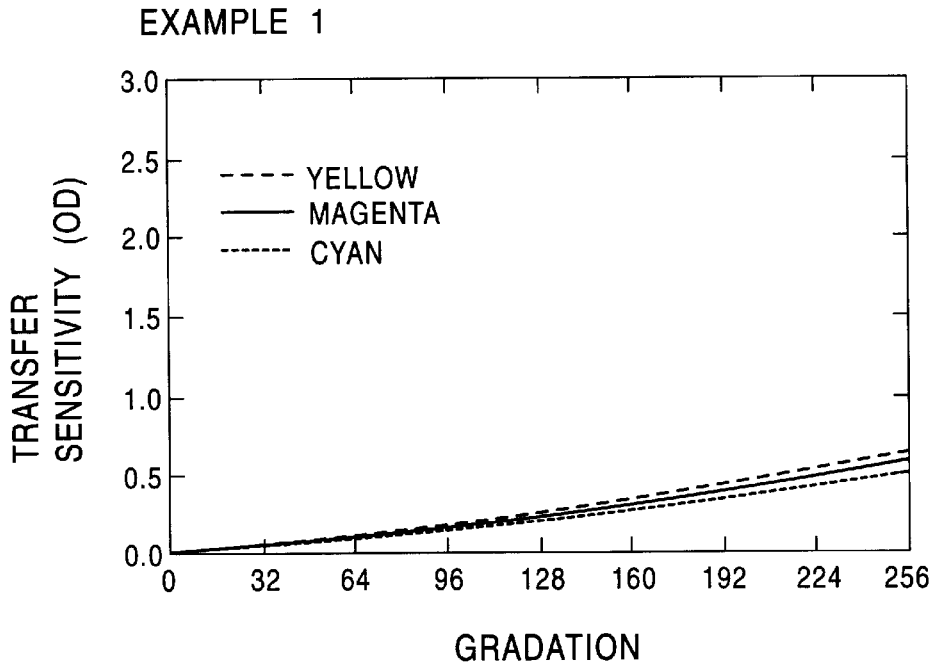
FIG. 48 is a graph showing the relationship between the number of gradation levels and transfer sensitivity in Example 1 of the present invention.

FIG. 48 shows the relationship between the number of gradation levels (the number of pulses applied per pixel) and the reflection density (OD) obtained for this Example from measurement using a Macbeth densitometer. It is seen from FIG. 48 that a half-tone image can be achieved with a gradation of 64 or more levels per pixel. In this Example 1, a minimum time and energy required for obtaining a cyan pixel of OD=2.0 were 20 msec and 200 μJ, respectively. Calculating, based on these values, the energy and time required for transferring a typical natural picture (with average density of 0.5 for each color) of A6 size (about 8 cm×11 cm), the energy and time were 240 J and 106 sec, respectively.

EXAMPLE 2

An image was transferred by using the same printer head, printer construction, ink, printing paper, and driving method as employed in Example 1 except that the heater driving voltage was set to be 1.15 times that used in Example 1. In other words, energy 1.15 times that used in Example 1 was applied to each heater in this Example 2.

As a result, a magnitude of the Marangoni flow was so increased that when the ink flows, a part of the bottom surface of the transfer section was exposed and a gas—solid—liquid line vibrating in synch with the heating cycle appeared. With the ink flow accompanying such vibration of the gas—solid—liquid line, the ink in the transfer section was ejected in the form of a mist having a size of about 0.22 pico-liter at maximum (see FIG. 2). All mists having sizes not smaller than 0.01 pico-liter were forced to fly over a gap of 100 μm and stick onto a sheet of printing paper. After sticking onto the sheet of printing paper, the mists were absorbed into the paper and developed the color immediately. During the pause time for each period of time (cycle) necessary for forming one pixel, the temperature gradient disappeared and the ink surface completely restored to the initial state.

Figure 49:
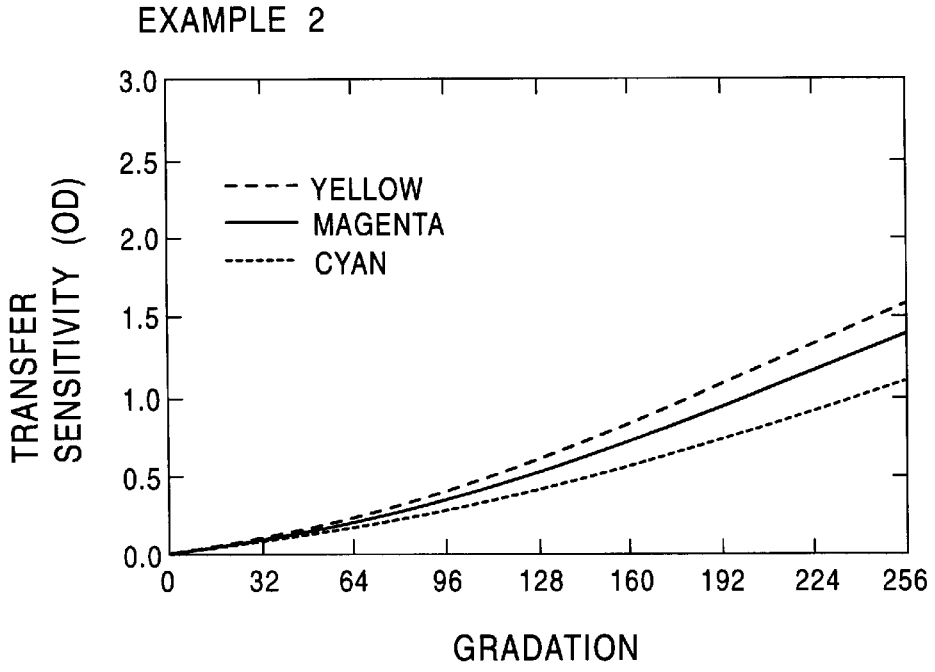
FIG. 49 is a graph showing the relationship between the number of gradation levels and transfer sensitivity in Example 2 of the present invention.

FIG. 49 shows the relationship between the number of gradation levels (the number of pulses applied per pixel) and the reflection density (OD) obtained for this Example from measurement using a Macbeth densitometer. It is seen from FIG. 49 that a half-tone image can be achieved with a gradation of 64 or more levels per pixel. In this Example 2, a minimum time and energy required for obtaining a cyan pixel of OD=2.0 were 9 msec and 100 μJ, respectively. Calculating, based on these values, the energy and time required for transferring a typical natural picture (with average density of 0.5 for each color) of A6 size (about 8 cm×11 cm), the energy and time were 240 J and 106 sec, respectively.

EXAMPLE 3

In wall forming steps (see FIGS. 32 to 34) during a similar heater chip manufacturing process as implemented in Example 1, columnar members were formed as concave/convex structures at the same time as forming the wall.

First, similarly to the step shown in FIG. 19, a photoresist was formed on the chromium layer in a pattern of square lattice array comprising circles arranged around each heater 45 with a diameter of 3 μm and a center-to-center distance of 6 μm, and the chromium film was removed in unnecessary areas by an ion milling apparatus to thereby form the metal masks **40*b*** for the columnar members.

Figure 37:
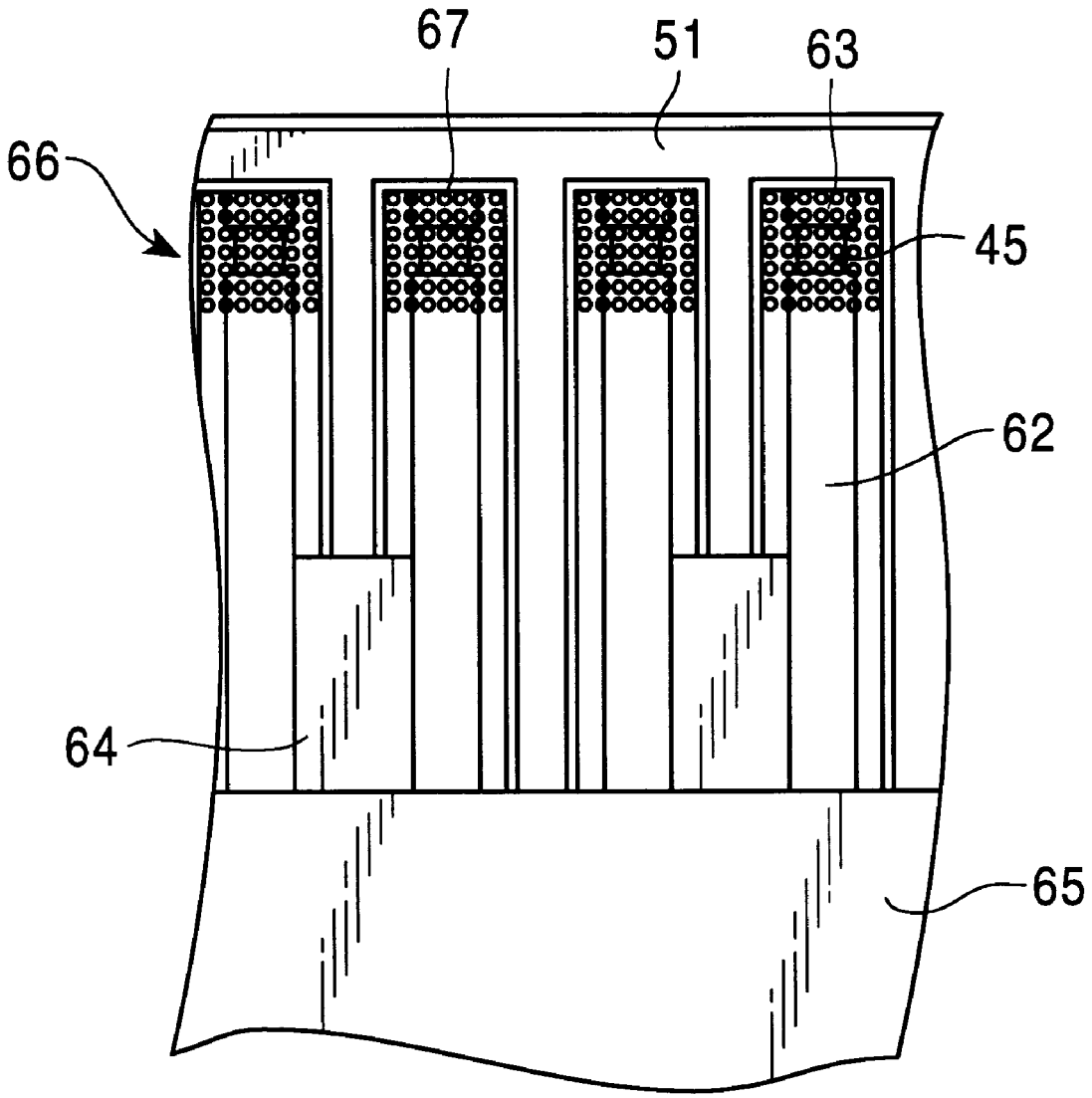
FIG. 37 is a schematic plan view showing the structure of a transfer section and thereabout of a head chip according to Example 3 of the present invention.

Then, as shown in FIGS. 20 and 21, by using, as masks, the chromium films **40*b* formed in a predetermined pattern, the $SiO_2$ layer 47 was etched by the RIE process to form the wall 51 and the columnar members 52 having a height of about 8 μm. The columnar members were formed as an array comprising at least 7×7 columns for each heater. As a result, as shown in FIGS. 37 and 21, a heater chip including a group of columnar members (concave/convex structures) 67, each having a circular section with a diameter of 3 μm and a height of 8 μm, was fabricated, the columnar members being arranged around each heater in a square lattice array with a center-to-center distance of 6 μm between the adjacent columnar members. With the above manufacturing process, the columnar members 67 have the same height as the wall 51 in a transfer section 66. Stated otherwise, the printer head of this Example has the same structure of the transfer section and thereabout as that in Example 1 except the provision of the columnar members 67**.

A certain image was transferred by using the printer head incorporating the above heater chip mounted therein (see FIG. 37), and the same printer construction, ink, printing paper and driving method as employed in Example 1 except that the heater driving voltage was set to be 1.2 times that used in Example 1. In other words, energy 1.2 times that used in Example 1 was applied to each heater in this Example 3.

In a heater driving mode, the ink surface was locally heated to develop a surface tension gradient based on a temperature gradient in the heating area, and the ink was moved from the heating area to the peripheral area due to the surface tension gradient. In a heater non-driving mode, the surface tension gradient in the ink surface disappeared, and the ink was moved from the peripheral area to the heating area due to the meniscus restoring force and the capillary attraction developed by the columnar members (see FIG. 1). The thickness of a ink layer was 7.5 $\mu$m at the heater center. Also, the contact angle between the ink and the bottom surface of the transfer section was 16 degrees.

With such ink flow causing collision against the wall surface, collision against the group of columnar members, and collision between ink traveling waves, the ink in the transfer section 66 was ejected in the form of a mist having a size of about 0.15 pico-liter at maximum. All mists having sizes not smaller than 0.01 pico-liter were forced to fly over a gap of 100 $\mu$m and stick onto a sheet of printing paper. After sticking onto the sheet of printing paper, the mists were absorbed into the paper and developed the color immediately. During the pause time for each period of time (cycle) necessary for forming one pixel, the temperature gradient disappeared and the ink surface completely restored to the initial state.

Figure 50:
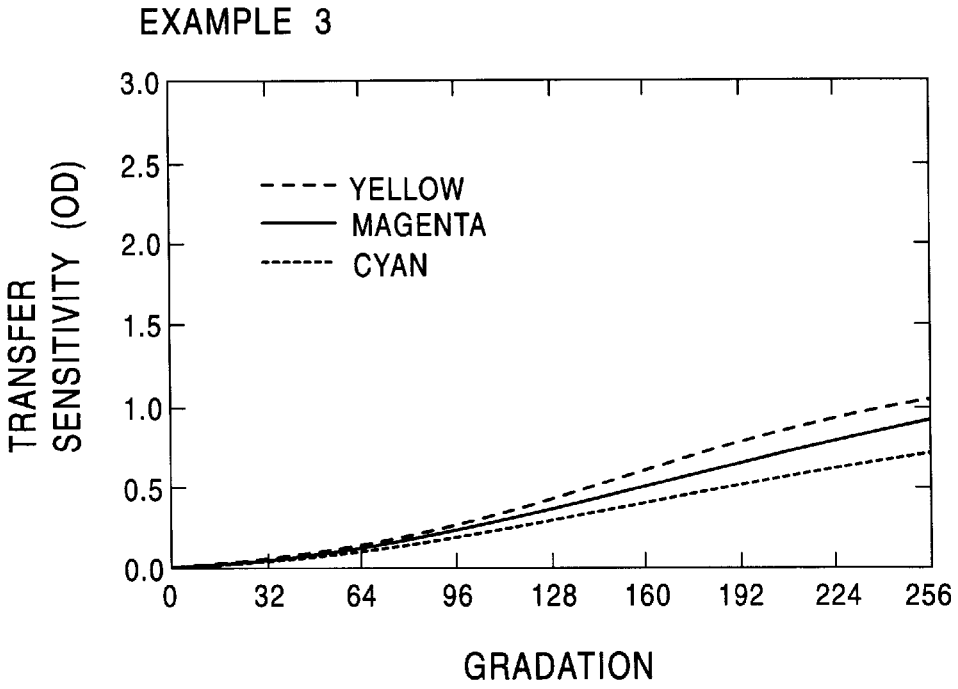
FIG. 50 is a graph showing the relationship between the number of gradation levels and transfer sensitivity in Example 3 of the present invention.

FIG. 50 shows the relationship between the number of gradation levels (the number of pulses applied per pixel) and the reflection density (OD) obtained for this Example from measurement using a Macbeth densitometer. It is seen from FIG. 50 that a half-tone image can be achieved with a gradation of 64 or more levels per pixel. In this Example 3, a minimum time and energy required for obtaining a cyan pixel of OD=2.0 were 13 msec and 160 $\mu$J, respectively. Calculating, based on these values, the energy and time required for transferring a typical natural picture (with average density of 0.5 for each color) of A6 size (about 8 cm×11 cm), the energy and time were 270 J and 69 sec, respectively.

EXAMPLE 4

A certain image was transferred by using the same printer head as obtained in Example 3, and the same printer construction, ink, printing paper and driving method as employed in Example 1 except that the heater driving voltage was set to be 1.4 times that used in Example 1. In other words, energy 1.4 times that used in Example 1 was applied to each heater in this Example 4.

As a result, a magnitude of the Marangoni flow was so increased as compared with Example 3 that when the ink flows, a part of the bottom surface of the transfer section was exposed and a gas—solid—liquid line vibrating in synch with the heating cycle appeared. Also, during cooling (the pause time $T_2$ in the applied pulse signal), the exposed bottom surface of the transfer section was covered by the ink (see FIG. 2).

With the ink flow causing collision against the wall surface, collision against the group of columnar members, and collision between ink traveling waves, while accompanying generation and extinction of the gas—solid—liquid line, the ink in the transfer section was ejected in the form of a mist having a size of about 0.15 pico-liter at maximum. All mists having sizes not smaller than 0.01 pico-liter were forced to fly over a gap of 100 $\mu$m and stick onto a sheet of printing paper. After sticking onto the sheet of printing paper, the mists were absorbed into the paper and developed the color immediately. During the pause time for each period of time (cycle) necessary for forming one pixel, the temperature gradient disappeared and the ink surface completely restored to the initial state.

Figure 51:
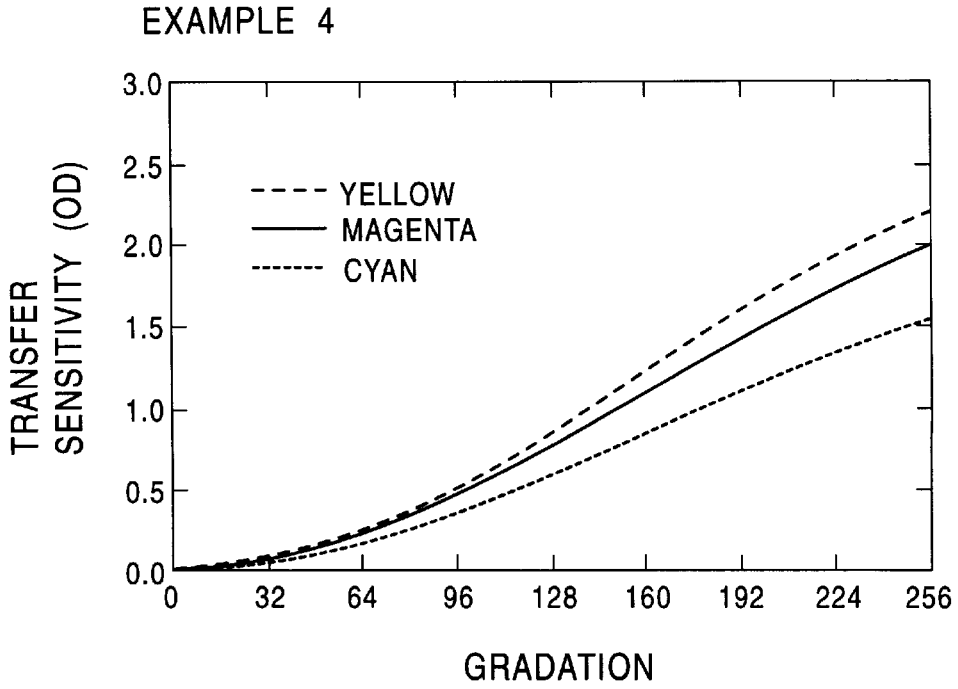
FIG. 51 is a graph showing the relationship between the number of gradation levels and transfer sensitivity in Example 4 of the present invention.

FIG. 51 shows the relationship between the number of gradation levels (the number of pulses applied per pixel) and the reflection density (OD) obtained for this Example from measurement using a Macbeth densitometer. It is seen from FIG. 51 that a half-tone image can be achieved with a gradation of 64 or more levels per pixel. In this Example 4, a minimum time and energy required for obtaining a cyan pixel of OD=2.0 were 6 msec and 84 $\mu$J, respectively. Calculating, based on these values, the energy and time required for transferring a typical natural picture (with average density of 0.5 for each color) of A6 size (about 8 cm×11 cm), the energy and time were 140 J and 31 sec, respectively.

EXAMPLE 5

A certain image was transferred by using the same printer head as obtained in Example 3, and the same printer construction, ink, printing paper and driving method as employed in Example 1 except that the heater driving voltage was set to be 1.5 times that used in Example 1. In other words, energy 1.5 times that used in Example 1 was applied to each heater in this Example 5.

As a result, a magnitude of the Marangoni flow was so increased as compared with Example 4 that when the ink flows, a part of the bottom surface of the transfer section was exposed and a gas—solid—liquid line vibrating in synch with the heating cycle appeared. In addition, during cooling (the pause time $T_2$ in the applied pulse signal), the exposed bottom surface of the transfer section was not completely covered by the ink and still remained exposed partly.

With the ink flow causing collision against the wall surface, collision against the group of columnar members, and collision between ink traveling waves, while accompanying forward and backward movement of the gas—solid—liquid line, the ink in the transfer section was ejected in the form of a mist having a size of about 0.15 pico-liter at maximum. All mists having sizes not smaller than 0.01 pico-liter were forced to fly over a gap of 100 $\mu$m and stick onto a sheet of printing paper. After sticking onto the sheet of printing paper, the mists were absorbed into the paper and developed the color immediately. During the pause time for each period of time (cycle) necessary for forming one pixel, the temperature gradient disappeared and the ink surface completely restored to the initial state.

Figure 52:
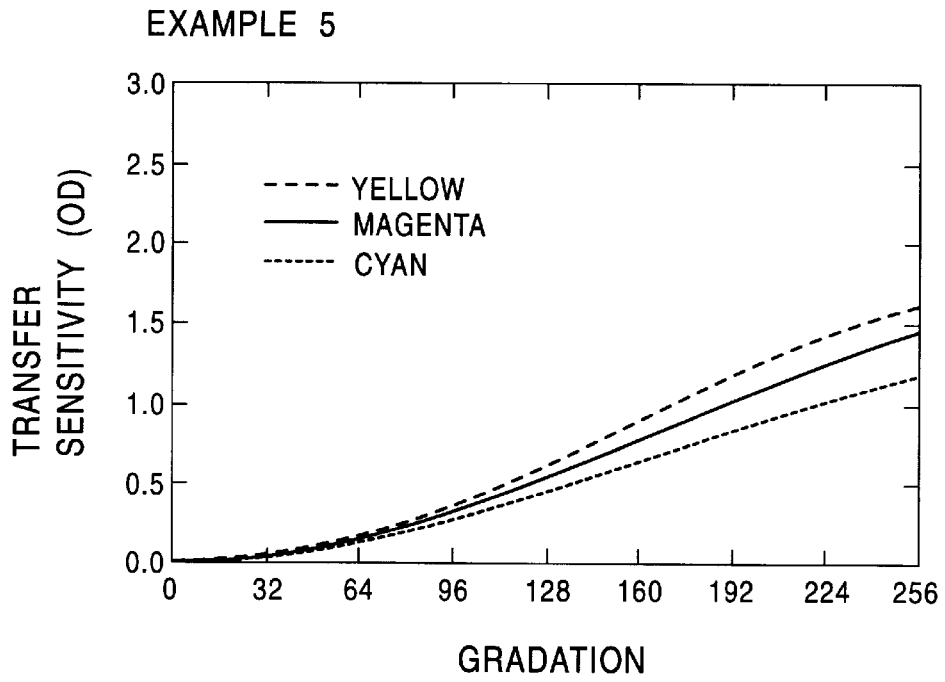
FIG. 52 is a graph showing the relationship between the number of gradation levels and transfer sensitivity in Example 5 of the present invention.

FIG. 52 shows the relationship between the number of gradation levels (the number of pulses applied per pixel) and the reflection density (OD) obtained for this Example from measurement using a Macbeth densitometer. It is seen from FIG. 52 that a half-tone image can be achieved with a gradation of 64 or more levels per pixel. In this Example 5, a minimum time and energy required for obtaining a cyan pixel of OD=2.0 were 8 msec and 120 $\mu$J, respectively. Calculating, based on these values, the energy and time required for transferring a typical natural picture (with average density of 0.5 for each color) of A6 size (about 8 cm×11 cm), the energy and time were 200 J and 42 sec, respectively.

EXAMPLE 6

Figure 38:
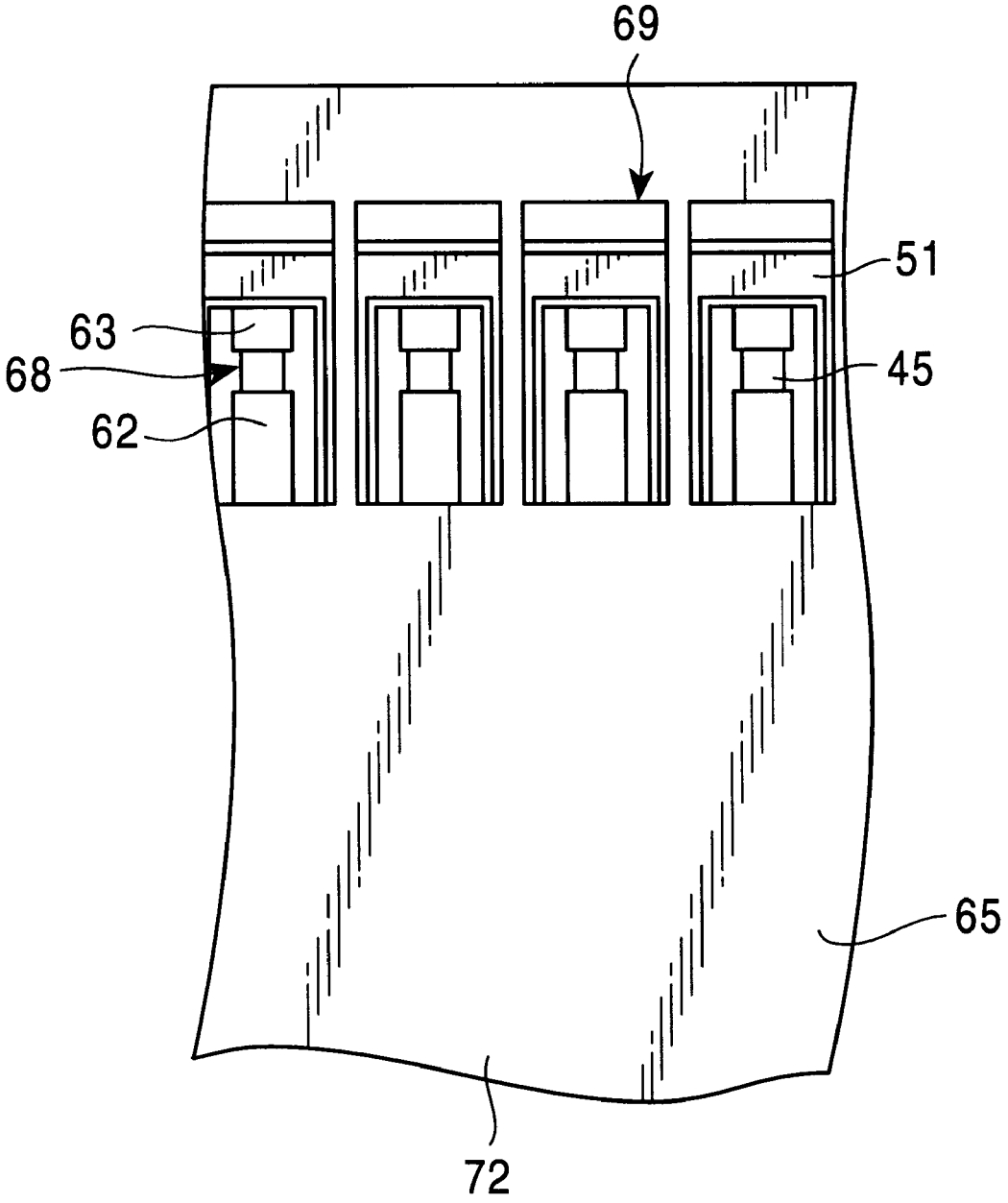
FIG. 38 is a schematic plan view showing the structure of a transfer section and thereabout of a head chip according to Example 6 of the present invention.

In ink passage forming steps (see FIGS. 22 and 23) during a similar heater chip manufacturing process as implemented in Example 1, after providing a heat resist as with the heater chip in Example 1, a nickel sheet 65 having rectangular openings 69 of 75×200 μm formed therein with a pitch of 84.7 μm was, as shown in FIG. 38, fixedly disposed by thermal press-bonding such that the center of each opening 69 was aligned with the heater center, the nickel sheet 65 serving as a lid 72 to hold ink in place.

In this Example, the thickness of the sheet resist was 20 μm, but was reduced 2 μm by shrinkage during the thermal press-bonding. Therefore, the gap between the underside of the nickel sheet 65 and the bottom surface of a transfer section 68, i.e., the dimension of an ink supply passage, was 18 μm. A side surface (peripheral edge) of each opening 69 in the nickel sheet 65 was treated to be repellant to the ink. Accordingly, when the ink was introduced to the printer head of this Example, the ink was stopped at a line where the underside of the nickel sheet 65 joined with the opening 69 in the nickel sheet 65, thus forming the meniscus extending from the line. The thickness of an ink layer was 15 μm at the heater center.

A certain image was transferred by using the printer head incorporating the above heater chip mounted therein, and the same printer construction, ink, printing paper and driving method as employed in Example 1 except that the heater driving voltage was set to be 1.6 times that used in Example 1. In other words, energy 1.6 times that used in Example 1 was applied to each heater in this Example 6.

In a heater driving mode, the ink surface was locally heated to develop a surface tension gradient based on a temperature gradient in the heating area, and the ink was moved from the heating area to the peripheral area due to the surface tension gradient. With the ink flow, a part of the bottom surface of the transfer section was exposed and a gas—solid—liquid line was formed. In a heater non-driving mode, the surface tension gradient in the ink surface disappeared, the ink was moved from the peripheral area to the heating area due to the meniscus restoring force, and the exposed bottom surface of the transfer section was covered by the ink.

With such ink flow causing collision against the edge of the opening and collision between ink traveling waves, while accompanying generation and extinction of the gas—solid—liquid line, the ink in the transfer section 68 was ejected in the form of a mist having a size of about 0.15 pico-liter at maximum. All mists having sizes not smaller than 0.01 pico-liter were forced to fly over a gap of 100 μm and stick onto a sheet of printing paper. After sticking onto the sheet of printing paper, the mists were absorbed into the paper and developed the color immediately. During the pause time for each period of time (cycle) necessary for forming one pixel, the temperature gradient disappeared and the ink surface completely restored to the initial state.

Figure 53:
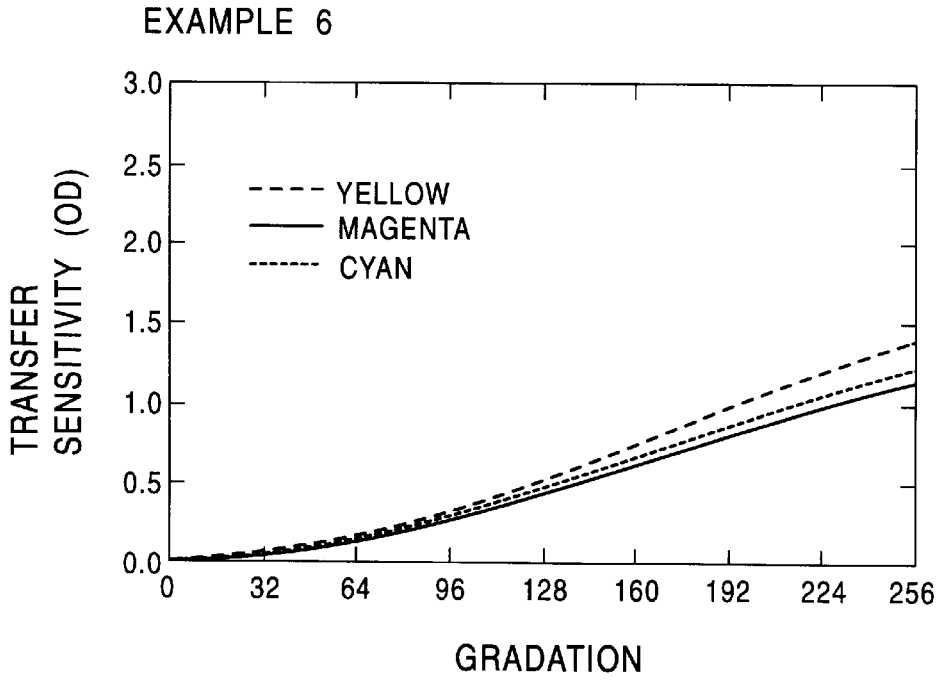
FIG. 53 is a graph showing the relationship between the number of gradation levels and transfer sensitivity in Example 6 of the present invention.

FIG. 53 shows the relation ship between the number of gradation levels (the number of pulses applied per pixel) and the reflection density (OD) obtained for this Example from measurement using a Macbeth densitometer. It is seen from FIG. 53 that a half-tone image can be achieved with a gradation of 64 or more levels per pixel. In this Example 6, a minimum time and energy required for obtaining a cyan pixel of OD=2.0 were 9 msec and 150 μJ, respectively. Calculating, based on these values, the energy and time required for transferring a typical natural picture (with average density of 0.5 for each color) of A6 size (about 8 cm×11 cm), the energy and time were 250 J and 48 sec, respectively.

EXAMPLE 7

In wall forming process (see FIGS. 32 to 34) during a similar heater chip manufacturing process as implemented in Example 1, as with Example 3, a photoresist was formed on the chromium layer in a pattern of square lattice array comprising circles arranged around each heater with a diameter of 3 μm and a center-to-center distance of 6 μm, and the chromium film was removed in unnecessary areas by an ion milling apparatus to thereby form metal masks for columnar members.

Then, by using, as masks, the chromium films formed in a predetermined pattern, the $SiO_2$ layer was etched by the RIE process to form a wall 51 and columnar members 67 all having a height of about 8 μm. The columnar members were formed as an array comprising at least 7×7 columns for each heater. As a result, a heater chip including a group of columnar members, each having a circular section with a diameter of 3 μm and a height of 8 μm, was fabricated, the columnar members being arranged around each heater in a square lattice array with a center-to-center distance of 6 μm between the adjacent columnar members.

Figure 39:
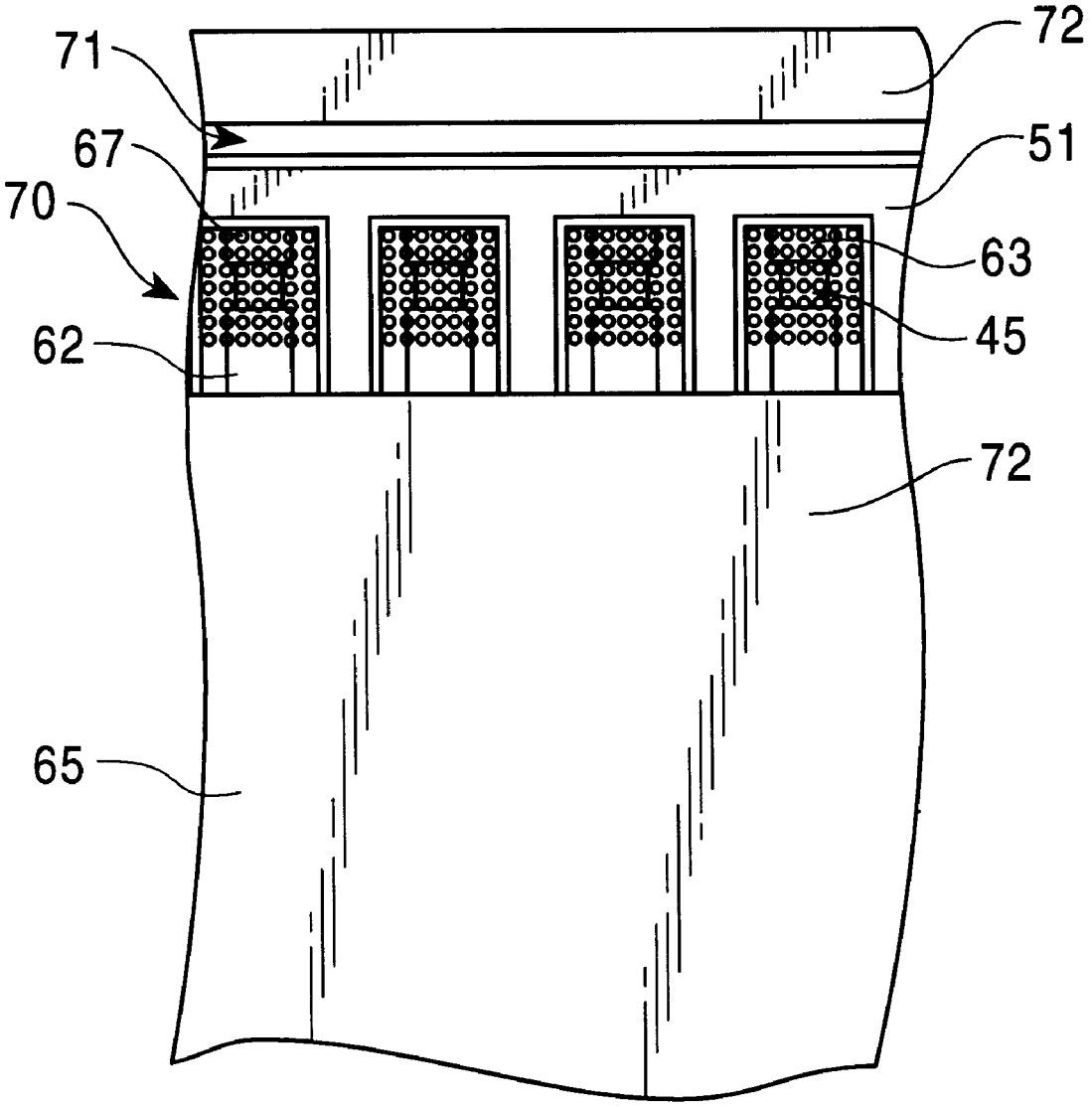
FIG. 39 is a schematic plan view showing the structure of a transfer section and thereabout of a head chip according to Example 7 of the present invention.

Further, in ink passage forming steps (see FIGS. 22 and 23) during the similar process of manufacturing the heater chip as implemented in Example 1, a heat resist was placed on the heater chip surface, and a nickel sheet 65 having a slit formed therein with a width of 300 μm was fixedly disposed by thermal press-bonding such that the center of the slit 71 was aligned with the center of the heater 45. A printer head having such a structure of a transfer section 70 and thereabout as shown in FIG. 39 was thus fabricated.

In this Example, the thickness of the sheet resist was 20 μm, but was reduced 2 μm by shrinkage during the thermal press-bonding. Therefore, the gap between the underside of the nickel sheet 65 and a bottom surface of the transfer section 70, i.e., the dimension of an ink supply passage, was 18 μm. A side surface (peripheral edge) of the opening (slit 71) in the nickel sheet 65 was treated to be repellant to the ink. Accordingly, when the ink was introduced to the printer head of this Example, the ink was stopped at a line where the underside of the nickel sheet 65 joined with the opening in the nickel sheet 65, thus forming the meniscus extending from the line to the tops of the columnar members 67. The thickness of an ink layer was 6 μm at the heater center.

A certain image was transferred by using the printer head incorporating the above heater chip mounted therein, and the same printer construction, ink, printing paper and driving method as employed in Example 1 except that the heater driving voltage was set to be 1.6 times that used in Example 1. In other words, energy 1.6 times that used in Example 1 was applied to each heater in this Example 7.

With a similar transfer mechanism as that described in connection with Example 4, the ink in the transfer section 70 was ejected in the form of a mist having a size of about 0.15 pico-liter at maximum. All mists having sizes not smaller than 0.01 pico-liter were forced to fly over a gap of 100 μm and stick onto a sheet of printing paper. After sticking onto the sheet of printing paper, the mists were absorbed into the paper and developed the color immediately.

Figure 54:
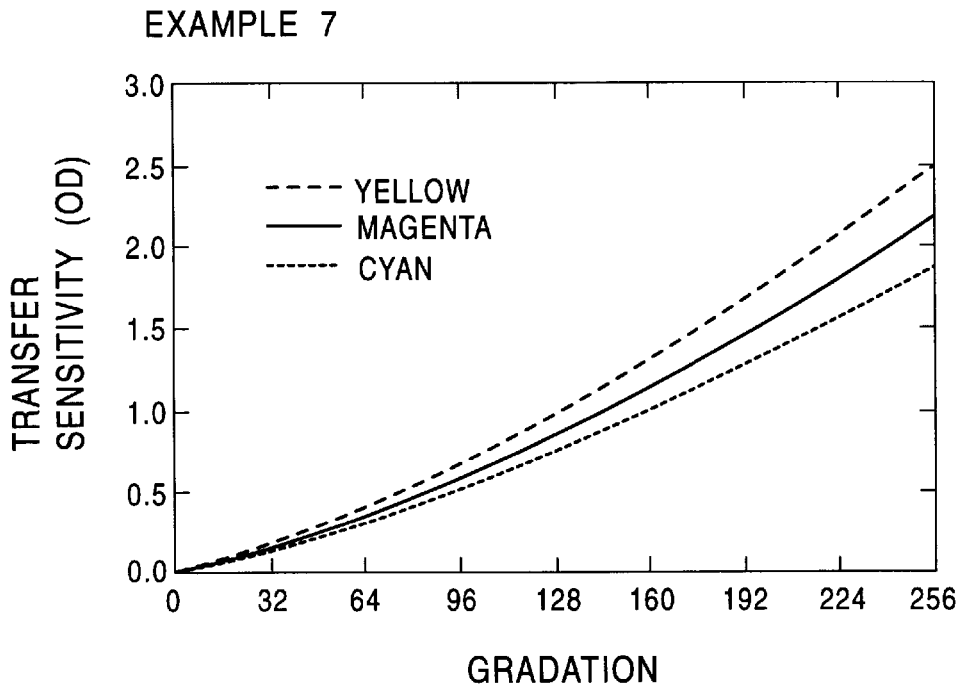
FIG. 54 is a graph showing the relationship between the number of gradation levels and transfer sensitivity in Example 7 of the present invention.

FIG. 54 shows the relationship between the number of gradation levels (the number of pulses applied per pixel) and the reflection density (OD) obtained for this Example from measurement using a Macbeth densitometer. It is seen from FIG. 54 that a half-tone image can be achieved with a gradation of 64 or more levels per pixel. In this Example 7, a minimum time and energy required for obtaining a cyan pixel of OD=2.0 were 6 msec and 87 μJ, respectively.

Calculating, based on these values, the energy and time required for transferring a typical natural picture (with average density of 0.5 for each color) of A6 size (about 8 cm×11 cm), the energy and time were 150 J and 28 sec, respectively.

EXAMPLE 8

In wall forming process (see FIGS. 32 to 34) during a similar heater chip manufacturing process as implemented in Example 1, as with Example 3, a photoresist was formed on the chromium layer in a pattern of square lattice array comprising circles arranged around each heater with a diameter of 3 μm and a center-to-center distance of 6 μm, and the chromium film was removed in unnecessary areas by an ion milling apparatus to thereby form metal masks for columnar members. At this time, the wall was not formed, but the columnar members were formed in a continuous pattern to cover even spaces between the adjacent heaters.

Figure 40:
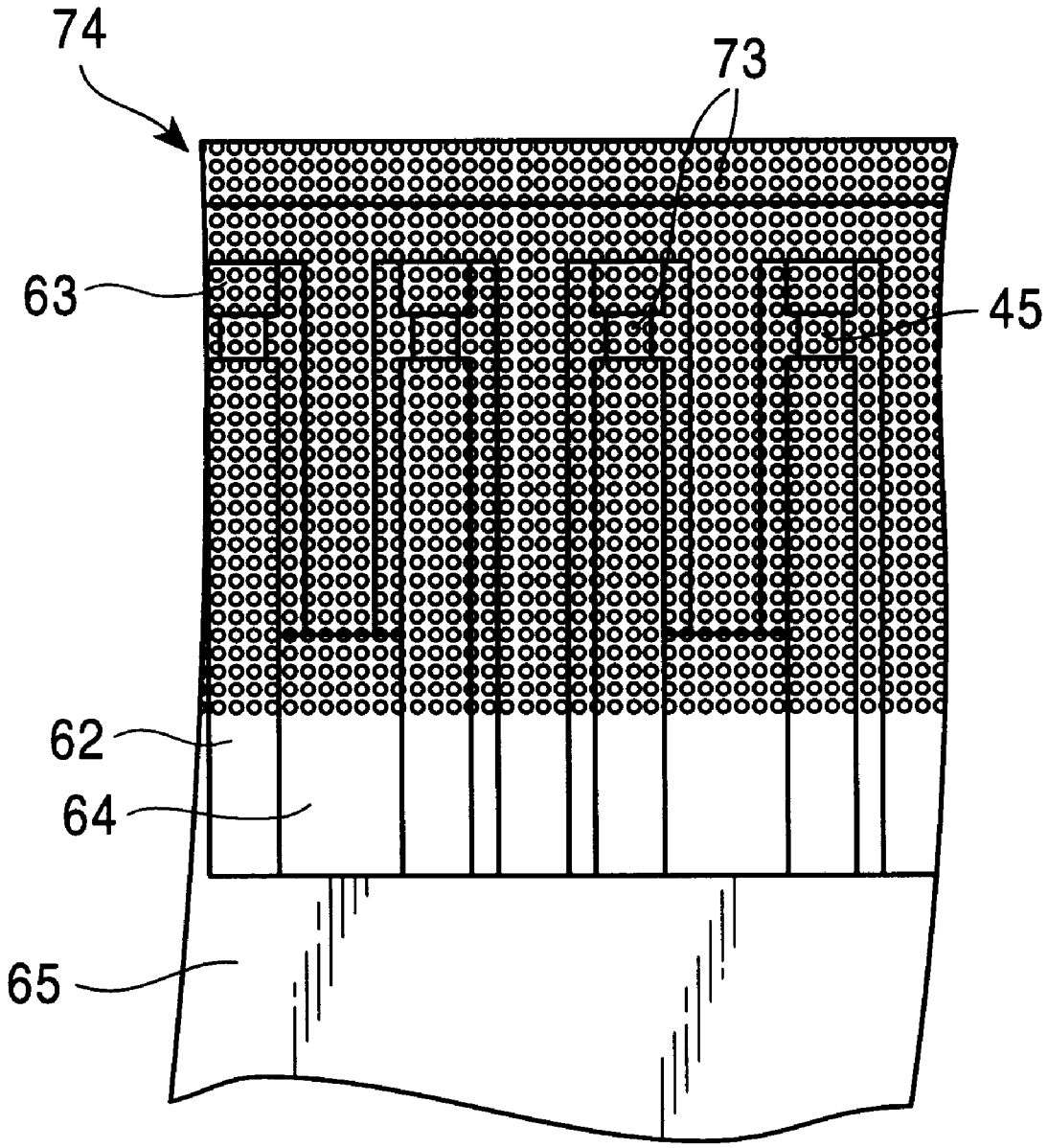
FIG. 40 is a schematic plan view showing the structure of a transfer section and thereabout of a head chip according to Example 8 of the present invention.

Then, by using, as masks, the chromium films formed in a predetermined pattern, the $SiO_2$ layer was etched by the RIE process to form columnar members 73 each having a height of about 8 μm. As a result, a heater chip including a group of columnar members 73, each having a circular section with a diameter of 3 μm and a height of 8 μm, was fabricated, the columnar members being in a square lattice array with a center-to-center distance of 6 μm between the adjacent columnar members. A printer head having such a structure of a transfer section 74 and thereabout as shown in FIG. 40 was thereby obtained.

A certain image was transferred by using the printer head incorporating the above heater chip mounted therein, and the same printer construction, ink, printing paper and driving method as employed in Example 1 except that the heater driving voltage was set to be 1.4 times that used in Example 1. In other words, energy 1.4 times that used in Example 1 was applied to each heater in this Example 8.

With a similar transfer mechanism as that described in connection with Example 4, the ink in the transfer section 74 was ejected in the form of a mist having a size of about 0.15 pico-liter at maximum. All mists having sizes not smaller than 0.01 pico-liter were forced to fly over a gap of 100 μm and stick onto a sheet of printing paper. After sticking onto the sheet of printing paper, the mists were absorbed into the paper and developed the color immediately.

Figure 55:
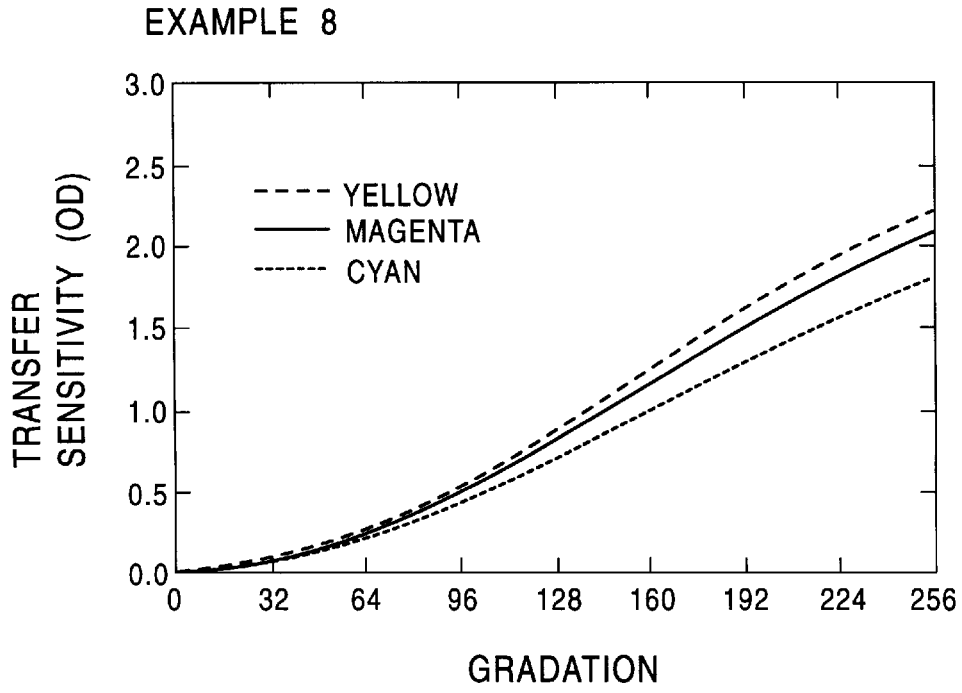
FIG. 55 is a graph showing the relationship between the number of gradation levels and transfer sensitivity in Example 8 of the present invention.

FIG. 55 shows the relationship between the number of gradation levels (the number of pulses applied per pixel) and the reflection density (OD) obtained for this Example from measurement using a Macbeth densitometer. It is seen from FIG. 55 that a half-tone image can be achieved with a gradation of 64 or more levels per pixel. In this Example 8, a minimum time and energy required for obtaining a cyan pixel of OD=2.0 were 6 msec and 80 μJ, respectively. Calculating, based on these values, the energy and time required for transferring a typical natural picture (with average density of 0.5 for each color) of A6 size (about 8 cm×11 cm), the energy and time were 130 J and 30 sec, respectively.

EXAMPLE 9

In a similar heater (head) chip manufacturing process as implemented in Example 1, a substrate was formed of quartz glass, and the steps of forming the heaters, the aluminum electrodes and the $SiO_2$ layer (see FIGS. 1 to 17) were omitted. Then, in a similar manner as described in Example 3, a head chip was fabricated (not shown) which had a wall and a group of columnar members, each having a circular section with a diameter of 3 μm and a height of 8 μm, the columnar members being arranged around each transfer section in a square lattice array with a center-to-center distance of 6 μm between the adjacent columnar members. Ink supply passages were formed similarly to those in Example 1 by using a sheet resist and a nickel sheet. The transfer section in this head chip was transparent because the chip was totally made of quartz glass except the metals masks for the wall and the columnar members.

The head chip was mounted to a base plate made of Pyrex (thermal conductivity: 1.1 W/m.k) in place of the aluminum base plate shown in FIG. 6, thereby fabricating a printer head.

Ink used here was prepared by adding 0.1% by weight of a naphthalocyanine-base dye TS-1 (by Mitsui Chemicals Co., Ltd.), having a maximum absorption wavelength of 790 nm, to the same basic components as used in Example 1. This naphthalocyanine-base dye is one kind of opto-thermic transducing material.

Using the above printer head and a similar sheet of printing paper as used in Example 1, a semiconductor laser was driven with similar pulses, shown in FIG. 36, as used in Example 1 to emit a laser beam having a half value of 780 nm, and the laser beam was irradiated to the ink from the back side of the chip while being condensed by a lens into an elliptic spot of 10×20 μm in the ink surface.

In a laser driving mode, the ink surface was locally heated to develop a surface tension gradient based on a temperature gradient in an area near the irradiated laser beam spot (i.e., a heating area), and the ink was moved from the heating area to an area away from the irradiated laser beam spot (i.e., a peripheral area) due to the surface tension gradient. With the ink flow, a part of the bottom surface of the transfer section was exposed and a gas—solid—liquid line was formed. In a laser non-driving mode, the surface tension gradient in the ink surface disappeared, the ink was moved from the peripheral area to the heating area due to the meniscus restoring force, and the exposed bottom surface of the transfer section was covered by the ink.

With such ink flow causing collision against the edge of the opening, collision against the columnar member, and collision between ink traveling waves, while accompanying generation and extinction of the gas—solid—liquid line, the ink in the transfer section was ejected in the form of a mist having a size of about 0.15 pico-liter at maximum. All mists having sizes not smaller than 0.01 pico-liter were forced to fly over a gap of 100 μm and stick onto a sheet of printing paper. After sticking onto the sheet of printing paper, the mists were absorbed into the paper and developed the color immediately. Since the naphthalocyanine-base dye is almost colorless in the visible range, contamination of the sheet of printing paper was not observed. During the pause time for each period of time (cycle) necessary for forming one pixel, the temperature gradient disappeared and the ink surface completely restored to the initial state.

Figure 56:
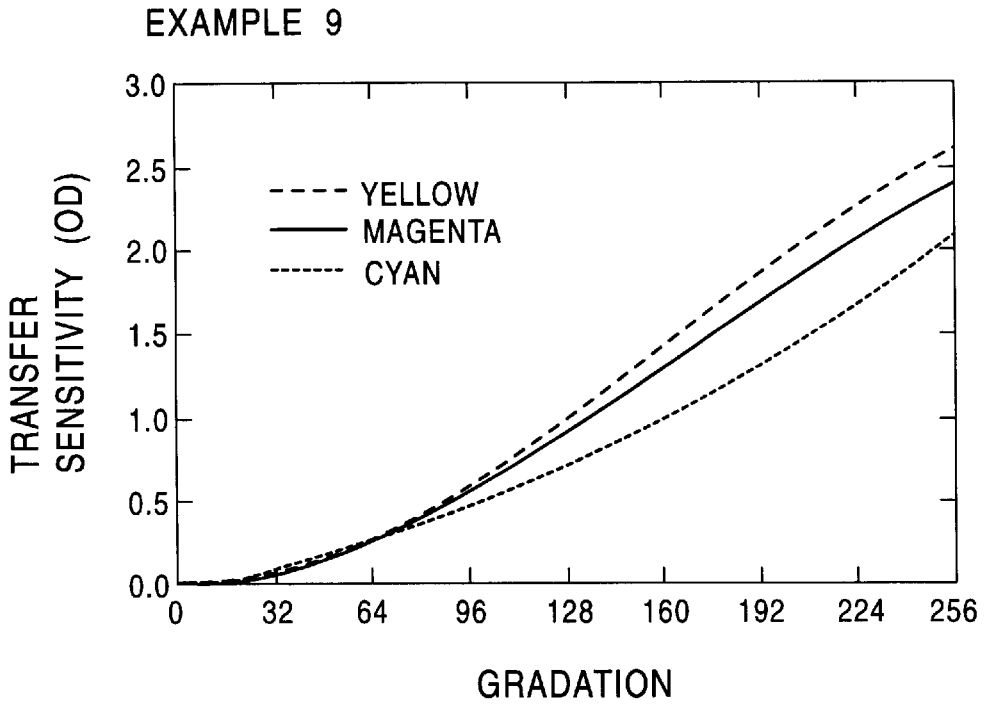
FIG. 56 is a graph showing the relationship between the number of gradation levels and transfer sensitivity in Example 9 of the present invention.

FIG. 56 shows the relationship between the number of gradation levels (the number of pulses applied per pixel) and the reflection density (OD) obtained for this Example from measurement using a Macbeth densitometer. It is seen from FIG. 56 that a half-tone image can be achieved with a gradation of 64 or more levels per pixel. In this Example 9, a minimum time and energy required for obtaining a cyan pixel of OD=2.0 were 5 msec and 50 μJ, respectively. Calculating, based on these values, the energy and time required for transferring a typical natural picture (with average density of 0.5 for each color) of A6 size (about 8 cm×11 cm), the energy and time were 80 J and 26 sec, respectively.

EXAMPLE 10

In a similar heater chip manufacturing process as implemented in Example 1, after forming a group of columnar members and a wall, a two-layer film consisted of silicon nitride and tantalum (i.e., a dielectric two-layer film) was formed as an infrared absorbing layer (opto-thermic transducer) in the transfer section. The two-layer film had absorptivity of 88% for light at a wavelength of 780 nm. The head chip was mounted to a base plate made of Pyrex in place of the aluminum base plate shown in FIG. 6, thereby fabricating a printer head (not shown).

Using the above head and the same ink and sheet of printing paper as used in Example 1, a semiconductor laser was driven with the pulses shown in FIG. 36 to emit a laser beam having a half value of 780 nm, and the laser beam was irradiated to the ink from the back side of the chip while being condensed by a lens into an elliptic spot of 10×20 μm in the ink surface.

With a similar transfer mechanism as that described in connection with Example 9, the ink in the transfer section was ejected in the form of a mist having a size of about 0.15 pico-liter at maximum. All mists having sizes not smaller than 0.01 pico-liter were forced to fly over a gap of 100 μm and stick onto a sheet of printing paper. After sticking onto the sheet of printing paper, the mists were absorbed into the paper and developed the color immediately.

Figure 57:
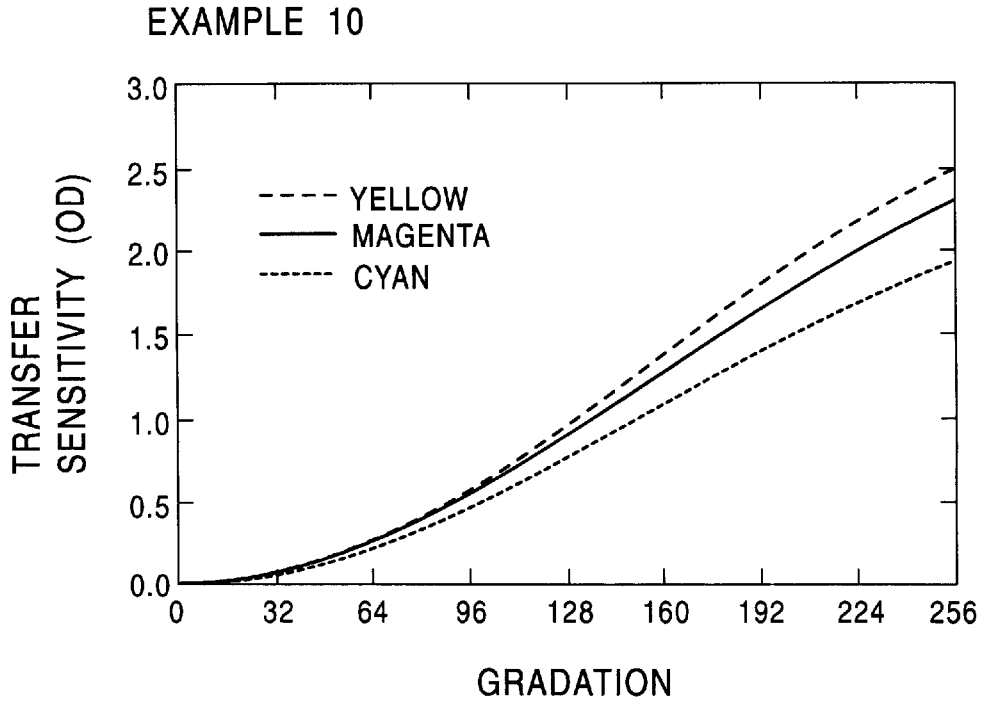
FIG. 57 is a graph showing the relationship between the number of gradation levels and transfer sensitivity in Example 10 of the present invention.

FIG. 57 shows the relationship between the number of gradation levels (the number of pulses applied per pixel) and the reflection density (OD) obtained for this Example from measurement using a Macbeth densitometer. It is seen from FIG. 57 that a half-tone image can be achieved with a gradation of 64 or more levels per pixel. In this Example 10, a minimum time and energy required for obtaining a cyan pixel of OD=2.0 were 5 msec and 52 μJ, respectively. Calculating, based on these values, the energy and time required for transferring a typical natural picture (with average density of 0.5 for each color) of A6 size (about 8 cm×11 cm), the energy and time were 90 J and 27 sec, respectively.

EXAMPLE 11

Figure 41:
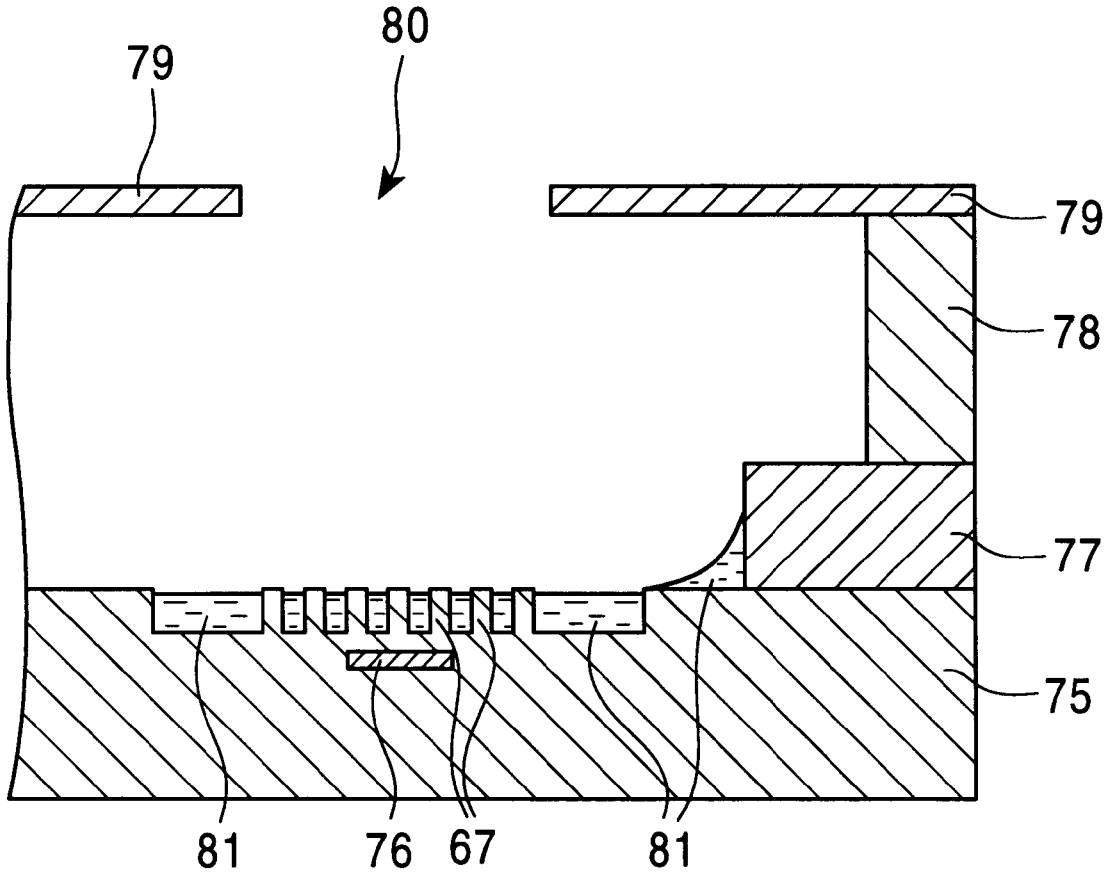
FIG. 41 is a schematic plan view showing the structure of a transfer section and thereabout of a head chip according to Example 11 of the present invention.

In addition to a similar chip construction as in Example 3, as shown in FIG. 41, a Teflon plate 79 being 30 μm thick and having an opening 80 with a diameter of 60 μm was placed through a cover support 78 such that a gap of 100 μm was left between the transfer section surface and the opening 80, and the center of the opening 80 was aligned with the center of a heater 76. Because of Teflon being repellent to ink 81, when the ink 81 was introduced to the printer head of this Example, the ink formed the meniscus with the presence of columnar members 67 and a wall 77. The thickness of an ink layer was 8 μm at the heater center. In this Example, a gap (distance) of 2000 μm was secured between a sheet of printing paper and the transfer section including the heater by arranging a shaft, which fixedly supported a printer head, in a position 2500 μm away above the sheet of printing paper by mechanical means, rather than contacting a part of the printer head with the sheet of printing paper like Example 1.

A certain image was transferred by using the printer head incorporating the above heater chip mounted therein, and the same printer construction, ink, printing paper and driving method as employed in Example 1 except that the heater driving voltage was set to be 1.5 times that used in Example 1. In other words, energy 1.5 times that used in Example 1 was applied to each heater in this Example 11.

With a similar transfer mechanism as that described in connection with Example 4, the ink in the transfer section was ejected in the form of a mist having a size of about 0.15 pico-liter at maximum. All mists having sizes not smaller than 0.05 pico-liter were forced to fly over the gap of 2500 μm and stick onto the sheet of printing paper, whereas ink mists having smaller sizes and ink vapor were all accumulated in a space inside the Teflen cover 79, following by returning to the transfer section eventually. After sticking onto the sheet of printing paper, the mists were absorbed into the paper and developed the color immediately. An area having a half value of the maximum density in the transferred ink dot had a diameter of 105 μm in terms of a perfect circle, and a satisfactory resolution of 300 dpi was attained even with the gap of 2500 μm.

Figure 58:
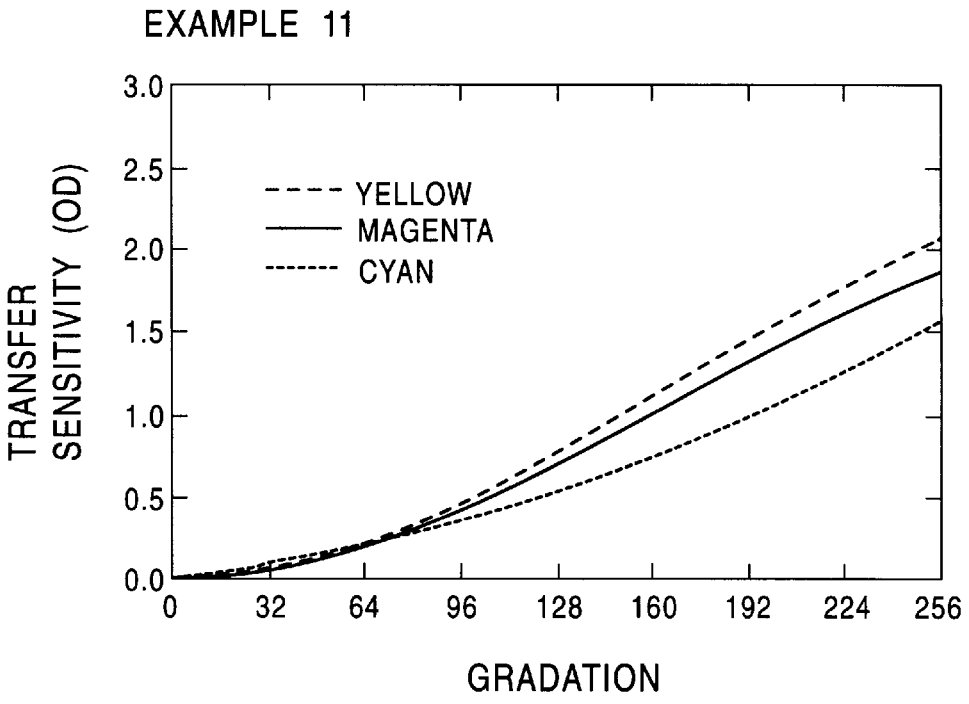
FIG. 58 is a graph showing the relationship between the number of gradation levels and transfer sensitivity in Example 11 of the present invention.

FIG. 58 shows the relationship between the number of gradation levels (the number of pulses applied per pixel) and the reflection density (OD) obtained for this Example from measurement using a Macbeth densitometer. It is seen from FIG. 58 that a half-tone image can be achieved with a gradation of 64 or more levels per pixel. In this Example 11, a minimum time and energy required for obtaining a cyan pixel of OD=2.0 were 6 msec and 95 μJ, respectively. Calculating, based on these values, the energy and time required for transferring a typical natural picture (with average density of 0.5 for each color) of A6 size (about 8 cm×11 cm), the energy and time were 160 J and 33 sec, respectively.

EXAMPLE 12

Figure 42:
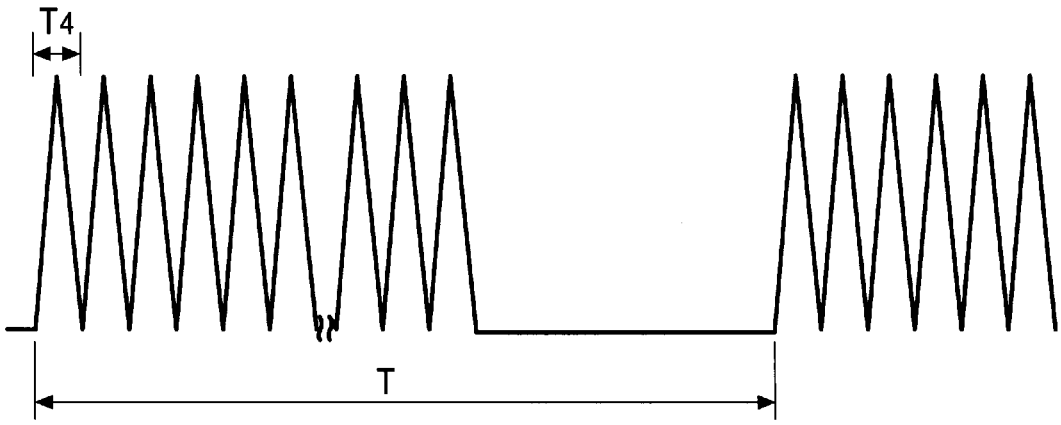
FIG. 42 is a schematic chart showing the waveform of a driving signal applied when a printer head according to Example 12 of the present invention is driven.

A certain image was transferred by using the same printer head as obtained in Example 3, and the same printer construction, ink, and printing paper as employed in Example 1 except the waveform of driving pulses. The ink in the transfer section was cyclically heated with sawtooth 50-KHz pulses having a duty of 90%, as shown in FIG. 42. In this Example, maximum 255 pulses were applied to one pixel in accordance with image data. A time (cycle) T necessary for forming one pixel, i.e., the sum of a pulse applying time (255×20 μsec=5.1 msec) and a pause time (interval) of 0.9 msec for allowing the ink surface to restore sufficiently, was set to 6 msec (167 Hz). Incidentally, a period of each sawtooth pulse was $T_4$=20 μsec as shown.

By driving the heater with the sawtooth pulses, a local temperature rise of the ink surface proceeded more smoothly, and a magnitude of the Marangoni flow caused upon cyclic driving of the heater was increased. As a result, with a similar transfer mechanism as that described in connection with Example 4, the ink in the transfer section was ejected in the form of a mist having a size of about 0.15 pico-liter at maximum. After sticking onto the sheet of printing paper, the mists were absorbed into the paper and developed the color immediately.

Figure 59:
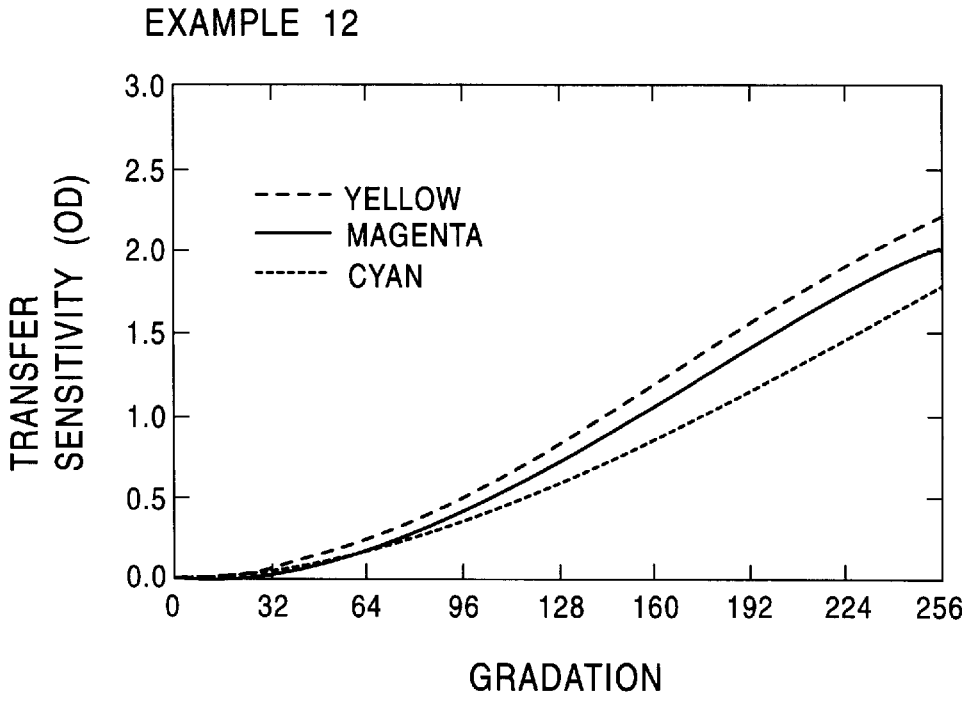
FIG. 59 is a graph showing the relationship between the number of gradation levels and transfer sensitivity in Example 12 of the present invention.

FIG. 59 shows the relationship between the number of gradation levels (the number of pulses applied per pixel) and the reflection density (OD) obtained for this Example from measurement using a Macbeth densitometer. It is seen from FIG. 59 that a half-tone image can be achieved with a gradation of 64 or more levels per pixel. In this Example 12, a minimum time and energy required for obtaining a cyan pixel of OD=2.0 were 6 msec and 86 μJ, respectively. Calculating, based on these values, the energy and time required for transferring a typical natural picture (with average density of 0.5 for each color) of A6 size (about 8 cm×11 cm), the energy and time were 140 J and 306 sec, respectively.

EXAMPLE 13

Figure 43:
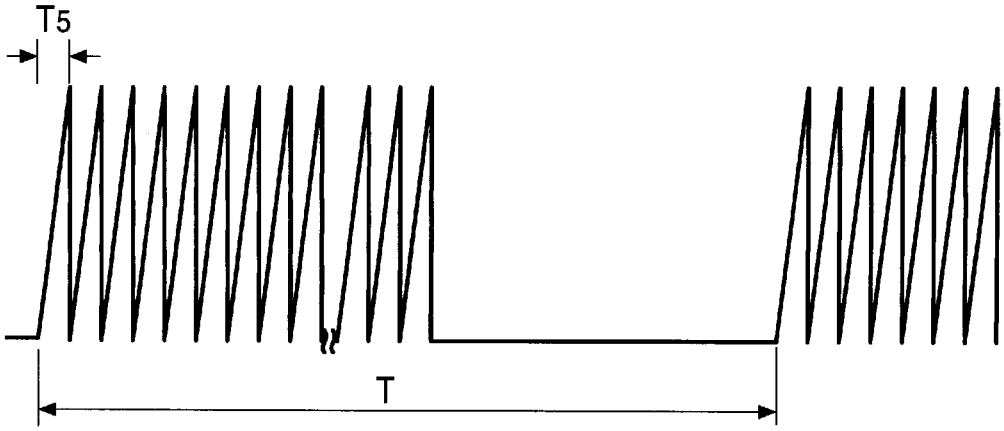
FIG. 43 is a schematic chart showing the waveform of a driving signal applied when a printer head according to Example 13 of the present invention is driven.

A certain image was transferred by using the same printer head as obtained in Example 3, and the same printer construction, ink, and printing paper as employed in Example 1 except the waveform of driving pulses. The ink in the transfer section was cyclically heated with triangular 50-KHz pulses having a duty of 90%, as shown in FIG. 43. In this Example, maximum 255 pulses were applied to one pixel in accordance with image data. A time (cycle) T necessary for forming one pixel, i.e., the sum of a pulse applying time (255×20 μsec=5.1 msec) and a pause time (interval) of 0.9 msec for allowing the ink surface to restore sufficiently, was set to 6 msec (167 Hz). Incidentally, a period of each triangular pulse was $T_5$=20 μsec as shown.

By driving the heater with the triangular pulses, a local temperature rise of the ink surface proceeded more smoothly, and a magnitude of the Marangoni flow caused upon cyclic driving of the heater was increased. As a result, with a similar transfer mechanism as that described in connection with Example 4, the ink in the transfer section was ejected in the form of a mist having a size of about 0.15 pico-liter at maximum. After sticking onto the sheet of printing paper, the mists were absorbed into the paper and developed the color immediately.

Figure 60:
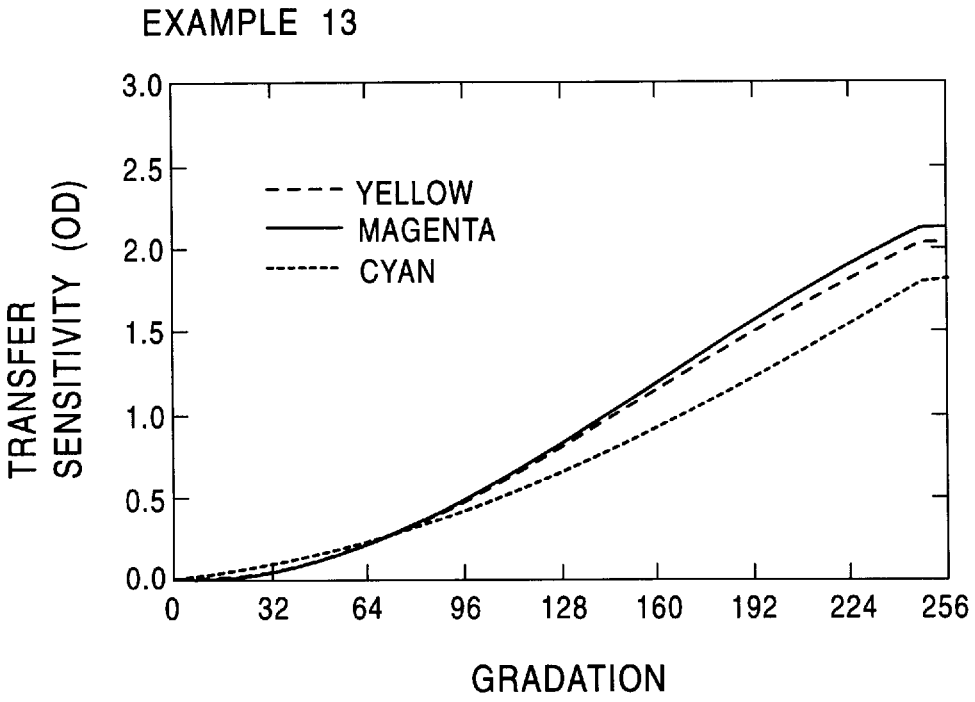
FIG. 60 is a graph showing the relationship between the number of gradation levels and transfer sensitivity in Example 13 of the present invention.

FIG. 60 shows the relationship between the number of gradation levels (the number of pulses applied per pixel) and the reflection density (OD) obtained for this Example from measurement using a Macbeth densitometer. It is seen from FIG. 60 that a half-tone image can be achieved with a gradation of 64 or more levels per pixel. In this Example 13, a minimum time and energy required for obtaining a cyan pixel of OD=2.0 were 6 msec and 86 μJ, respectively. Calculating, based on these values, the energy and time required for transferring a typical natural picture (with average density of 0.5 for each color) of A6 size (about 8 cm×11 cm), the energy and time were 140 J and 28 sec, respectively.

EXAMPLE 14

A certain image was transferred by using the same printer head, printer construction, ink, and printing paper as employed in Example 1 except that the head was driven with a signal having a duty of 100%, i.e., continuously. As a result, the continuous Marangoni flow was not produced in the ink surface and the transfer of the ink was insufficient.

EXAMPLE 15

In a similar heater chip manufacturing process as implemented in Example 1, a wall having a width of 100 μm and a height of 55 μm was formed so as to surround each heater by using a sheet resist having a thickness of 60 μm. A heater chip having exactly the same structure as obtained in Example 1 except the above point was thus fabricated. The thickness of an ink layer was 51 μm at the heater center in an initial state.

Using a printer head incorporating the above heater chip mounted therein, and the same ink and printing paper as employed in Example 1, the driving pulses shown in FIG. 36 were applied to the heater of the printer head to thereby cyclically heat the ink surface. During heating by the heater, a sufficient temperature rise of the ink surface was not obtained because the ink layer held by the sheet resist and the wall was too thick. As a result, the Marangoni flow was hardly produced in the ink surface and the transfer of the ink was insufficient.

EXAMPLE 16

By a similar heater chip manufacturing process as implemented in Example 3, a heater chip having exactly the same structure as obtained in Example 3 was fabricated except that the height of a wall and a group of columnar members were set to 0.8 μm. The thickness of an ink layer was 0.3 μm at the heater center in an initial state.

Figure 61:
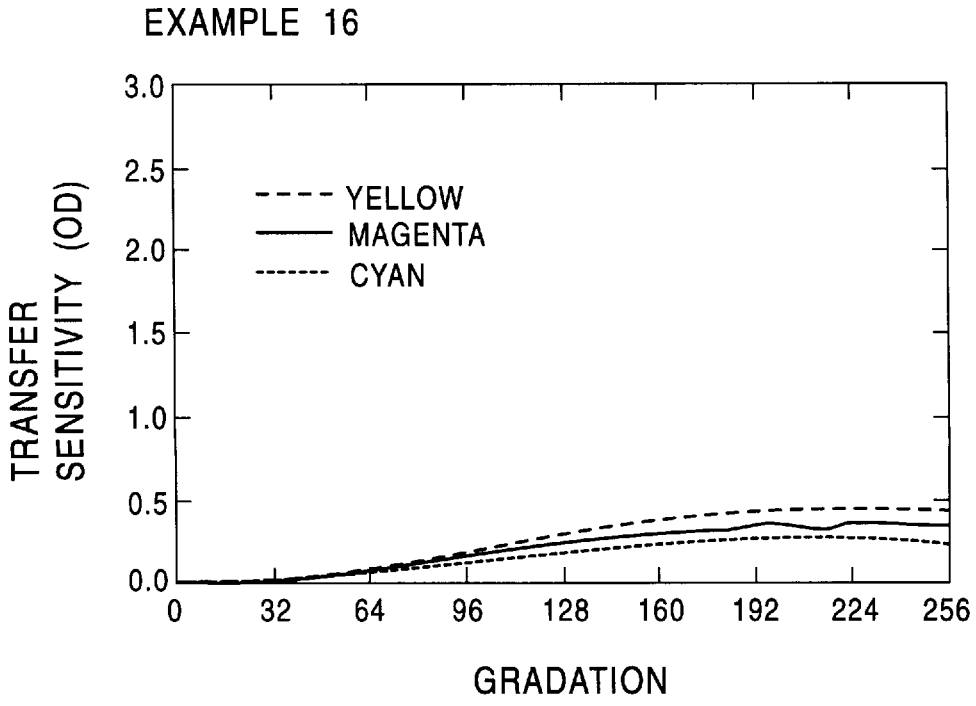
FIG. 61 is a graph showing the relationship between the number of gradation levels and transfer sensitivity in Example 16 of the present invention.

Using a printer head incorporating the above heater chip mounted therein, and the same ink and printing paper as employed in Example 1, the driving pulses shown in FIG. 36 were applied to each heater of the printer head to thereby cyclically heat the ink surface. As a result, the Marangoni flow was produced during heating by the heater, but because of sufficient supply of the ink, a tendency of transfer sensitivity to reach saturation soon was observed as shown in FIG. 61.

EXAMPLE 17

Using the same printer head, printer construction, and printing paper as employed in Example 3, the driving pulses shown in FIG. 36 were applied to each heater of the printer head for continuous driving. However, an ink solvent was changed from dibutyl phthalate to toluene (boiling point: 110.6° C.).

As a result, mists were ejected attributable to the Marangoni flow, but because of the low boiling point of toluene, a tendency of causing the ink to boil and the transfer operation to become unstable was observed. Also, during storage, only the ink solvent, i.e., toluene, was evaporated from the transfer section, and the condensed dye was precipitated at the bottom of the transfer section. The printer head was continuously driven upon application of the driving pulses shown in FIG. 36, but mists were not sufficiently ejected.

EXAMPLE 18

In a similar heater chip manufacturing process as implemented in Example 6, an opening was formed in a nickel sheet in a circular shape having a diameter of 20 μm. When the ink was introduced to a printer head incorporating a heater chip thus fabricated and mounted therein, the ink was stopped at a line where the underside of the nickel sheet joined with the opening in the nickel sheet, thereby forming the meniscus extending from the line. The thickness of an ink layer was 18 μm at the heater center.

A certain image was transferred by using the above printer head, and the same printer construction, ink, printing paper, and driving method as employed in Example 1. Because of an opening area being too small, however, a sufficient temperature gradient was not developed in the ink surface. As a result, the Marangoni flow was hardly produced and the transfer of the ink was insufficient.

EXAMPLE 19

In a similar heater chip manufacturing process as implemented in Example 3, a silane coupling agent substituted by a perfluoroalkyl radical was coated on the wall and the columnar members, and then fixed by heat treatment at 200° C. for five minutes. The side surfaces of the wall and the columnar members and the bottom surface of the transfer section were covered by the perfluoroalkyl radical, and exhibited a contact angle of 80° with respect to the same ink as used in Example 3.

A certain image was transferred by using a printer head thus fabricated, and the same printer construction, ink, printing paper, and driving method as employed in Example 3. Because of poor wetting of the ink with respect to the transfer section, however, a speed of restoring of the ink surface was extremely slowed and the transfer of the ink was insufficient.

EXAMPLE 20

In a similar heater chip manufacturing process as implemented in Example 9, a printer head was fabricated in the same manner as that in Example 9 except that materials of a heater chip and a base plate were changed to soda glass (thermal conductivity: 0.6 W/m.k). Then, a certain image was transferred under the same conditions as those in Example 9.

Because of the thermal conductivity of the printer head being too low, a temperature rise occurred in entirety of the printer head and a developed temperature gradient was small. As a result, there was observed such a tendency that a magnitude of the Marangoni flow was gradually reduced and so did the transfer speed.

EXAMPLE 21

In a similar heater chip manufacturing process as implemented in Example 1, a printer head was fabricated in the same manner as that in Example 1 except the heater size. In this Example, heaters were each formed into a square with one side of 60 μm (maximum dimension width of 120 μm). Then, a certain image was transferred under the same conditions as those in Example 9.

Because of the heater having a too large area, the ink was not locally heated and a developed temperature gradient was small. As a result, the Marangoni flow was hardly produced and the transfer of the ink was insufficinet.

EXAMPLE 22

A certain image was transferred by using the same printer head, printer construction, printing paper, and driving method as employed in Example 4 except the ink. An aniline-base cyan dye was used as ink. This dye produced a pyrolysate of 500 ppm when heated at 200° C. in air for one hour.

Figure 62:
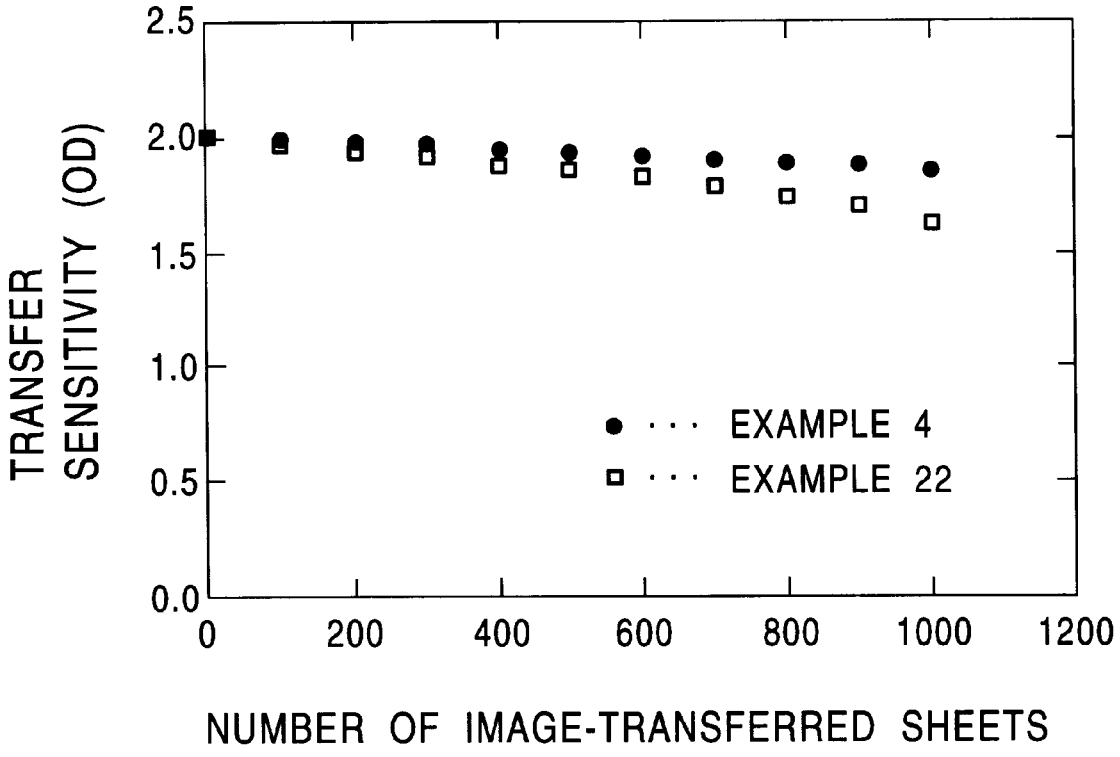
FIG. 62 is a graph showing changes in transfer sensitivity depending on the number of sheets subjected to transfer in Examples 4 and 22.

As a result, the initial transfer sensitivity was exactly the same as obtained in Example 4, but after transferring an image onto 1000 sheets in terms of A6 size, the transfer sensitivity was reduced over 10% in comparison with Example 4 as plotted in FIG. 62.

Observing the transfer section of the printer head during the above transfer operation with a microscope, foreign matters having diameters 1 to 3 μm adhered thereon in the form of pillars or columns. Element analysis of the foreign matters using EDX (Energy Dispersed X-ray Spectroscopy) proved that most of them was carbon. Adhesion of carbon impeded supply of the ink and showed a tendency of reducing the transfer sensitivity.

EXAMPLE 23

A certain image was transferred by using the same printer head as obtained in Example 3, and the same printer construction, printing paper, and driving method as employed in Example 1 except the ink. Ink was prepared by adding, as a surfactant, 0.1% by weight of perfluorohexyl-hexanoate ($C_6H_{13}COOC_6F_{13}$) having the boiling point 50° C. or more lower than that of dibutyl phthalate as the ink solvent, to the same ink as employed in Example 1. With the addition of the perfluorohexyl-hexanoate, the surface tension of the ink in its entirety lowered from 35 dyn/cm to 14 dyn/cm.

When a heater is energized for driving the head, the perfluorohexyl-hexanoate was selectively evaporated and lost from the ink residing near the heater center, and the surface tension of the ink at the heater center increased from 14 dyn/cm to 28 dyn/cm. As a result, the Marangoni flow was produced in a direction opposed to the direction occurred in Example 1, thus causing ink traveling waves to collide against each other above the heater. With such a mechanism, the ink in the transfer section was ejected in the form of a mist having a size of about 0.45 pico-liter at maximum (see FIG. 3). All mists having sizes not smaller than 0.01 pico-liter were forced to fly over a gap of 100 μm and stick onto a sheet of printing paper. After sticking onto the sheet of printing paper, the mists were absorbed into the paper and developed the color immediately. The concentration of the perfluorohexyl-hexanoate in the ink at the heater center was returned to a normal value upon the ink flow. During the pause time for each period of time (cycle) necessary for forming one pixel, the ink surface completely restored to the initial state.

Figure 63:
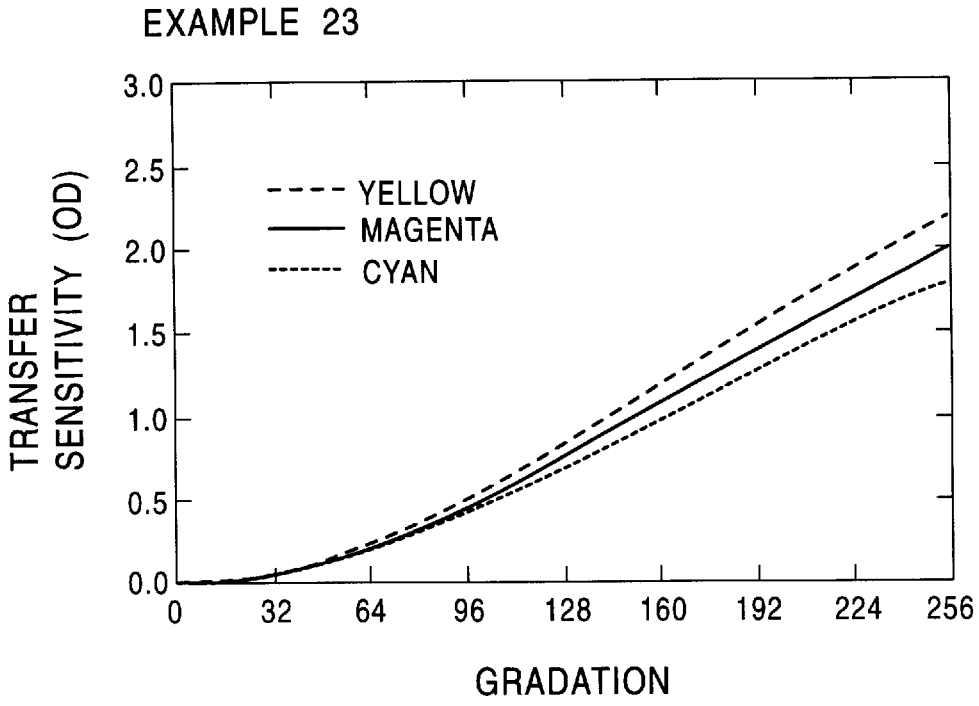
FIG. 63 is a graph showing the relationship between the number of gradation levels and transfer sensitivity in Example 23 of the present invention.

FIG. 63 shows the relationship between the number of gradation levels (the number of pulses applied per pixel) and the reflection density (OD) obtained for this Example from measurement using a Macbeth densitometer. It is seen from FIG. 63 that a half-tone image can be achieved with a gradation of 64 or more levels per pixel. In this Example 23, a minimum time and energy required for obtaining a cyan pixel of OD=2.0 were 4.5 msec and 75 μJ, respectively. Calculating, based on these values, the energy and time required for transferring a typical natural picture (with average density of 0.5 for each color) of A6 size (about 8 cm×11 cm), the energy and time were 130 J and 23 sec, respectively.

EXAMPLE 24

A certain image was transferred by using the same printer head as obtained in Example 3, and the same printer construction, printing paper, and driving method as employed in Example 1 except that heaters 84 provided in a printer head were divided into two parts for each transfer section 1*d*, as shown in FIG. 44.

Figure 47A:
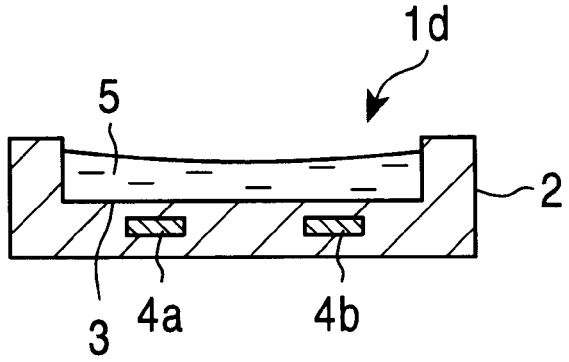
FIGS. 47A to 47C are a schematic view for explaining principles of transfer when the head chip shown in FIG. 46 is employed.
Figure 47B:
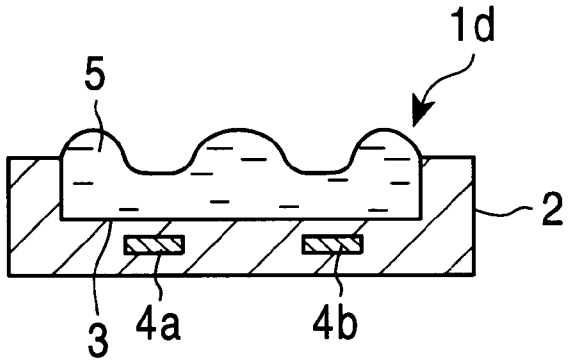
Figure 47C:
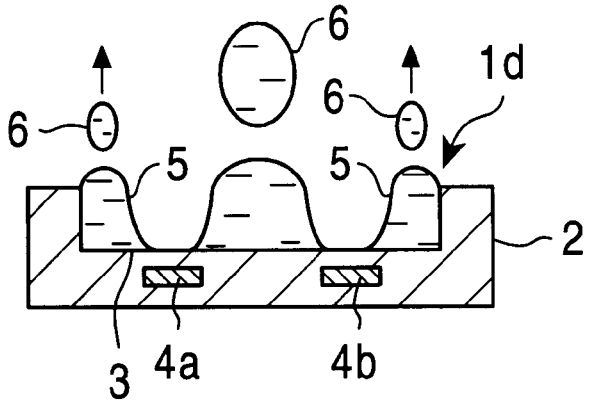

Referring to FIG. 47A, when predetermined driving pulses were applied to two heaters 84 provided in the transfer section ld for driving the head, the Marangoni flows were simultaneously produced by two heaters 4*a* and 4*b* (corresponding to the heaters 84 in FIG. 44) with a similar mechanism as in Example 3. Then, as shown in FIG. 47B, ink traveling waves generated at the centers of the two heaters collided against each other, and these ink traveling waves collided against ink holding means 2 (in the form of a wall and concave/convex structures (columnar structures) in this Example). With such a mechanism, as shown in FIG. 47C, ink 5 in the transfer section 1*d* was ejected in the form of a mist 6 having a size of about 0.5 pico-liter at maximum.

All mists having sizes not smaller than 0.01 pico-liter were forced to fly over a gap of 100 μm and stick onto a sheet of printing paper. After sticking onto the sheet of printing paper, the mists were absorbed into the paper and developed the color immediately. The ink density at the heater center was returned to a normal value upon the ink flow. During the pause time for each period of time (cycle) necessary for forming one pixel, the ink surface completely restored to the initial state.

Figure 64:
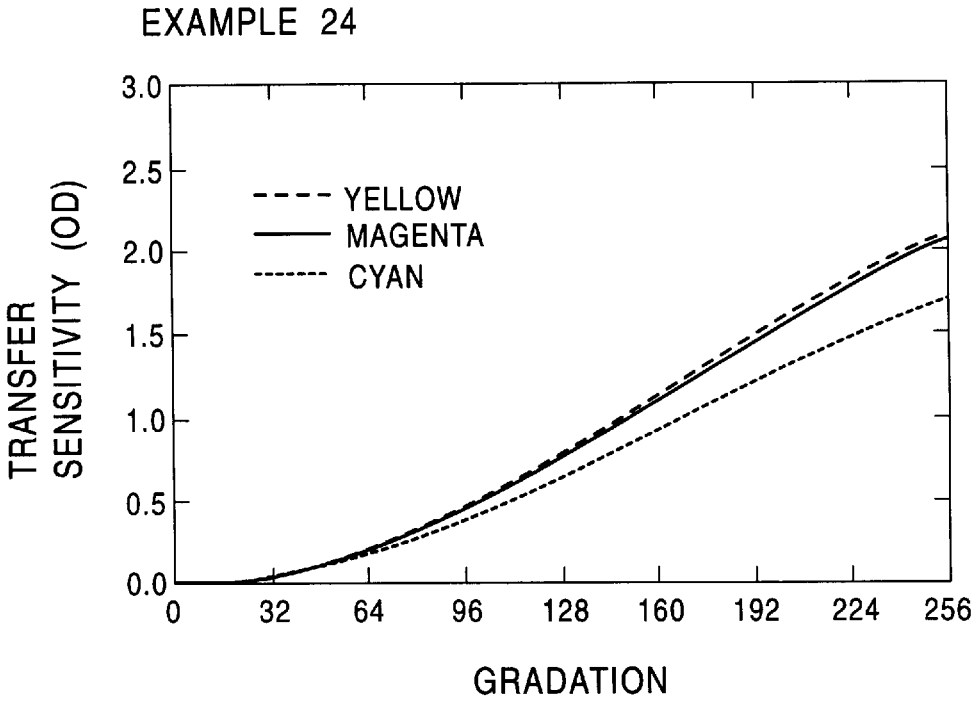
FIG. 64 is a graph showing the relationship between the number of gradation levels and transfer sensitivity in Example 24 of the present invention.

FIG. 64 shows the relationship between the number of gradation levels (the number of pulses applied per pixel) and the reflection density (OD) obtained for this Example from measurement using a Macbeth densitometer. It is seen from FIG. 64 that a half-tone image can be achieved with a gradation of 64 or more levels per pixel. In this Example 24, a minimum time and energy required for obtaining a cyan pixel of OD=2.0 were 4.8 msec and 88 μJ, respectively. Calculating, based on these values, the energy and time required for transferring a typical natural picture (with average density of 0.5 for each color) of A6 size (about 8 cm×11 cm), the energy and time were 150 J and 25 sec, respectively.

Further, as shown in FIG. 45, heaters 85 provided in a printer head were divided into four parts for each transfer section, and each pair of the heaters 85 were interconnected by wiring materials 100 (which were patterned at the same time as forming the electrodes 62, 63). With this printer head, the Marangoni flows were produced upon heating by the four heaters. In addition, with a printer head including ring-shaped heaters 86 as shown in FIG. 46, the Marangoni flows was also produced corresponding to the heater shape. In any of these cases, good transfer sensitivity was obtained.

EXAMPLE 25

Figure 69:
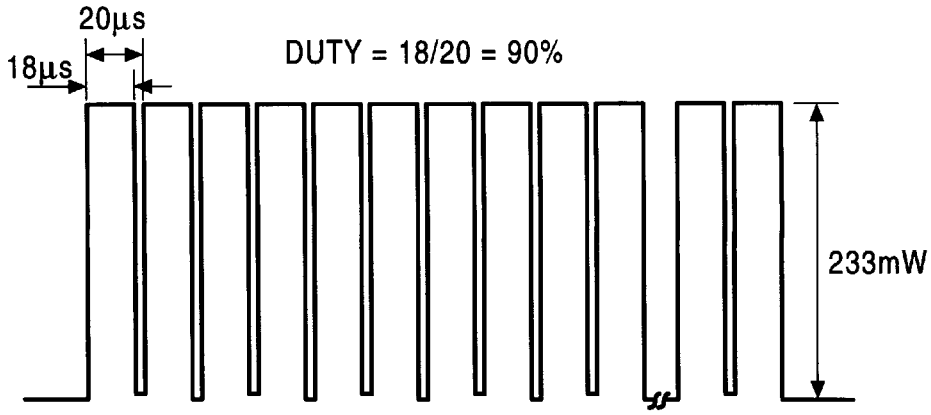
FIG. 69 is a schematic chart showing the waveform of driving pulses used in Example 25 of the present invention.

A certain image was transferred by using the same printer heads, printer construction, ink, and printing paper as employed in Examples 1 and 3 except the driving method. In this Example, the printer heads were driven with driving pulses having a duty of 90%, power of 233 mW, and average power of 210 mW, as shown in FIG. 69.

As a result, the ink was forced to fly in the form of vaporized matters and small mist particles generated by condensation of the vaporized matters. Because of being too small in volume, the flying mists lost their speeds at once and the transfer sensitivity was insufficient. Also, there was observed such a tendency that impurities having the relatively high boiling points and contained in the ink in trace amount, such as silica particles and metal powder, adhered to the transfer section upon fusing.

EXAMPLE 26

Figure 70:
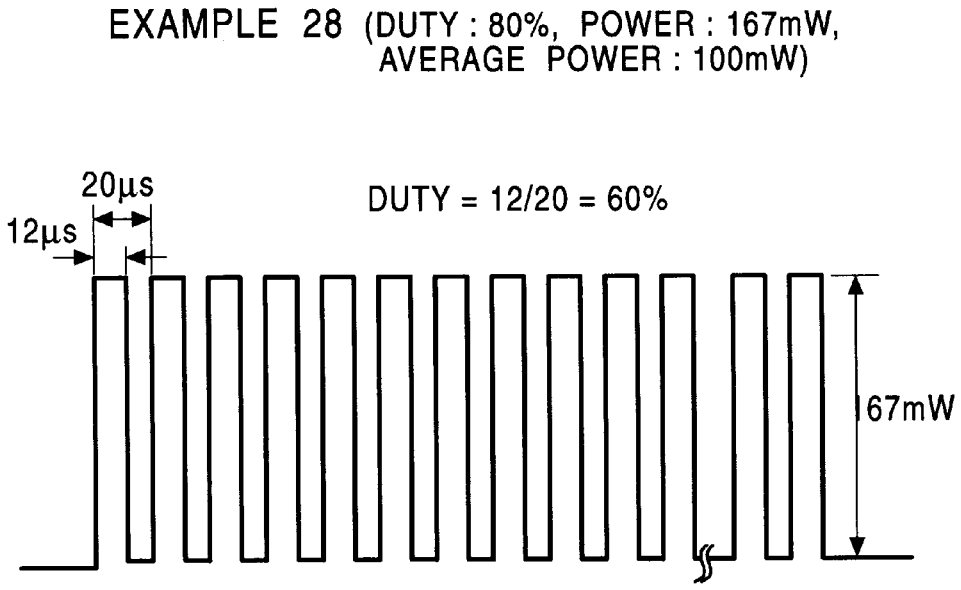
FIG. 70 is a schematic chart showing the waveform of driving pulses used in Example 26 of the present invention.
Figure 71:
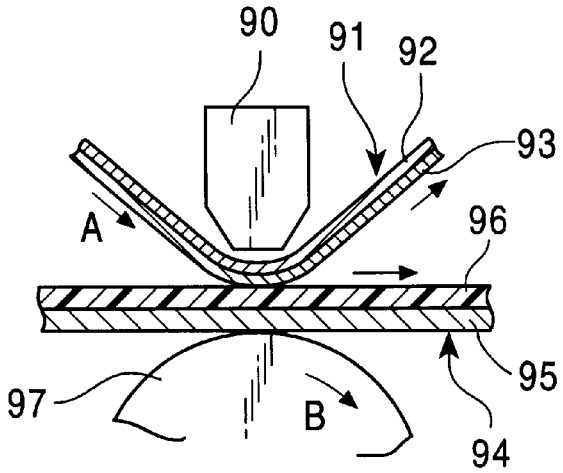
FIG. 71 is a schematic view showing the construction a conventional printer in accordance with the dye diffusion thermal transfer process.

A certain image was transferred by using the same printer head as obtained in Example 3, and the same printer construction, ink, and printing paper as employed in Example 1 except the driving method. In this Example, the printer head was driven with driving pulses having a duty of 60%, power of 167 mW, and average power of 100 mW, as shown in FIG. 70.

As a result, the ink was forced to fly in the form of vaporized matters, small mist particles and large mist particles, and the transfer sensitivity (OD) was sufficiently as high as 1.4 or more. From comparing with Example 25, it was also found that sufficiently good transfer was achieved even with a half or more reduction of the average power supplied.

Measurement of Optimum Height of Pillar Members

Figure 65:
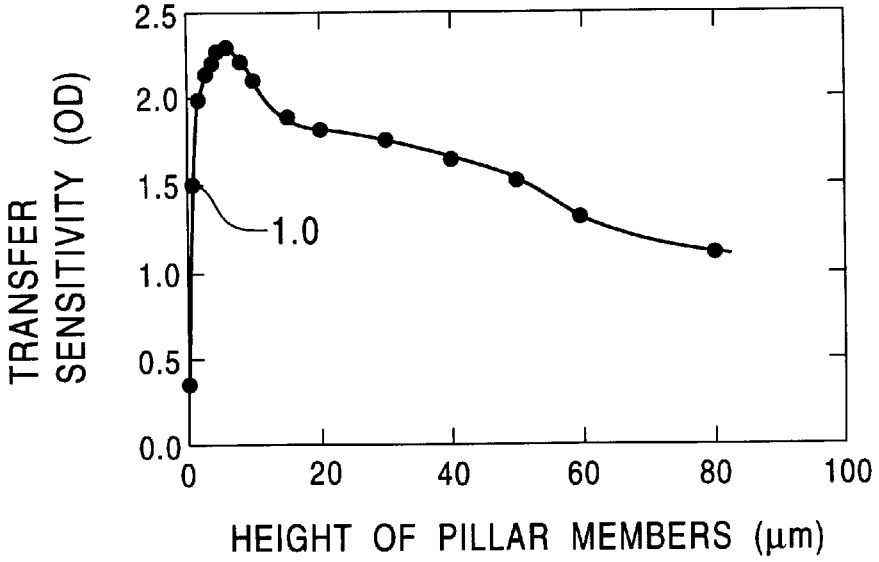
FIG. 65 is a graph showing changes in transfer sensitivity depending on the height of pillar members in the transfer section of the printer head according to the present invention.

FIG. 65 shows maximum values of transfer sensitivity resulted from preparing printer heads which had the same structure as that in Example 3, but were variously changed in height of the small concave/convex structures (pillar members), and then printing images under predetermined conditions. Printing paper used here was the same as used in Example 1, and ink used here was the same magenta ink as used in Example 1. Further, the pillar members were each a square pillar having a square section with one side of 3 μm, and the center-to-center distance between the adjacent pillar members was 6 μm.

As seen from FIG. 65, the transfer sensitivity of OD=1.5 or more, that is desirably required at minimum, was obtained when the height of the pillar members was in the range of not smaller then 1 μm but not larger than 50 μm. In particular, when the height of the pillar members was in the range of not smaller then 2 μm but not larger than 10 μm, a sufficiently high transfer sensitivity, i.e., OD=2 or more, was obtained.

Measurement of Optimum Center-to-center Distance Between Pillar Members

Figure 66:
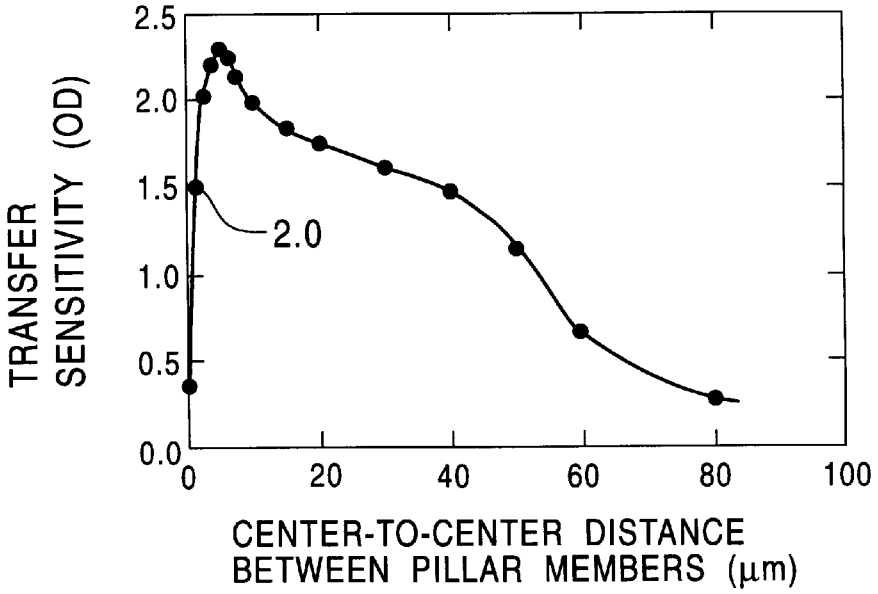
FIG. 66 is a graph showing changes in transfer sensitivity depending on the center-to-center distance between the pillar members in the transfer section of the printer head according to the present invention.

FIG. 66 shows maximum values of transfer sensitivity resulted from preparing printer heads which had the same structure as that in Example 3, but were variously changed in center-to-center distance between the small concave/convex structures (pillar members), and then printing images under predetermined conditions. Printing paper used here was the same as used in Example 1, and ink used here was the same magenta ink as used in Example 1. Further, the pillar members were each a square pillar having a square section with one side of 3 μm, and the height of the pillar members was 6 μm. When the center-to-center distance between the adjacent pillar members was 3 μm, the length of one side in section of each pillar member was set to 2 μm; when the center-to-center distance was 2 μm, the length of one side of the pillar section was set to 1 μm; and when the center-to-center distance was 1 μm, the length of one side of the pillar section was set to 0.5 μm.

As seen from FIG. 66, the transfer sensitivity of OD=1.5 or more, that is desirably required at minimum, was obtained when the center-to-center distance between the adjacent pillar members was in the range of not smaller then 2 μm but not larger than 40 μm. In particular, when the center-to-center distance between the adjacent pillar members was in the range of not smaller then 2 μm but not larger than 10 μm, a sufficiently high transfer sensitivity, i.e., OD=2 or more, was obtained.

Measurement of Ejection Modes Depending upon Power and Duty Applied in Driving

Figure 67:
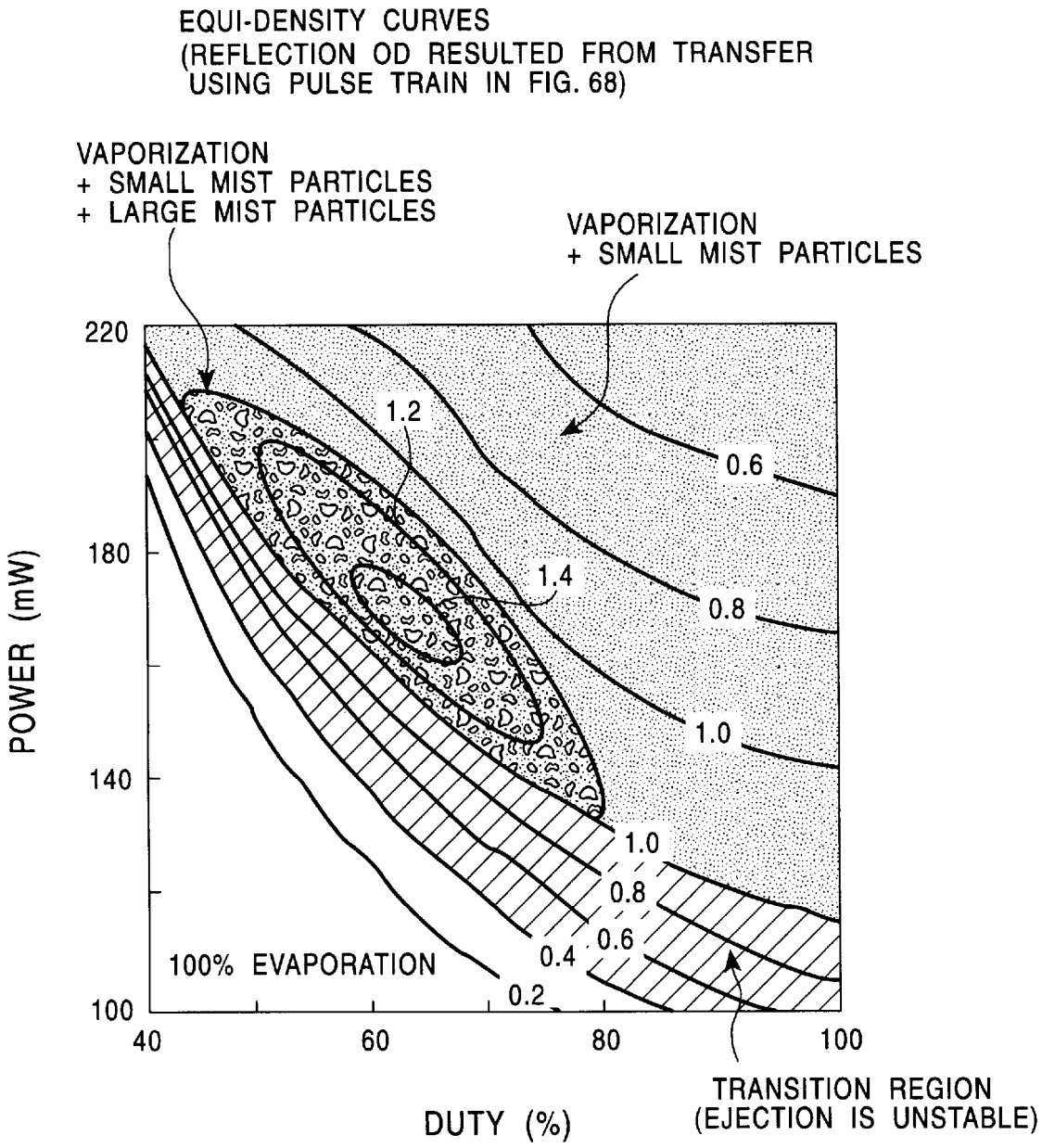
FIG. 67 is a graph showing contour lines of transfer sensitivity (equi-density lines) as a function of power and duty with a driving method according to the present invention.
Figure 68:
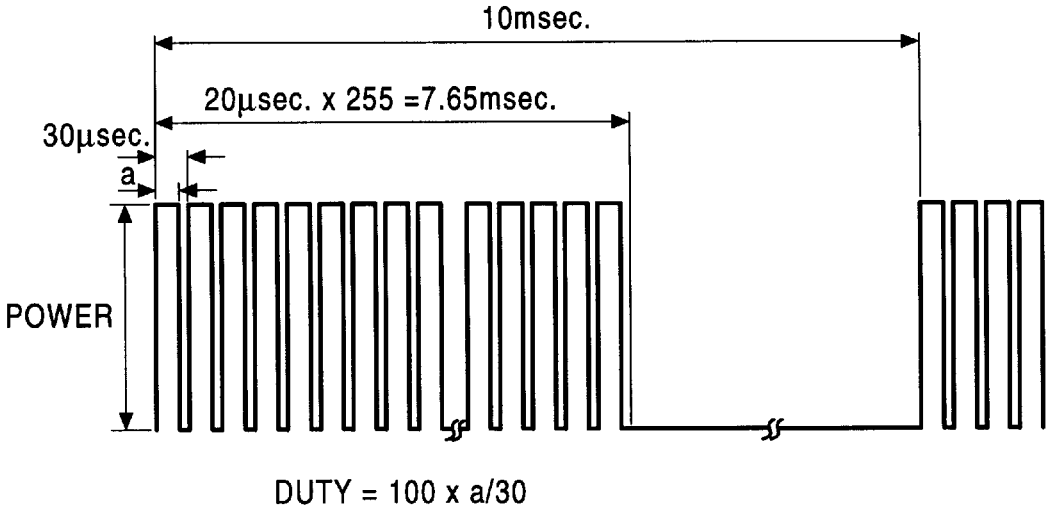
FIG. 68 is a schematic chart showing the waveform of driving pulses used in the driving method according to the present invention.

FIG. 67 shows results of measuring contour lines of transfer sensitivity (equi-density lines) as a function of power (heater driving voltage) and duty (duty ratio of a pulse signal) by using the same printer head as obtained in Example 1. Driving pulses were set as shown in FIG. 68. Specifically, a basic cycle was 30 μsec, an on-time of the driving voltage was 12 to 30 μsec (i.e., duty in the range of 40 to 100%), and a one-dot period was the sum of 255 basic pulses repeatedly applied and a pause time of 35 msec. Printing paper and ink were the same as those used in Example 1, and evaluation was made for the case of using magenta ink.

A lower-left white region in FIG. 67 represents an ejection mode in which the ink is ejected in the completely vaporized form during the transfer operation. In this condition, the transfer sensitivity was low and a selective vaporization phenomenon of the solvent due to a difference in boiling point between the solvent and the coloring matter in the ink was observed.

An upper-right region (light gray) occupying a large part in FIG. 67 represents an ejection mode in which the ink residing in the vaporizing (transfer) section above the heater continues "escaping" from there during the transfer operation. In this mode, the ink was ejected in the form of vaporized matters and small mist particles having diameters not larger than 1 μm during the transfer operation. Since a part of the ink was ejected in the form of small mist particles, a selective vaporization phenomenon of the solvent was not observed. Also, the transfer sensitivity was relatively high (OD=about 0.6 to 1).

An central region (dark gray) in FIG. 67 represents an ejection mode in which the ink residing in the vaporizing section above the heater continues "escaping" from and "returning" to there during the transfer operation. In this mode, the ink was ejected in the form of vaporized matters, small mist particles having diameters not larger than 1 μm, and large mist particles having diameters not smaller than 2 μm during the transfer operation. Since a part of the ink was ejected in the form of small and large mist particles, a selective vaporization phenomenon of the solvent was not observed. Also, the transfer sensitivity was relatively high (OD=about 1.2).

A region (hatched) extending from the upper-left corner to the lower-right corner in FIG. 67 represents a transition region between the ejection in the form of vaporized matters and the ejection in the form of small particles. In this region, the "escaping" phenomenon was basically observed, and the ink was ejected in the form of vaporized matters and small mist particles. However, when the "escaping" phenomenon disappeared due to, e.g., the occurrence of fusing of impurities, the ejection mode was abruptly changed to the completely vaporized form. Hence the ejection behavior of mists were relatively unstable.

With the preferred Examples of the present invention described above, it is possible to sufficiently realize printer heads (recording apparatus) which can satisfy high image quality comparable to that of silver salt prints, and output an image of, e.g., A6 size within 10 seconds (not less than 6 ppm), while ensuring a satisfactorily low running cost and apparatus cost (about hundred thousand yen or below).

According to the present invention, as described above, in a recording method including the steps of forcing a recording material held in a transfer section to fly upon heating by heating means and transferring a predetermined image onto a transfer target member that is placed opposite to the transfer section, the method comprises the steps of developing a surface tension gradient and/or an interface tension gradient in the surface of the recording material (ink) under resistance heating, laser-beam heating or the like, and flying the recording material by utilizing flowage of the recording material caused by the surface tension gradient and/or the interface tension gradient.

Therefore, the recording material can be forced to fly in the form of a mist including relatively larger mist particles, and the transfer sensitivity per unit time is improved. As a result, a recording method superior in transfer sensitivity and transfer speed can be realized.

In particular, the recording method of the present invention can efficiently force the above-mentioned mist to fly in the form of relatively large mist particles having diameters not smaller than 2 μm, for example. The large mist particle has a volume about 1000 times as much as those of vaporized matters and small mist particles produced by the conventional dye vaporization thermal transfer process. Accordingly, the transfer sensitivity per unit time can be improved on the order of 2 to 10 times. Further, since a surface tension gradient and/or an interface tension gradient is developed in the surface of the recording material and flowage of the recording material caused by such a gradient is utilized as driving forces to fly the recording material, it requires energy to be supplied for heating only about ½ to ⅓ of that required in the conventional dye vaporization thermal transfer process which utilizes vaporization or ablation alone, and can avoid fusing of nonvolatile impurities due to high temperatures and long-time residence of the ink. In total, the recording method of the present invention can increase the operating efficiency 4 to 30 times that obtainable with the conventional dye vaporization thermal transfer process.

Also, the recording apparatus of the present comprises a transfer section disposed opposite to a transfer target member, heating means for heating a recording material held in the transfer section to fly the recording material, and recording material flying means for developing a surface tension gradient and/or an interface tension gradient in the recording material under the heating, and flying the recording material by utilizing flowage of the recording material caused by the surface tension gradient and/or the interface tension gradient. Therefore, the recording method of the present invention can be implemented by the above apparatus with good reproducibility.

What is claimed is:

1. A recording method including the steps of forcing a recording material held in a transfer section to fly upon heating by a heater and transferring said recording material onto a transfer target member that is placed opposite to said transfer section, said method comprising the steps of:

providing a supply of recording material in a transfer section comprising a structure comprising a bottom connected to at least one upwardly extending sidewall, the bottom comprising a heater in a heating area thereof developing a surface tension gradient and/or an interface tension gradient in the surface of said recording material by activating and deactivating the heater, and flying a plurality of mist particles of said recording material by utilizing flowage of said recording material caused by said surface tension gradient and/or said interface tension gradient resulting in a generation of a plurality of waves of recording material in the structure and the collision of at least two of the waves with the sidewall resulting in an election of at least two mist particles of recording material towards the transfer target member, and further resulting in the collision of at least two waves with each other resulting in an election of at least another mist particle towards the transfer target member.

2. A recording method according to claim 1, wherein said method comprises the steps of applying a temperature gradient to said recording material with the heater, developing at least said surface tension gradient in accordance with said temperature gradient, and electing said mist particles by utilizing, as driving forces, flowage of said recording material caused by said surface tension gradient.

3. A recording method according to claim 2, wherein said method comprises the step of causing the flowage of said recording material in a direction from a heating area heated by said heater to a peripheral area or a direction opposed to said direction.

4. A recording method according to claim 3, wherein said method comprises the step of causing at least one of:

the flowage of said recording material in the direction from the heating area to the sidewall while the heater is activated, and the flowage of said recording material in the direction from the sidewall to the heating area under cooling, the flowage being attributable to a meniscus restoring force in the surface of said recording material, and/or capillary attraction developed in said transfer section.

5. A recording method according to claim 3, wherein said method comprises the step of flying said recording material based on at least one of:

collision between a traveling wave of said recording material and the sidewall as the traveling wave flows from the heating area and towards the sidewall, collision between two traveling waves of said recording material flowing from the sidewalk towards the heating area, collision between a traveling wave of said recording material flowing from the heating area towards the sidewall and a traveling wave of said recording material flowing from the sidewall towards the heating area, and resonation of a standing wave of said recording material with a traveling wave of said recording material flowing from the heating area towards the sidewall and a traveling wave of said recording material flowing from the sidewall towards the heating area.

6. A recording method according to claim 5, wherein said sidewall is disposed within the range of 50 μm from the center of the heating area on at least one side thereof, said sidewall having a height not smaller than 1 μm but not larger than 50 μm.

7. A recording method according to claim 5, wherein said structure comprises a member having an opening formed to position above the heating area, said member having an opening area not smaller than 1000 $\mu m^2$ but not larger than 50000 $\mu m^2$, said member defining a thickness of said recording material to be not smaller than 1 μm but not larger than 50 μm, and mist particles of said recording material flying from said structure have a maximum cross-sectional area, in terms of perfect sphere, not more than 1/10 of said opening area.

8. A recording method according to claim 5, wherein said structure comprises a member having a slit formed to position above the heating area, said slit having an average width not smaller than 30 μm but not larger than 500 μm, said member defining a thickness of said recording material to be not smaller than 1 μm but not larger than 50 μm, and mist particles of said recording material flying from said transfer section have a diameter, in terms of perfect sphere, not more than 1/3 of the average width of said slit.

9. A recording method according to claim 5, wherein a thickness of said recording material held in said structure is defined only by said sidewall.

10. A recording method according to claim 9, wherein a contact angle Θ1 of said recording material with respect to a bottom surface of said structure and a side or back surface of said sidewall is not larger than 60° at temperatures not lower than 0° C. but not higher than 200° C.

11. A recording method according to claim 9, wherein a contact angle $\theta_2$ of said recording material with respect to an upper portion surface of said sidewall and a side surface of an opening in a member, which has the opening formed to position above the heating area and defines a thickness of said recording material, is not smaller than 75°.

12. A recording method according to claim 11, wherein said sidewall and/or said member is made of a liquid repellent material, or said sidewall and/or said member is treated to be liquid repellent so that the contact angle Θ2 of said recording material is held not smaller than 75°, and said member having the opening is disposed on the same side as said transfer target member with a predetermined gap left between said member and the surface of said recording material.

13. A recording method according to claim 2, wherein said method comprises the step of flowing said recording material based on:

among the Marangoni flow caused by said surface tension gradient in said recording material in accordance with said temperature gradient, the Marangoni flow caused by an interface tension gradient between said recording material and a bottom surface of said transfer section in accordance with said temperature gradient, the Marangoni flow caused by a density distribution of a substance constituting said recording material, and the Marangoni flow caused by selective evaporation of a surfactant contained in said recording material, at least the Marangoni flow caused by said surface tension gradient.

14. A recording method according to claim 1, wherein said heater performs cyclic heating to flow said recording material cyclically.

15. A recording method according to claim 14, wherein said cyclic heating is performed by applying a rectangular-wave signal having a duty of not smaller than 20% to said heater.

16. A recording method according to claim 14, wherein said cyclic heating is performed by applying a triangular or sawtooth signal having a duty of not smaller than 20% to said therefore.

17. A recording method according to claim 14, wherein said cyclic heating is performed by applying a pulse signal having a duty of not smaller than 40% but not larger than 80% and power not smaller than 130 mW but not larger than 210 mW.

18. A recording method according to claim 17, wherein said pulse signal and an interval are applied within a period of time necessary for forming one pixel.

19. A recording method according to claim 1, wherein said recording material is forced to flow such that at least a part of the bottom of said structure is exposed.

20. A recording method according to claim 19, wherein the bottom said structure is cyclically exposed and covered with the flowage of said recording material.

21. A recording method according to claim 19, wherein an exposed area of the bottom of said structure is cyclically moved.

22. A recording method according to claim 19, wherein an exposed area of the bottom of said structure is not completely covered and cyclically moved.

23. A recording method according to claim 1, wherein said sidewall comprises at least four pillar or conical convex portions each arranged within the range of 20 μm from the center of the heating area and having a height not smaller than 1 μm but not larger than 50 μm, a width not smaller than 1 μm but not larger than 10 μm, and a center-to-center distance not smaller than 2 μm but not larger than 40 μm, said concave/convex structure being arranged in a cyclic or not-cyclic pattern.

24. A recording method according to claim 1, wherein said recording material held near said heating means vaporizes only from the gas and liquid interface.

25. A recording method according to claim 1, wherein an amount of said recording material forced to fly upon the flowage of said recording material is not larger than one pico-liter.

26. A recording method according to claim 1, wherein said transfer section is made of materials containing not less than 90% by weight of a substance that has thermal conductivity not less than 1 W/m·K at temperatures not lower than 0° C. but not higher than 200° C.

27. A recording method according to claim 1, wherein said heater comprises resistance heating mechanism provided below said bottom and having a maximum size not larger than 60 μm.

28. A recording method according to claim 1, wherein an opto-thermic transducing substance is contained as at least a part of substances making up said recording material, and said recording material is forced to fly by using a laser beam as said heating means and irradiating the laser beam to the opto-thermic transducing substance.

29. A recording method according to claim 1, wherein an opto-thermic transducing substance is added to at least a part of substances making up said transfer section, and said recording material is forced to fly by using a laser beam as said heating means and irradiating the laser beam to the opto-thermic transducing substance.

30. A recording method according to claim 1, wherein a therefore having the boiling point not lower than 250° C. at the atmospheric pressure is selected as said recording material.

31. A recording method according to claim 1, wherein a substance producing a pyrolysate of not larger than 100 ppm when heated at the normal pressure and a temperature of 200° C. in air for one hour, is selected as said recording material.

32. A recording method according to claim 1, wherein a distance between the surface of said recording material held in said transfer section and said transfer target member is set to be not smaller than 50 μm but not larger than 2000 μm.

33. A recording method according to claim 1, wherein a sheet of porous printing paper having an average pore size not smaller than 0.05 μm but not larger than 20 μm is used as said transfer target member.

34. A recording method according to claim 1, wherein said recording material is added with a surfactant having the boiling point 20° C. or more lower than that of a solvent of said recording material at the normal pressure.

35. A recording method according to claim 1, wherein said heaters comprises a plurality of heating means provided in the bottom of each structure of said transfer section.

36. A recording method according to claim 1, wherein said heater comprises ring-shaped heater provided in the bottom of the structure of said transfer section.

37. A recording apparatus comprising:

a transfer section disposed opposite to a transfer target member, the transfer section comprising a structure comprising a bottom connected to, at least one, upwardly extending sidewall, for heating a recording material held in said structure to fly said recording material, and recording material flying means for developing a surface tension gradient and/or an interface tension gradient in said recording material by activating and deactivating the heater, and flying said recording material by utilizing flowage of said recording material caused by said surface tension gradient and/or said interface tension gradient resulting in a generation of a plurality of waves of recording material in the structure and the collision of at least two of the waves with the sidewall resulting in an election of at least two mist particles of recording material towards the transfer target member, and further resulting in the collision of at least two waves with each other resulting in an ejection of at least another mist particle towards the transfer target member.

38. A recording apparatus according to claim 37, wherein said heater performs cyclic heating to flow said recording material cyclically.

39. A recording apparatus according to claim 38, wherein said cyclic heating is performed by applying a rectangular-wave signal having a duty of not smaller than 20% to said heater.

40. A recording apparatus according to claim 38, wherein said cyclic heating is performed by applying a triangular or sawtooth signal having a duty of not smaller than 20% to said heating means.

41. A recording apparatus according to claim 38, wherein said cyclic heating is performed with signal applying means for applying a pulse signal having a duty of not smaller than 40% but not larger than 80% and power not smaller than 130 mW but not larger than 210 mW.

42. A recording apparatus according to claim 41, wherein said pulse signal and an interval are applied within a period of time necessary for forming one pixel.

43. A recording apparatus according to claim 37, wherein said sidewall comprises a small concave/convex structure.

44. A recording apparatus according to claim 43, wherein said concave/convex structure is formed by at least four pillar or conical convex portions each arranged within the range of 20 μm from a center of the heating area and having a height not smaller than 1 μm but not larger than 50 μm, a width not smaller than 1 μm but not larger than 10 μm, and a center-to-center distance not smaller than 2 μm but not larger than 40 μm, said concave/convex structure being arranged in a cyclic or not-cyclic pattern.

45. A recording apparatus according to claim 37, wherein said sidewall is disposed within the range of 50 μm from a center of the heating area on at least one side thereof, said sidewall having a height not smaller than 1 μm but not larger than 50 μm.

46. A recording apparatus according to claim 37, wherein said structure comprises a member having an opening formed to position above the heating area, said member having an opening area not smaller than 1000 $\mu m^2$ but not larger than 50000 $\mu m^2$, said member defining a thickness of said recording material to be not smaller than 1 μm but not larger than 50 μm, and mist particles of said recording material flying from said transfer section have a maximum cross-sectional area, in terms of perfect sphere, not more than 1/10 of said opening area.

47. A recording apparatus according to claim 37, wherein said structure comprises a member having a slit formed to position above the heating area, said slit having an average width not smaller than 30 μm but not larger than 500 μm, said member defining a thickness of said recording material to be not smaller than 1 μm but not larger than 50 μm, and mist particles of said recording material flying from said transfer section have a diameter, in terms of perfect sphere, not more than 1/3 of the average width of said slit.

48. A recording apparatus according to claim 37, wherein a thickness of said recording material held in said transfer section is defined only by said structure.

49. A recording apparatus according to claim 48, wherein a contact angle $\theta_1$ of said recording material with respect to the bottom surface of said structure and said sidewall is not larger than 60° at temperatures not lower than 0° C. but not higher than 200° C.

50. A recording apparatus according to claim 48, wherein a contact angle $\theta_2$ of said recording material with respect to an upper portion surface of said sidewall and a side surface of an opening in a member, which has the opening formed to position above the heating area and defines a thickness of said recording material, is not smaller than 75°.

51. A recording apparatus according to claim 50, wherein said sidewall and/or said member is made of a liquid repellent material, or said sidewall and/or said member is treated to be liquid repellent so that the contact angle $\theta_2$ of said recording material is held not smaller than 75°, and said member having the opening is disposed on the same side as said transfer target member with a predetermined gap left between said member and the surface of said recording material.

52. A recording apparatus according to claim 37, wherein said transfer section is made of materials containing not less than 90% by weight of a substance that has thermal conductivity not less than 1 W/m·K at temperatures not lower than 0° C. but not higher than 200° C.

53. A recording apparatus according to claim 37, wherein said heating means comprises resistance heater provided below said transfer section and having a maximum size not larger than 60 $\mu$m.

54. A recording apparatus according to claim 37, wherein an opto-thermic transducing substance is added to at least a part of substances making up said transfer section, and said recording material is forced to fly by using a laser beam as said heating means and irradiating the laser beam to the opto-thermic transducing substance.

55. A recording apparatus according to claim 37, wherein said heating means comprises a plurality of heaters provided in one said transfer section.

56. A recording apparatus according to claim 37, wherein said heating means comprises ring-shaped heater provided in one said transfer section.

* * * * *